US006057086A

United States Patent [19]

Nakamura et al.

[11] Patent Number: 6,057,086

[45] Date of Patent: May 2, 2000

[54] SILVER HALIDE COLOR PHOTOGRAPHIC MATERIAL

[75] Inventors: Koichi Nakamura; Kiyoshi Takeuchi; Koki Nakamura, all of Kanagawa, Japan

[73] Assignee: Fuji Photo Film Co., Ltd., Kanagawa, Japan

[21] Appl. No.: 08/977,049

[22] Filed: Nov. 25, 1997

Related U.S. Application Data

[63] Continuation of application No. 08/607,633, Feb. 27, 1996, abandoned.

[30] Foreign Application Priority Data

Feb. 28, 1995 [JP] Japan ..... 7-063572

[51] Int. Cl.[7] ..... G03C 1/08; G03C 1/42

[52] U.S. Cl. ..... 430/543; 430/264; 430/405; 430/552; 430/554; 430/955

[58] Field of Search ..... 430/264, 405, 430/567, 481–485, 415, 543, 955, 554, 552

[56] References Cited

U.S. PATENT DOCUMENTS 4,429,036 1/1984 Hirano et al. ..... 430/405
4,839,258 6/1989 Katoh ..... 430/264
5,116,717 5/1992 Matsushita et al. ..... 430/264

FOREIGN PATENT DOCUMENTS

0545491A1 6/1992 European Pat. Off. .
0565165A1 10/1993 European Pat. Off. .

*Primary Examiner*—Thorl Chea
*Attorney, Agent, or Firm*—Sughrue, Mion, Zinn Macpeak & Seas, PLLC

[57] ABSTRACT

A silver halide color photographic material is disclosed, comprising a support having thereon photographic constituent layers containing at least one light-sensitive silver halide emulsion layer, wherein any one of the photographic constituent layers contains at least one coupler for dye formation, at least one reducing agent for color formation represented by the following formula (I) and an auxiliary developing agent and/or a precursor thereof:

$$R^{11}—NH—NH—X—R^{12} \quad (I)$$

wherein $R^{11}$ represents an aryl or heterocyclic group, $R^{12}$ represents an alkyl, alkenyl, alkynyl, aryl or heterocyclic group, and X represents $—SO_2—$, —CO—, —COCO—, —CO—O—, —CO— $N(R^{13})$—, —COCO—O—, —COCO—$N(R^{13})$— or $—SO_2—N(R^{13})$— (wherein $R^{13}$ represents a hydrogen atom or a group described for $R^{12}$).

15 Claims, No Drawings

SILVER HALIDE COLOR PHOTOGRAPHIC MATERIAL

This is a Continuation of application Ser. No. 08/607,633 filed Feb. 27, 1996 which is now being abandoned.

FILED OF THE INVENTION

The present invention relates to a silver halide color photographic material containing a light-sensitive silver halide emulsion, a coupler for dye formation and a reducing agent for color formation, and capable of image formation only by the processing in an alkali bath.

Also, the present invention relates to a silver halide color photographic material excellent in the processing stability and suitable for rapid processing by low replenishment.

Further, the present invention relates to a silver halide color photographic material reduced in stains and color mixing and capable of forming an image in a high image density.

BACKGROUND OF THE INVENTION

A silver halide color photographic material is generally subjected to color development and removal of silver to form an image. In the color development step, exposed silver halide grains are developed (reduced) by an aromatic primary amine developing agent and subsequently, the resulting oxidation product reacts with couplers to form a color image.

For example, in case of color paper processing, the development processing is conducted in an alkali bath containing 4-amino-N-ethyl-N-(β-mthanesulfonamidoethyl)-aniline sulfate as an aromatic primary amine developing agent.

Usually, the above-described color developing agent, when formulated into an alkali solution, is readily air-oxidized and extremely deteriorates. Accordingly, a large amount of preservative or a large amount of replenisher is used to maintain the solution composition or the photographic capability.

In recent years, it is being demanded in the art to reduce the environmental load or the amount of wastes and to recycle the material to be thrown away and as a result, reduction of processing chemicals for the above-described color developer and replenishment greatly lowered in the replenishing amount are being aggressively investigated.

However, in order to maintain the photographic capability both in a continuous processing and in a laisured processing, it is the status quo that although the replenishing amount is reduced, the processing chemicals in the replenisher are on the contrary concentrated, thus, the reduction of the processing chemicals is not yet achieved. Further, another problem arises that when low replenishment is practiced, stains and change in the photographic capability due to accumulated components remarkably increase.

As an effective means for overcoming the problems in reducing processing chemicals and practicing low replenishment, it is proposed to incorporate a color developing agent or a precursor thereof into the light-sensitive material as described, for example, in U.S. Pat. Nos. 2,507,114, 3,764,328 and 4,060,418, JP-A-56-6235 (the term "JP-A" as used herein means an "unexamined published Japanese patent application") and JP-A-58-192031. However, the aromatic primary amine and its precursor described in these publications are unstable and disadvantageous in that stains are generated during a long-term storage of an unprocessed light-sensitive material or at the time of color development.

Other than the above-described color development method, a method of incorporating a sulfonhydrazide-type compound into a light-sensitive layer is described, for example, in European Patent Applications 0545491A1 and 0565165A1. However, according to this method, a pyrazolidone having high hydrophilicity and reducing property such as 1-phenyl-4-methyl-4-hydroxymethyl-3-pyrazolidone is used, for example, as an auxiliary developing agent in the developer and as a result, the deterioration proceeds upon continuous processing or leisured processing and replenishment in a large amount is required for maintaining the photographic capability. Further, it is found that although the silver development rate is high, the color density is low and the color mixing is conspicuous.

In a conventional method where the color image is formed using a developer containing a color developing agent or an auxiliary developing agent, the reduction of the replenishing amount or discharging amount is limited because the solution stability must be maintained and also, the total use amount of chemicals is not reduced. In practicing the low replenishment, generation of stains or change in photographic capability ascribable to deterioration of the developing agent is readily caused.

SUMMARY OF THE INVENTION

An object of the present invention is to provide a silver halide color photographic material capable of processing in an alkali bath containing no developing agent and suitable for large reduction in the replenishing amount and processing chemicals.

Another object of the present invention is to provide a silver halide color photographic material reduced in stains or color mixing even in a continuous processing by low replenishment and suitable for image formation still more excellent in the processing stability.

Still another object of the present invention is to provide a silver halide color photographic material also suitable for simple processing such as coating processing or thermal development.

DETAILED DESCRIPTION OF THE INVENTION

As a result of intensive investigations under consideration of these problems, the present inventors have found that the above-described objects can be achieved by the following means:

(1) a silver halide color photographic material comprising a support having thereon photographic constituent layers containing at least one light-sensitive silver halide emulsion layer, wherein any one of the photographic constituent layers contains at least one coupler for dye formation, at least one reducing agent for color formation represented by the following formula (I) and an auxiliary developing agent and/or a precursor thereof:

$$R^{11}—NH—NH—X—R^{12} \quad (I)$$

wherein $R^{11}$ represents an aryl or heterocyclic group which may have a substituent; $R^{12}$ represents an alkyl, alkenyl, alkynyl, aryl or heterocyclic group which may have a substituent; X represents $—SO_2—$, —CO—, —COCO—, —CO—O—, —CO—N($R^{13}$)—, —COCO—O—, —COCO—N($R^{13}$)— or $—SO_2—N(R^{13})—$, wherein $R^{13}$ represents a hydrogen atom or a group described for $R^{12}$;

(2) a silver halide color photographic material as described in item (1) above, wherein the precursor of the auxiliary developing agent is represented by the following formula (A):

$$A—(L)_n—PUG \quad (A)$$

wherein A represents a block group which cleaves the bond to $(L)_n$—-PUG upon development, L represents a linking group which cleaves the bond between L and PUG after the cleavage of the bond between L and A, n represents an integer of from 0 to 3, and PUG represents an auxiliary developing agent;

(3) a silver halide color photographic material as described in item (1) or (2) above, wherein the auxiliary developing agent is a pyrazolidone, a dihydroxybenzene, a reductone or an aminophenol;

(4) a silver halide color photographic material as described in item (3) above, wherein the auxiliary developing agent and/or a precursor thereof has a solubility in water of 0.1% or less; and (5) a silver halide color photographic material as described in item (1), (2), (3) or (4), wherein the total coated silver amount of all coated layers is from 0.003 to 0.3 g/m$^2$.

More specifically, when a silver halide color photographic material containing a sulfonhydrazide-type compound and a coupler described in European Patent Application 0545491A1 is exposed and then processed in an alkali bath containing 1-phenyl-4-methyl-4-hydroxymethyl-3-pyrazolidone, the color density is low as compared with the silver development density and the color mixing is serious.

On the other hand, it is found that when a silver halide color photographic material containing a reducing agent for color formation, a coupler and an auxiliary developing agent and/or a precursor thereof according to the present invention is exposed and then processed in an alkali bath containing no developing agent, the color density is unexpectedly high and the color mixing is extremely reduced. Further, it is also found that when the photographic material of the present invention is continuously processed by the low replenishment, stains are little generated and at the same time, the change of photographic performance in processing is small.

Furthermore, it is found that when an auxiliary developing agent to be incorporated is reduced in its hydrophilicity and/or a precursor which releases the above-described auxiliary developing agent under alkali condition is incorporated, the color density is further elevated and a good image can be obtained.

The present invention has been accomplished based on these findings.

The specific constitution of the present invention is described below in detail.

First, the reducing agent for color formation used in the present is described below in detail.

The reducing agent for color formation used in the present invention is a compound characterized in that it smoothly causes oxidation-reduction reaction with an oxidation product of an auxiliary developing agent generated upon development reaction between exposed silver halide and the auxiliary developing agent to produce an oxidation product and the resulting oxidation product undertakes coupling reaction with a coupler for dye formation present together to form a color dye. The reducing agent for color formation represented by formula (I) is described below in detail with respect to the structure thereof.

$R^{11}$ represents an aryl or heterocyclic group which may have a substituent.

The aryl group of $R^{11}$ includes an aryl group having from 6 to 14 carbon atoms, such as phenyl and naphthyl. The heterocyclic group of $R^{11}$ includes a saturated or unsaturated 5-, 6- or 7-membered ring containing at least one of nitrogen, oxygen, sulfur and selenium. The ring may be condensed with a benzene ring or a heterocyclic ring. Examples of the heterocyclic ring of $R^{11}$ include furanyl, thienyl, oxazolyl, thiazolyl, imidazolyl, triazolyl, pyrrolidinyl, benzoxazolyl, benzothiazolyl, pyridyl, pyridazyl, pyrimidinyl, pyrazinyl, triazinyl, quinolinyl, isoquinolinyl, phthalazinyl, quinoxalinyl, quinazolinyl, purinyl, pteridinyl, azepinyl and benzoxepinyl.

Examples of the substituent which the aryl group or the heterocyclic group defined for $R^{11}$ may have include an alkyl group, an alkenyl group, an alkynyl group, an aryl group, a heterocyclic group, an alkoxy group, an aryloxy group, a heterocyclic oxy group, an alkylthio group, an arylthio group, a heterocyclic thio group, an acyloxy group, an acylthio group, an alkoxycarbonyloxy group, an aryloxycarbonyloxy group, a carbamoyloxy group, an alkylsulfonyloxy group, an arylsulfonyloxy group, an amino group, an alkylamino group, an arylamino group, an amido group, an alkoxycarbonylamino group, an aryloxycarbonylamino group, a ureido group, a sulfonamido group, a sulfamoylamino group, an acyl group, an alkoxycarbonyl group, an aryloxycarbonyl group, a carbamoyl group, an acylcarbamoyl group, a carbamoylcarbamoyl group, a sulfonylcarbamoyl group, a sulfamoylcarbamoyl group, an alkylsulfonyl group, an arylsulfonyl group, an alkylsulfinyl group, an arylsulfinyl group, an alkoxysulfonyl group, an aryloxysulfonyl group, a sulfamoyl group, an acylsulfamoyl group, a carbamoylsulfamoyl group, a halogen atom, a nitro group, a cyano group, a carboxy group, a sulfo group, a phosphono group, a hydroxy group, a mercapto group, an imido group and an azo group.

$R^{12}$ represents an alkyl, alkenyl, alkynyl, aryl or heterocyclic group which may have a substituent.

The alkyl group of $R^{12}$ includes a linear, branched or cyclic alkyl group having from 1 to 16 carbon atoms, such as methyl, ethyl, hexyl, dodecyl, 2-octyl, t-butyl, cyclopentyl and cyclooctyl.

The alkenyl group of $R^{12}$ includes a chained or cyclic alkenyl group having from 2 to 16 carbon atoms, such as vinyl, 1-octenyl and cyclohexenyl.

The alkynyl group of $R^{12}$ includes an alkynyl group having from 2 to 16 carbon atoms, such as 1-butynyl and phenylethynyl. The aryl group and the heterocyclic group of $R^{12}$ include those described for $R^{11}$. The substituent which $R^{12}$ may have includes those described above for the substituent of $R^{11}$.

X is preferably —$SO_2$—, —CO—, —COCO— or —(C═O)—N<, more preferably —$SO_2$— or —(C═O)—N<, most preferably —(C═O)—N<.

A part of the compounds represented by formula (I) of the present invention are described, for example, in U.S. Pat. No. 2,424,256 and 4,481,268, European Patent 0565165A1 and JP-A-61-259249, and the remaining compounds may also be synthesized according to the method described in these publications.

The reducing agent for color formation is incorporated into a photographic constituent layer of a light-sensitive material in the same manner as the coupler for dye formation which will be described later. The reducing agent for color formation may be incorporated into a hydrophilic colloid layer adjacent to a light-sensitive silver halide emulsion layer but preferably incorporated into a light-sensitive layer because of high color formation efficiency. Further, for adjusting the activity, different kinds of reducing agents for color formation are preferably used in each light-sensitive layer. The content of the compound is preferably $1\times10^{-5}$ to $1.0\times10^{-2}$ mol, more preferably from $1\times10^{-4}$ to $1\times10^{-3}$ mol, per $m^2$ of each photographic constituent layer.

The content of the coupler for dye formation which will be described later is from 0.05 to 10 times (by mol), more preferably from 0.2 to 5 times (by mol), the content of the reducing agent for color formation.

Specific examples of the compound represented by formula (I) are set forth below.

I-1

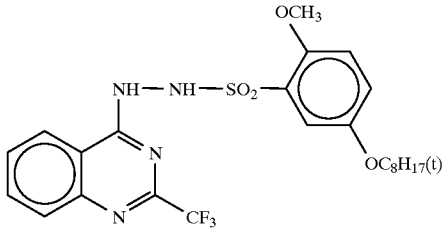

I-2

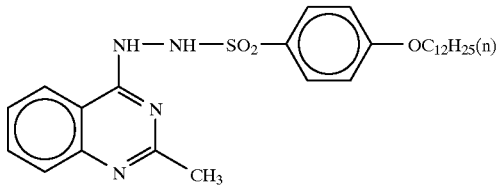

I-3

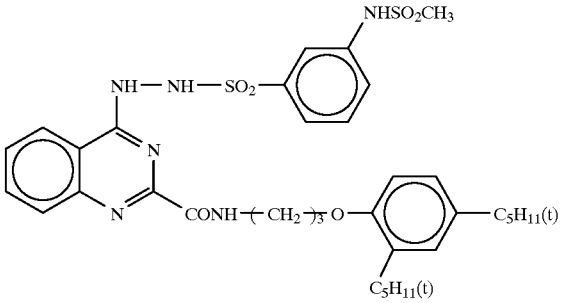

I-4

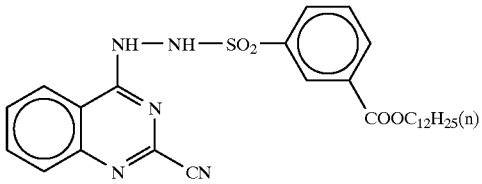

I-5

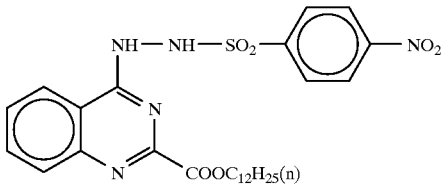

I-6

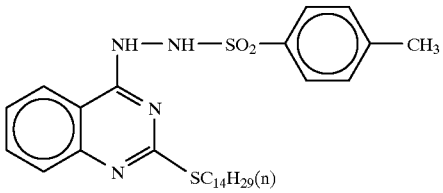

I-7

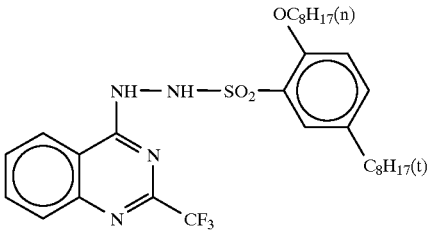

I-8

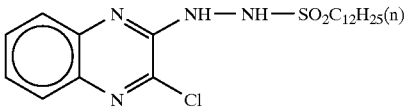

I-9

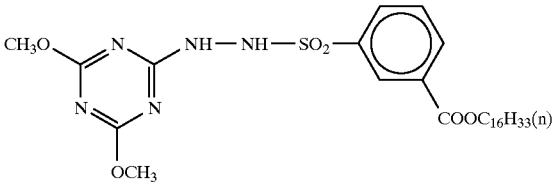

-continued
I-10
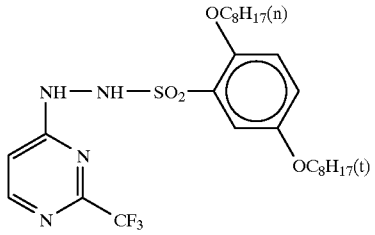
I-11
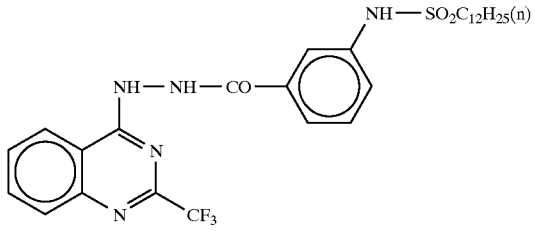
I-12
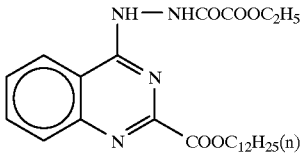
I-13
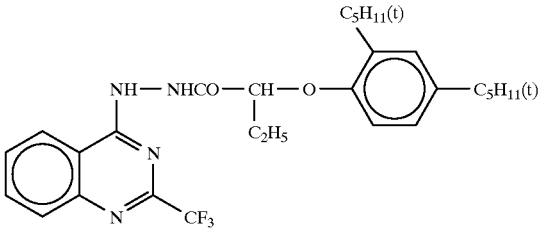
I-14
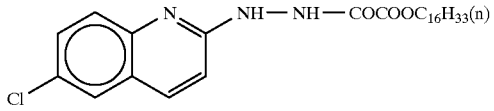
I-15
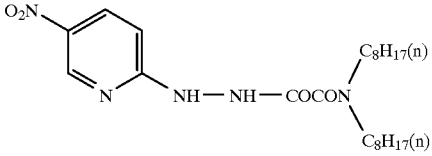
I-16
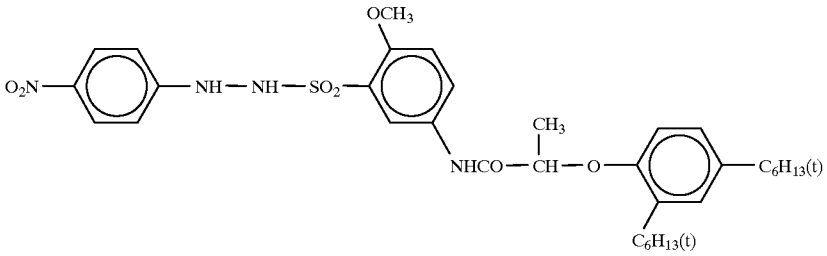
I-17
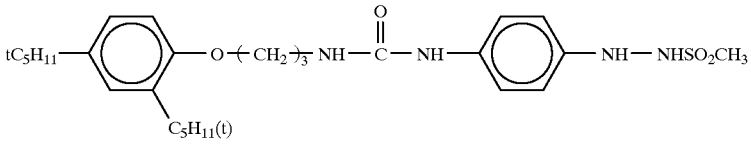
I-18
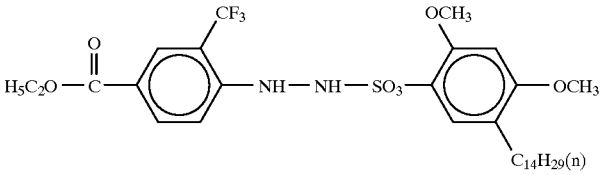

-continued
I-19
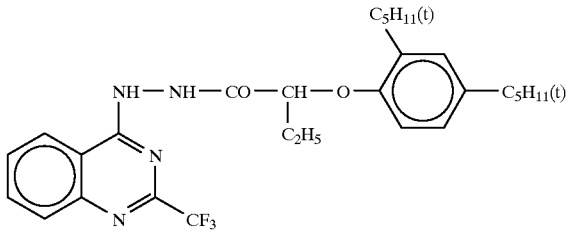
I-20
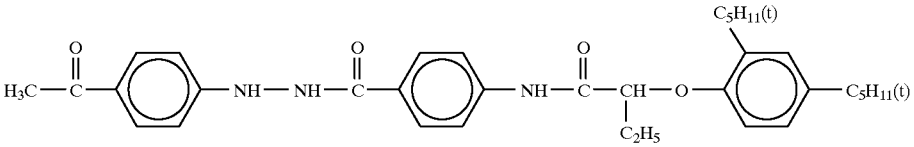
I-21
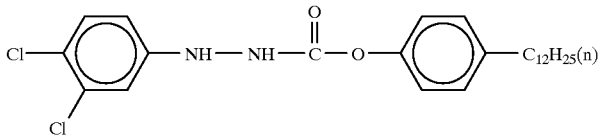
I-22
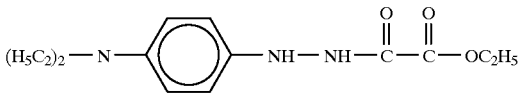
I-23
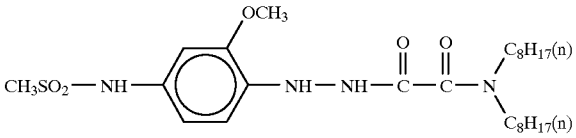
I-24
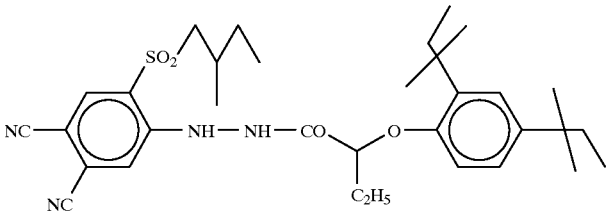
I-25
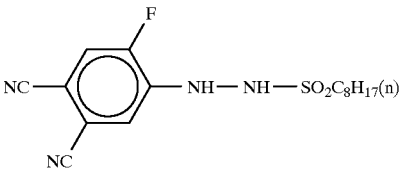
I-26
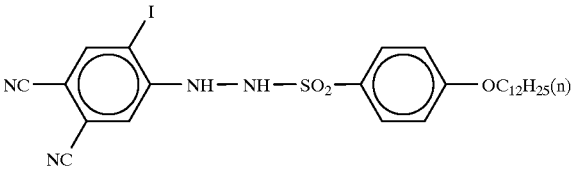
I-27
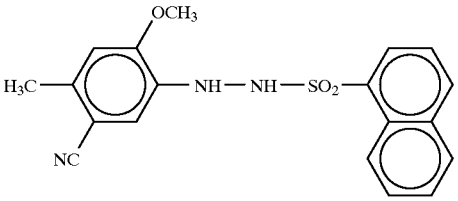
I-28
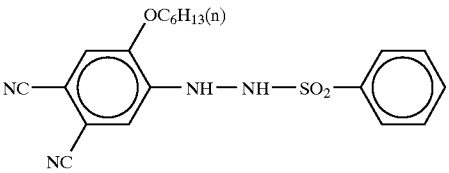

-continued
I-29
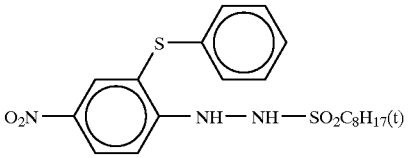
I-30
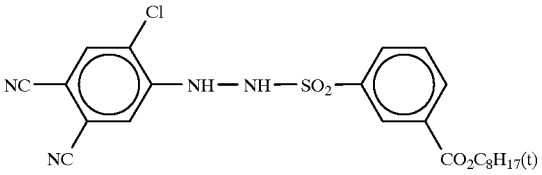
I-31
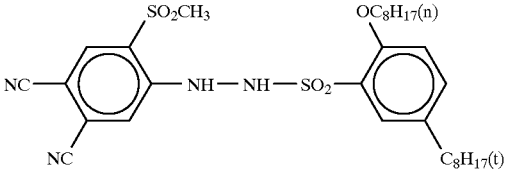
I-32
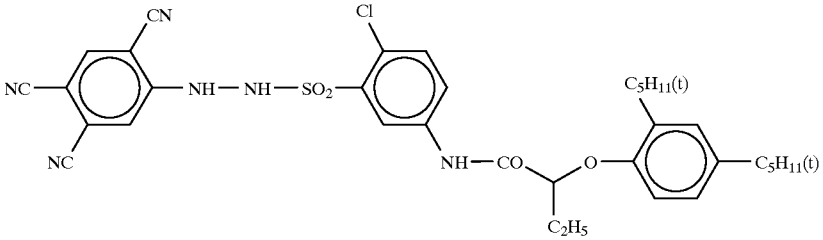
I-33
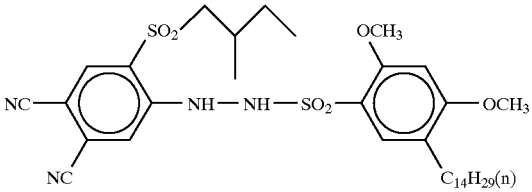
I-34
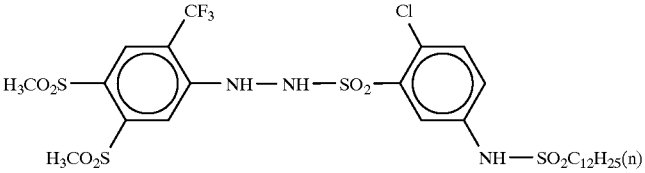
I-35
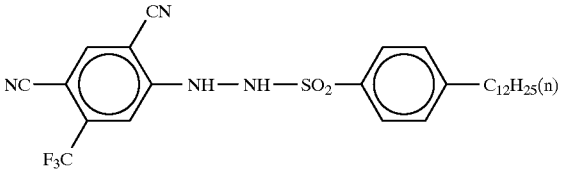
I-36
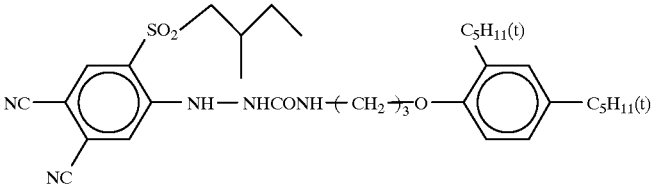

-continued
I-37
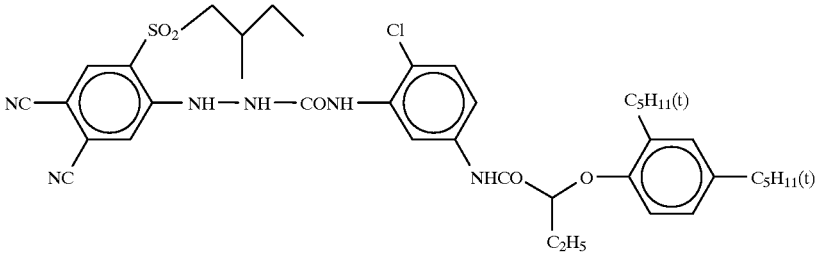
I-38
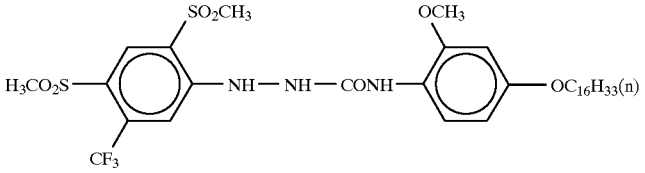
I-39
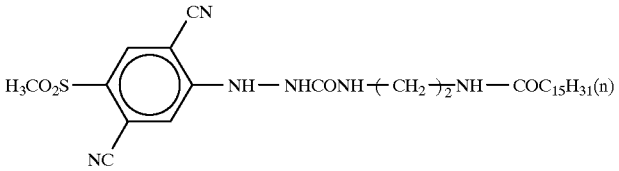
I-40
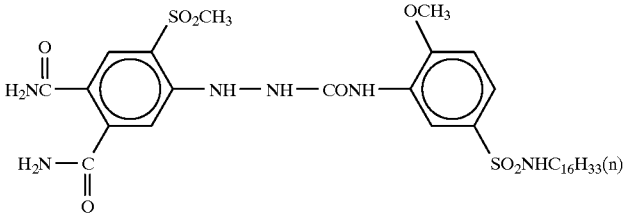
I-41
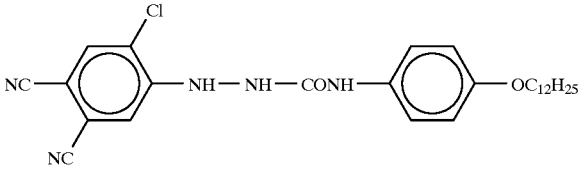
I-42
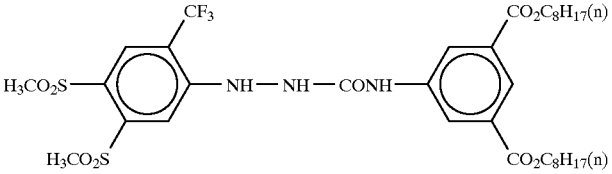
I-43
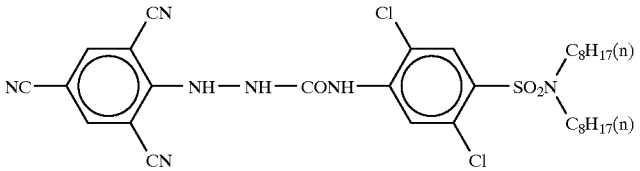

-continued
I-44
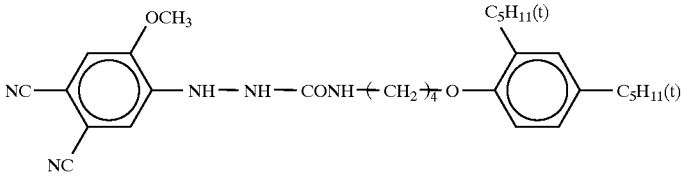
I-45
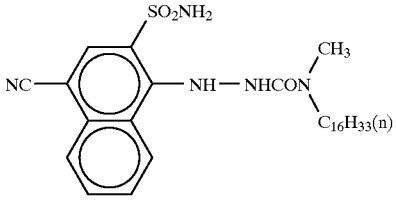
I-46
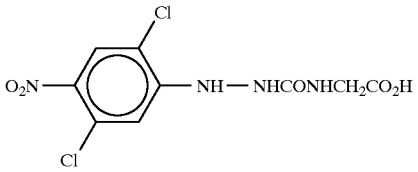
I-47
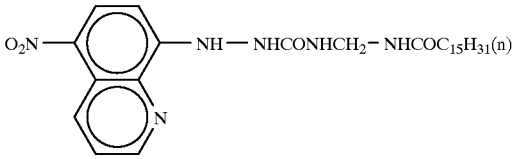
I-48
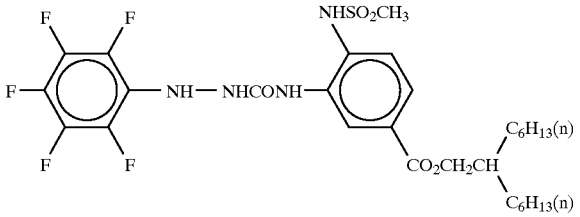
I-49
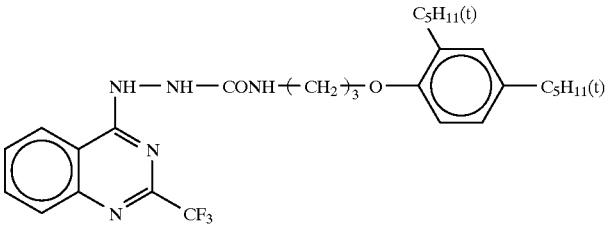
I-50
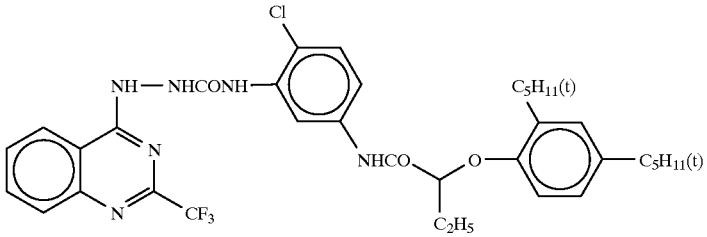
I-51
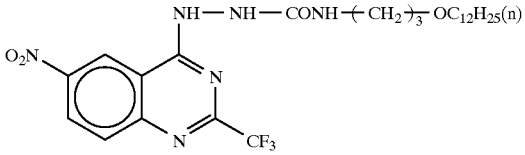

-continued

I-52

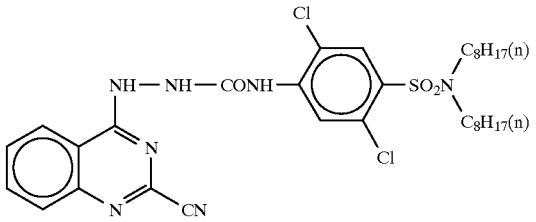

I-53

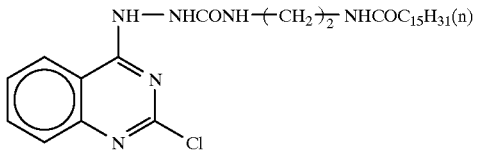

I-54

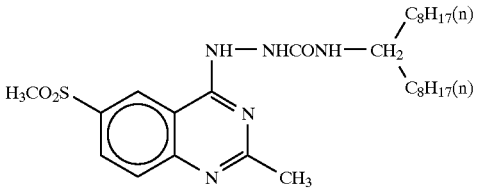

I-55

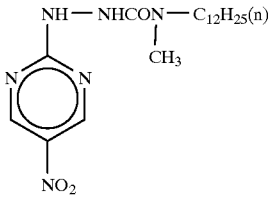

I-56

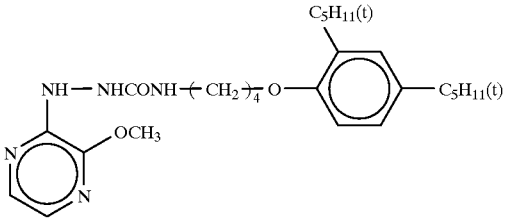

I-57

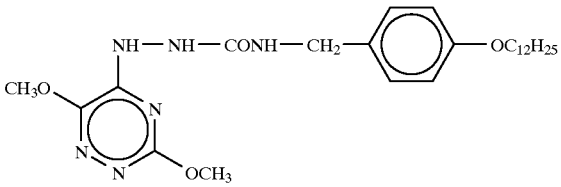

I-58

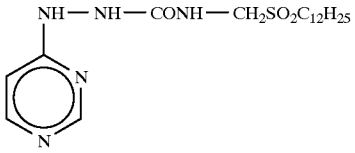

I-59

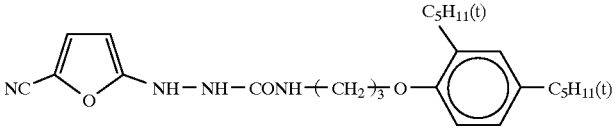

I-60

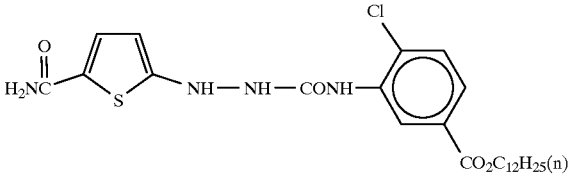

The auxiliary developing agent and the precursor thereof for use in the photographic material of the present invention are described below.

The auxiliary developing agent for use in the present invention is a compound capable of developing exposed silver halide grains to oxidize the reducing agent for color formation by the oxidation product obtained (hereinafter referred to as "cross-oxidation").

The auxiliary developing agent for use in the present invention is preferably a pyrazolidone, a dihydroxybenzene, a reductone or an aminophenol, more preferably a pyrazolidone. The auxiliary developing agent is preferably lower in the diffusibility in a hydrophilic colloid layer and the solubility (25° C.) thereof, for example, in water is preferably 0.1% or less, more preferably 0.05% or less, particularly preferably 0.01% or less.

The precursor of the auxiliary developing agent for use in the present invention is a compound which may be stably present in the light-sensitive material, however, once processed with a processing solution, swiftly releases the above-described auxiliary developing agent, and also in case of using this compound, the diffusibility thereof in a hydrophilic colloid layer is preferably lower. For example, the solubility (25° C.) thereof in water is preferably 0.1% or less, more preferably 0.05% or less, particularly preferably 0.01% or less. The auxiliary developing agent released from the precursor is not particularly restricted on its solubility, however, the auxiliary developing agent itself is preferably lower in the solubility.

The precursor of the auxiliary developing agent of the present invention is preferably represented by formula (A) and the auxiliary developing agent is preferably represented by formula (B-1), (B-2) or (B-3).

The compound represented by formula (A) is described below in detail.

The block group represented by A may be any known block group. More specifically, the block group includes a block group such as an acyl group and a sulfonyl group described in JP-B-48-9968 (the term "JP-B" as used herein means an "examined Japanese patent publication"), JP-A-52-8828, JP-A-57-82834, U.S. Pat. No. 3,311,476 and JP-B-47-44805 (corresponding to U.S. Pat. No. 3,615,617); a block group using a reverse Michel reaction described in JP-B-55-17369 (corresponding to U.S. Pat. No. 3,888,677), JP-B-55-9696 (corresponding to U.S. Pat. No. 3,791,830), JP-B-55-34927 (corresponding to U.S. Pat. No. 4,009,029), JP-A-56-77842 (corresponding to U.S. Pat. No. 4,307,175), JP-A-59-105640, JP-A-59-105641 and JP-A-59-105642; a block group using the production of quinonemethide or a compound analogous to quinonemethide by the intermolecular electron transfer described in JP-B-54-39727, U.S. Pat. Nos. 3,674,478, 3,932,480 and 3,993,661, JP-A-57-135944, JP-A-57-135945 (corresponding to U.S. Pat. No. 4,420,554), JP-A-57-136640, JP-A-61-196239, JP-A-61-196240 (corresponding to U.S. Patent 4,702,999), JP-A-61-185743, JP-A-61-124941 (corresponding to U.S. Pat. No. 4,639,408) and JP-A-2-280140; a block group using the intramolecular nucleophilic substitution reaction described in U.S. Pat. Nos. 4,358,525 and 4,330,617, JP-A-55-53330 (corresponding to U.S. Pat. No. 4,310,612), JP-A-59-121328, JP-A-59-218439 and JP-A-63-318555 (corresponding to European Patent (Unexamined) Publication 0295729); a block group using the ring cleavage of a 5- or 6-membered ring described in JP-A-57-76541 (corresponding to U.S. Pat. No. 4,335,200), JP-A-57-135949 (corresponding to U.S. Pat. No. 4,350,752), JP-A-57-179842, JP-A-59-137945, JP-A-59-140445, JP-A-59-219741, JP-A-59-202459, JP-A-60-41034 (corresponding to U.S. Pat. No. 4,618,563), JP-A-62-59945 (corresponding to U.S. Pat. No. 4,888,268), JP-A-62-65039 (corresponding to U.S. Pat. No. 4,772,537), JP-A-62-80647, JP-A-3-236047 and JP-A-3-238445; a block group using the addition reaction of a nucleophilic agent to a conjugated unsaturated bond described in JP-A-59-201057 (corresponding to U.S. Pat. No. 4,518,685), JP-A-61-95346 (corresponding to U.S. Pat. No. 4,690,885), JP-A-61-95347 (corresponding to U.S. Pat. No. 4,892,811), JP-A-64-7035, JP-A-64-42650 (corresponding to U.S. Pat. No. 5,066,573), JP-A-1-245255, JP-A-2-207249, JP-A-2-235055 (corresponding to U.S. Pat. No. 5,118,596) and JP-A-4-186344; a block group using the β-elimination reaction described in JP-A-59-93442, JP-A-61-32839, JP-A-62-163051 and JP-B-5-37299; a block group using the nucleophilic substitution reaction of diarylmethanes described in JP-A-61-188540; a block group using a Lossen rearrangement reaction described in JP-A-62-187850; a block group using the reaction of an N-acyl form of thiazolidine-2-thione with an amine described in JP-A-62-80646, JP-A-62-144164 and JP-A-62-147457; a block group having two electrophilic groups, which reacts with two nucleophilic agents described in JP-A-2-296240 (corresponding to U.S. Pat. No. 5,019,492), JP-A-4-177243, JP-A-4-177244, JP-A-4-177245, JP-A-4-177246, JP-A-4-177247, JP-A-4-177248, JP-A-4-177249, JP-A-4-179948, JP-A-4-184337, JP-A-4-184338, International Patent (Unexamined) Publication 92/21064, JP-A-4-330438, International Patent (Unexamined) Publication 93/03419 and JP-A-5-45816; and those described in JP-A-3-236047 and JP-A-3-238445.

Among these block groups, particularly preferred are those represented by the following formulae (A-1) to (A-10). In the formulae, the mark # indicates the site to be bonded to L of formula (A).

(A-1)

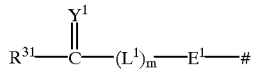

(A-2)

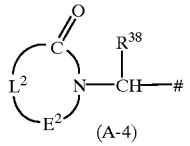

(A-4)

(A-3)

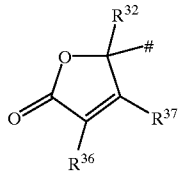

(A-4)

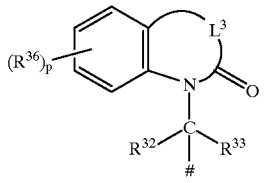

(A-5)

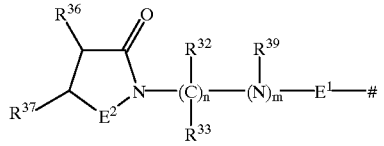

(A-6)

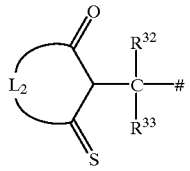

(A-7)

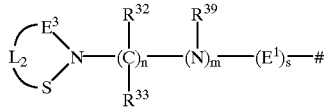

(A-8)

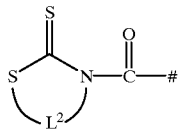

(A-9)

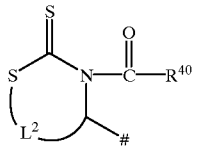

-continued (A-10)

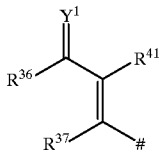

For the description of formulae (A-1) to (A-10), $R^{21}$, $R^{22}$, $R^{23}$, $R^{24}$ and $R^{25}$ are used for convenience' sake.

$R^{21}$ represents a hydrogen atom, an alkyl group (preferably, a linear or branched alkyl group having from 1 to 32 carbon atoms, e.g., methyl, ethyl, propyl, isopropyl, butyl, t-butyl, 1-octyl, tridecyl), a cycloalkyl group (preferably a cycloalkyl group having from 3 to 8 carbon atoms, e.g., cyclopropyl, cyclopentyl, cyclohexyl, 1-norbornyl, 1-adamantyl), an alkenyl group (preferably an alkenyl group having from 2 to 32 carbon atoms, e.g., vinyl, allyl, 3-buten-1-yl), an aryl group (preferably an aryl group having from 6 to 32 carbon atoms, e.g., phenyl, 1-naphthyl, 2-naphthyl), a heterocyclic group (preferably a 5-, 6-, 7- or 8-membered heterocyclic group having from 1 to 32 carbon atoms, e.g., 2-thienyl, 4-pyridyl, 2-furyl, 2-pyrimidinyl, 1-pyridyl, 2-benzothiazolyl, 1-imidazolyl, 1-pyrazolyl, benzotriazol-2-yl), an alkoxy group (preferably an alkoxy group having from 1 to 32 carbon atoms, e.g., methoxy, ethoxy, 1-butoxy, 2-butoxy, isopropoxy, t-butoxy, dodecyloxy), a cycloalkyloxy group (preferably a cycloalkyloxy group having from 3 to 8 carbon atoms, e.g., cyclopentyloxy, cyclohexyloxy), an aryloxy group (preferably an aryloxy group having from 6 to 32 carbon atoms, e.g., phenoxy, 2-naphthoxy), a heterocyclic oxy group (preferably a heterocyclic oxy group having from 1 to 32 carbon atoms, e.g., 1-phenyltetrazole-5-oxy, 2-tetrahydropyranyloxy, 2-furyloxy), a silyloxy group (preferably a silyloxy group having from 1 to 32 carbon atoms, e.g., trimethylsilyloxy, t-butyldimethylsilyloxy, diphenylmethylsilyloxy), an acyloxy group (preferably an acyloxy group having from 2 to 32 carbon atoms, e.g., acetoxy, pivaloyloxy, benzoyloxy, dodecanoyloxy), an amino group (preferably an amino group having 32 or less carbon atoms, e.g., amino, methylamino, N,N-dioctylamino, tetradecylamino, octadecylamino), an anilino group (preferably an anilino group having from 6 to 32 carbon atoms, e.g., anilino, N-methylanilino), a heterocyclic amino group (preferably a heterocyclic amino group having from 1 to 32 carbon atoms, e.g., 4-pyridylamino), an alkylthio group (preferably an alkylthio group having from 1 to 32 carbon atoms, e.g., ethylthio, octylthio), an arylthio group (preferably an arylthio group having from 6 to 32 carbon atoms, e.g., phenylthio) or a heterocyclic thio group (preferably a heterocyclic thio group having from 1 to 32 carbon atoms, e.g., 2-benzothiazolylthio, 2-pyridylthio, 1-phenyltetrazolylthio).

$R^{22}$ represents a hydrogen atom, an alkyl group, an aryl group or a heterocyclic group and the preferred carbon number and specific examples of these are the same as those of the alkyl group, the aryl group and the heterocyclic group represented by $R^{21}$, respectively.

$R^{23}$ represents a hydrogen atom, a halogen atom, a group having the same meaning as the group represented by $R^{21}$, a cyano group, a silyl group (preferably a silyl group having from 3 to 32 carbon atoms, e.g., trimethylsilyl, triethylsilyl, tributylsilyl, t-butyldimethylsilyl, t-hexyldimethylsilyl), a hydroxyl group, a nitro group, an alkoxycarbonyloxy group (preferably an alkoxycarbonyloxy group having from 2 to 32 carbon atoms, e.g., ethoxycarbonyloxy, t-butoxycarbonyloxy), a cycloalkyloxy-carbonyloxy group (preferably a cycloalkyloxycarbonyloxy group having from 4 to 9 carbon atoms, e.g., cyclohexyloxycarbonyloxy), an aryloxycarbonyloxy group (preferably an aryloxycarbonyloxy group having from 7 to 32 carbon atoms, e.g., phenoxycarbonyloxy), a carbamoyloxy group (preferably a carbamoyloxy group having from 1 to 32 carbon atoms, e.g., N,N-dimethylcarbamoyloxy, N-butylcarbamoyloxy), a sulfamoyloxy group (preferably a sulfamoyloxy group having from 1 to 32 carbon atoms, e.g., N,N-diethylsulfamoyloxy, N-propylsulfamoyloxy), an alkanesulfonyloxy group (preferably an alkanesulfonyloxy group having from 1 to 32 carbon atoms, e.g., methanesulfonyloxy, hexadecanesulfonyloxy), an arenesulfonyloxy group (preferably an arenesulfonyloxy group having from 6 to 32 carbon atoms, e.g., benzenesulfonyloxy), an acyl group (preferably an acyl group having from 1 to 32 carbon atoms, e.g., formyl, acetyl, pivaloyl, benzoyl, tetradecanoyl), an alkoxycarbonyl group (preferably an alkoxycarbonyl group having from 2 to 32 carbon atoms, e.g., methoxycarbonyl, ethoxycarbonyl, octadecylcarbonyl), a cycloalkyloxycarbonyl group (preferably a cycloalkyloxycarbonyl group having from 4 to 32 carbon atoms, e.g., cyclohexyloxycarbonyl), an aryloxycarbonyl group (preferably an aryloxycarbonyl group having from 7 to 32 carbon atoms, e.g, phenoxycarbonyl), a carbamoyl group (preferably a carbamoyl group having from 1 to 32 carbon atoms, e.g., carbamoyl, N,N-dibutylcarbamoyl, N-ethyl-N-octylcarbamoyl, N-propylcarbamoyl), a carbonamido group (e.g., a carbonamido group having from 2 to 32 carbon atoms, e.g., acetamido, benzamido, tetradecanamido), a ureido group (preferably a ureido group having from 1 to 32 carbon atoms, e.g., ureido, N,N-dimethylureido, N-phenylureido), an imido group (preferably an imido group having 10 or less carbon atoms, e.g., N-succinimido, N-phthalimido), an alkoxycarbonylamino group (preferably an alkoxycarbonylamino group having from 2 to 32 carbon atoms, e.g., methoxycarbonylamino, ethoxycarbonylamino, t-butoxycarbonylamino, octadecyloxycarbonylamino), an aryloxycarbonylamino (preferably an aryloxycarbonylamino group having from 7 to 32 carbon atoms, e.g., phenoxycarbonylamino), a sulfonamido group (preferably a sulfonamido group having from 1 to 32 carbon atoms, e.g., methanesulfonamido, butanesulfonamido, benzenesulfonamido, hexanesulfonamido), a sulfamoylamino group (preferably a sulfamoylamino group having from 1 to 32 carbon atoms, e.g., N,N-dipropylsulfamoylamino, N-ethyl-N-dodecylsulfamoylamino), an alkylsulfinyl group (preferably an alkylsulfinyl group having from 1 to 32 carbon atoms, e.g., dodecanesulfinyl), an arenesulfinyl group (preferably an arenesulfinyl group having from 6 to 32 carbon atoms, e.g., benzenesulfinyl), an alkanesulfonyl group (preferably an alkanesulfonyl group having from 6 to 32 carbon atoms, e.g., methanesulfonyl, octanesulfonyl), an arenesulfonyl group (preferably an arenesulfonyl group having from 6 to 32 carbon atoms, e.g., benzenesulfonyl, 1-naphthalenesulfonyl), a sulfamoyl group (preferably a sulfamoyl group having 32 or less carbon atoms, e.g., sulfamoyl, N,N-dipropylsulfamoyl, N-ethyl-N-dodecylsulfamoyl), a sulfo group, a phosphinoyl group (preferably a phosphinoyl group having from 1 to 32 carbon atoms, e.g., phenoxyphosphinoyl, octyloxyphosphinoyl, phenylphosphinoyl) or a phosphinoylamino group (preferably a phosphinoylamino group having from 1 to 32 carbon atoms, e.g., dioctyloxyphosphinoylamino, didodecylphosphinoylamino).

$R^{24}$ represents a hydrogen atom, an alkyl group, an aryl group, an acyl group, an alkanesulfonyl group or an arenesulfonyl group, $R^{25}$ represents an alkyl group, an aryl group or a heterocyclic group, and the carbon number and specific examples of these groups are the same as those described for the groups represented by $R^{21}$ and $R^{23}$.

In the case when $R^{21}$, $R^{22}$, $R^{23}$, $R^{24}$ and $R^{25}$ each represents a group which may have a substituent, preferred examples of the substituent include a halogen atom, an alkyl group, a cycloalkyl group, an alkenyl group, an aryl group, a heterocyclic group, a cyano group, a silyl group, a hydroxyl group, a carboxyl group, a nitro group, an alkoxy group, an aryloxy group, a heterocyclic oxy group, a silyloxy group, an acyloxy group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, an amino group, an anilino group, a heterocyclic amino group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, a sulfinyl group, a sulfo group, an alkanesulfonyl group, an arenesulfonyl group, a sulfamoyl group, a phosphinoyl group and a phosphinoylamino group. The preferred carbon number and specific examples of these groups are the same as those described for the groups represented by $R^{21}$ and $R^{23}$.

In formula (A-1), $R^{31}$ has the same meaning as $R^{21}$, $Y^1$ represents an oxygen atom, a sulfur atom, N-$R^{24}$ or C($E^4$)-$E^5$, $L^1$ represents a divalent linking group containing one or two atoms selected from a carbon atom and a nitrogen atom on the main chain, m represents 0 or 1, $E^1$ represents —CO— or —$SO_2$—, and $E^4$ and $E^5$ each represents an electron attractive group selected from a cyano group, a nitro group, —CO-$R^{22}$, —$CO_2R^{25}$, —CON($R^{24}$)—$R^{22}$, —$SO_2$—$R^{25}$ and —$SO_2$N($R^{24}$)—$R^{22}$. In a preferred embodiment, $R^{31}$ represents an alkyl group, an aryl group or a heterocyclic group, $Y^1$ represents an oxygen atom, $L^1$ represents —C($R^{32}$)($R^{33}$)—, —C($R^{32}$)($R^{33}$)—C($R^{34}$)($R^{35}$)—, —C($R^{36}$)=C($R^{37}$)— (wherein $R^{36}$ and $R^{37}$ may be combined to form a 5-, 6- or 7-membered ring), —C($R^{32}$)($R^{33}$)—N($R^{24}$)— or —N($R^{24}$)—, m represents 0 or 1, $E^1$ represents —CO— or —$SO_2$—, $R^{32}$, $R^{33}$ $l$, $R^{34}$ and $R^{35}$ each has the same meaning as $R^{22}$, and $R^{36}$ and $R^{37}$ each has the same meaning as $R^{23}$. In a more preferred embodiment, $R^{31}$ represents an alkyl group or an aryl group, $Y^1$ represents an oxygen atom, $L^1$ represents —C($R^{32}$)($R^{33}$)—, —C($R^{36}$)=C($R^{37}$)— (wherein $R^{36}$ and $R^{37}$ may be combined to form a 5-, 6- or 7-membered unsaturated or aromatic ring) or —N($R^{24}$)—, m represents 0 or 1 and $E^1$ represents —CO—.

In formula (A-2), $E^2$ represents —CO—, —C=N($R^{24}$)—, —C=C($E^4$)—$E^5$ or —$SO_2$—, $E^4$ and $E^5$ each represents an electron attractive group, $L^2$ represents a nonmetallic atom group necessary for forming a 5-, 6- or 7-membered ring together with —CO—N—$E^2$—. In a preferred embodiment, $E^2$ represents —CO—, —C=N($R^{24}$)—, —C=C($E^4$)—$E^5$ or —$SO_2$—, $E^4$ and $E^5$ each represents an electron attractive group selected from a cyano group, a nitro group, —CO—$R^{22}$, —$CO_2R^{25}$, —CON($R^{24}$)—$R^{22}$, —$SO_2$—$R^{25}$ and —$SO_2$N($R^{24}$)—$R^{22}$, $R^{38}$ has the same meaning as $R^{22}$, $L^2$ represents —C($R^{32}$)($R^{36}$)—C($R^{33}$)($R^{37}$)— or —C($R^{36}$)=C($R^{37}$)—, $R^{32}$, $R^{33}$, $R^{36}$ and $R^{37}$ have the same meaning as $R^{32}$, $R^{33}$, $R^{36}$ and $R^{37}$ in formula (A-1), respectively, and $R^{36}$ and $R^{37}$ may be combined to form a 5-, 6- or 7-membered saturated, unsaturated or aromatic ring. In a more preferred embodiment, $E^2$ represents —CO— or —$SO_2$—, $R^{38}$ represents a hydrogen atom and $L^2$ represents a substituted or unsubstituted ethylene group, or a substituted or unsubstituted 1,2-phenylene group.

In formula (A-3), $R^{32}$, $R^{36}$ and $R^{37}$ have the same meaning as $R^{32}$, $R^{36}$ and $R^{37}$ in formula (A-1), respectively, and $R^{36}$ and $R^{37}$ may be combined to form a 5-, 6- or 7-membered saturated, unsaturated or aromatic ring.

In formula (A-4), $R^{32}$, $R^{33}$ and $R^{36}$ have the same meaning as $R^{32}$, $R^{33}$ and $R^{36}$ in formula (A-1), respectively, $L^3$ represents a nonmetallic atom group necessary for forming a 5-, 6- or 7-membered ring and p represents an integer of from 0 to 4. In a preferred embodiment, $L^3$ represents —CO— or —C=N($R^{24}$)— and $R^{32}$ and $R^{33}$ each represents a hydrogen atom. In a more preferred embodiment, $L^3$ represents —CO—.

In formula (A-5), $R^{32}$, $R^{33}$, $R^{36}$ and $R^{37}$ have the same meaning as $R^{32}$, $R^{33}$, $R^{36}$ and $R^{37}$ in formula (A-1), respectively, $R^{36}$ and $R^{37}$ may be combined to form a 5-, 6- or 7-membered saturated, unsaturated or aromatic ring, $R^{39}$ has the same meaning as $R^{24}$, $E^1$ represents —CO— or —$SO_2$—, $E^2$ represents —CO—, —CS—, —C=N($R^{24}$)—, —SO— or —$SO_2$—, n represents 0, 1 or 2, m represents 0 or 1 and n+m is 1, 2 or 3. In a preferred embodiment, $E^1$ represents —CO—, $E^2$ represents —CO— or —$SO_2$—, n represents 0, 1 or 2, m represents 0 or 1 and n+m is 1, 2 or 3. In a more preferred embodiment, $E^1$ and $E^2$ each represents —CO—, n represents 1, m represents 0, and $R^{32}$ and $R^{33}$ each represents a hydrogen atom.

In formula (A-6), $R^{32}$ and $R^{33}$ have the same meaning as $R^{32}$ and $R^{33}$ in formula (A-1), respectively, $L^2$ represents a nonmetallic atom group necessary for forming a 5-, 6- or 7-membered ring together with —CO—N—CS—. In a preferred embodiment, $L^2$ represents a substituted or unsubstituted 1,2-phenylene group, a substituted or unsubstituted ethylene group, —C($R^{34}$)($R^{35}$)—S— or —C($R^{34}$)($R^{35}$)—O—, and $R^{34}$ and $R^{35}$ have the same meaning as $R^{34}$ and $R^{35}$ in formula (A-1), respectively.

In formula (A-7), $R^{32}$ and $R^{33}$ have the same meaning as $R^{32}$ and $R^{33}$ in formula (A-1), respectively, $R^{39}$ has the same meaning as $R^{24}$, $L^2$ represents a nonmetallic atom group necessary for forming a 5-, 6- or 7-membered ring together with —$E^3$—N—S—, $E^1$ represents —CO— or —$SO_2$—, $E^3$ represents —CO—, —CS—, —C=N($R^{24}$)—, —SO— or —$SO_2$—, n represents 0, 1, 2 or 3 and m and s each represents 0 or 1, provided that when m is 1, s is 1 and when n is 0, m and s each is 1. In a preferred embodiment, $L^2$ represents a substituted or unsubstituted ethylene group, —C($R^{34}$)($R^{35}$)—S— or —C($R^{34}$)($R^{35}$)—O—, $R^{34}$ and $R^{35}$ have the same meaning as $R^{34}$ and $R^{35}$ in formula (A-1), respectively, $E^1$ represents —CO— or —$SO_2$—, $E^3$ represents —CO— or —$SO_2$—, n represents 0 or 1 and m and s each represents 0 or 1, provided that when m is 1, s is 1 and when n is 0, m and s each is 1. In a more preferred embodiment, $L^2$ represents a substituted or unsubstituted 1,2-phenylene group or a substituted or unsubstituted ethylene group, $E^1$ represents —CO—, $E^3$ represents —CO— or —$SO_2$—, n represents 1 and m and s each represents 0.

In formula (A-8), $L^2$ represents a nonmetallic atom group necessary for forming a 5-, 6- or 7-membered ring together with —S—CS—N—, preferably a substituted or unsubstituted 1,2-phenylene group or a substituted or unsubstituted ethylene group.

In formula (A-9), $R^{40}$ has the same meaning as $R^{25}$ and $L^2$ represents a nonmetallic atom group necessary for forming a 5-, 6- or 7-membered ring together with —S—CS—N—, preferably a substituted or unsubstituted 1,2-phenylene group or a substituted or unsubstituted ethylene group.

In formula (A-10), $Y^1$ has the same meaning as $Y^1$ in formula (A-1), $R^{41}$ has the same meaning as $R^{23}$, $R^{36}$ and $R^{37}$ have the same meaning as $R^{36}$ and $R^{37}$ in formula (A-1), respectively, and $R^{36}$ and $R^{37}$ may be combined to form a 5-, 6- or 7-membered saturated, unsaturated or aromatic ring. The block group represented by (A-10) is preferably represented by the following formula (A-11) or (A-12).

(A-11)

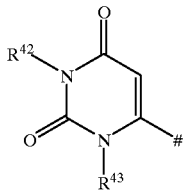

(A-12)

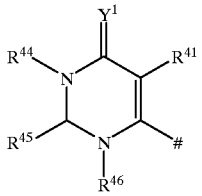

In formula (A-11), $R^{42}$ and $R^{43}$ each has the same meaning as $R^{24}$, preferably an alkyl group or an aryl group. In formula (A-12), $Y^1$ has the same meaning as $Y^1$ in formula (A-1), $R^{41}$ has the same meaning as $R^{41}$ in formula (A-10), and $R^{44}$, $R^{45}$ and $R^{46}$ each has the same meaning as $R^{23}$. In a preferred embodiment, $Y^1$ represents an oxygen atom.

Specific examples of A represented by formulae (A-1) to (A-10) are set forth below, but the block group of the present invention is by no means limited to these examples.

(A-1)

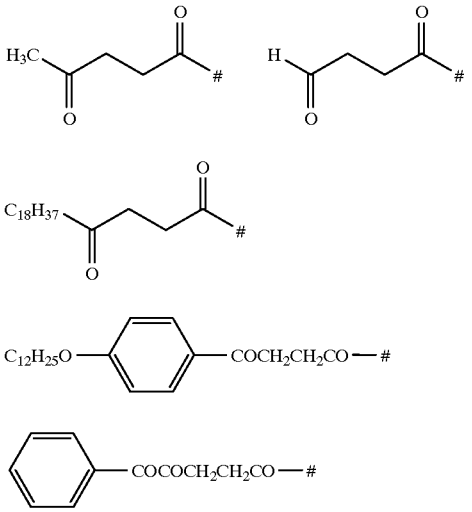

-continued

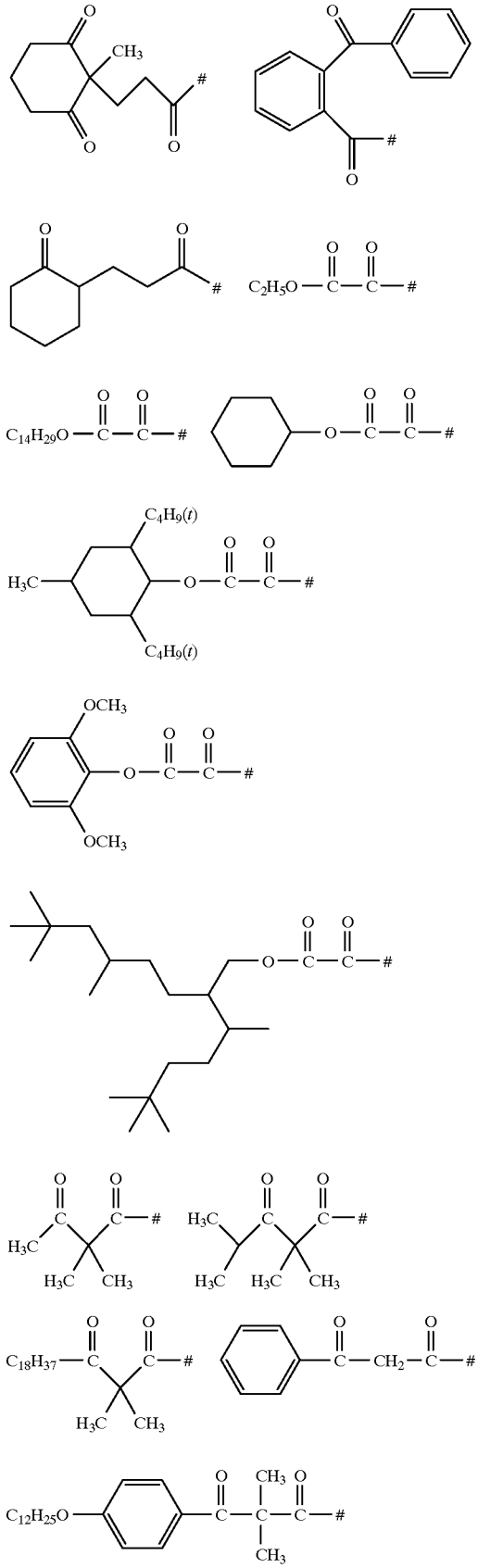

-continued
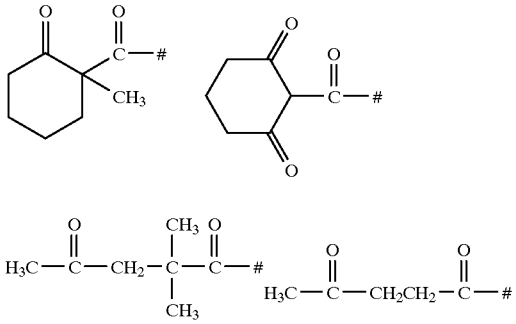
(A-2)
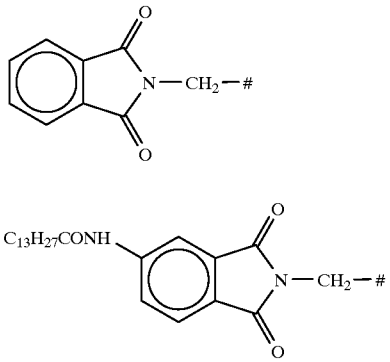
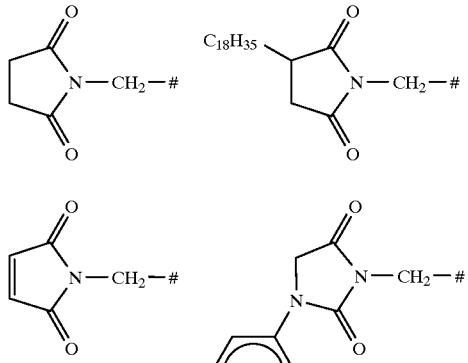
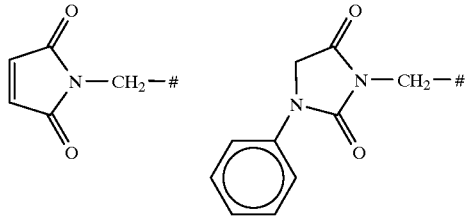
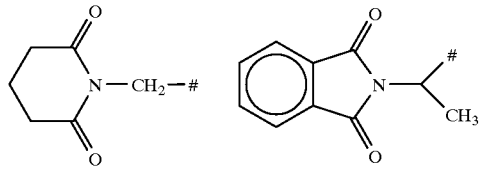
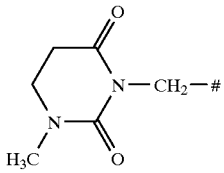
(A-3)
-continued
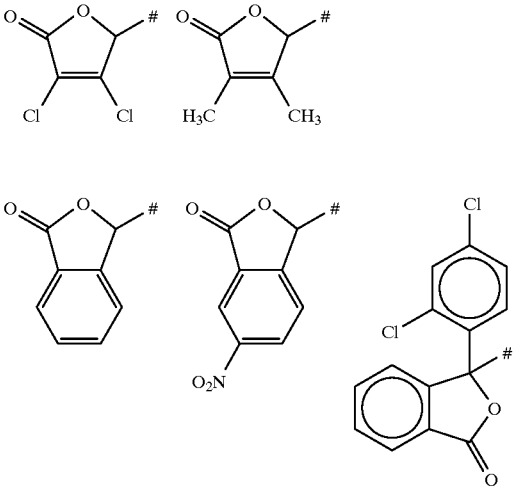
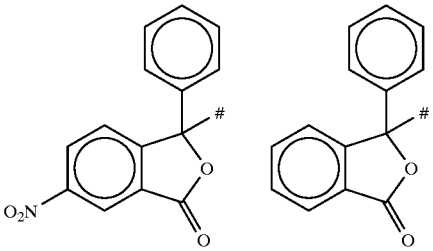
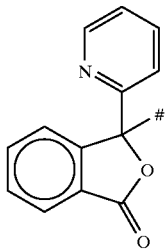
(A-4)
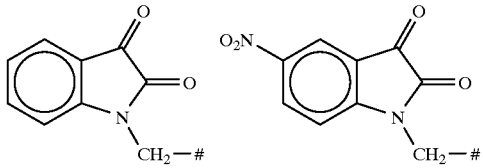
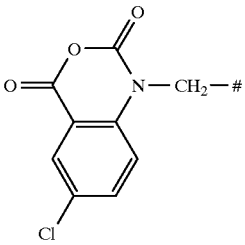
(A-5)

-continued
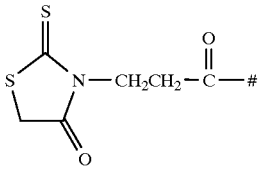
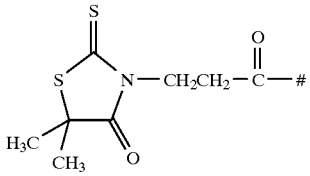
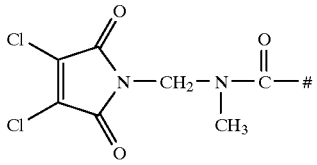
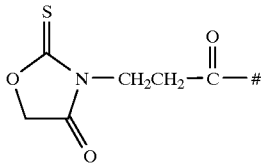
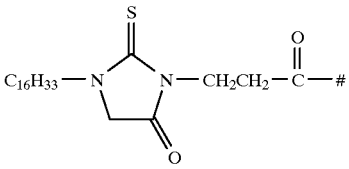
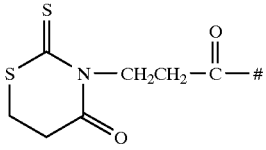
(A-6)
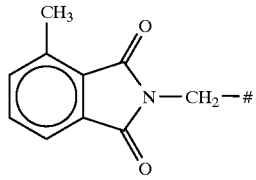
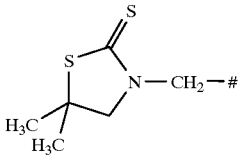
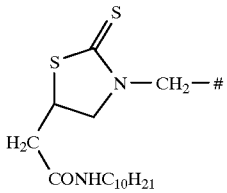
(A-7)
-continued
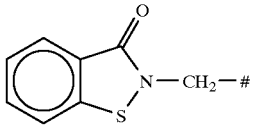
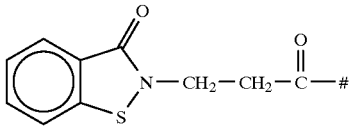
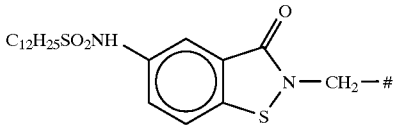
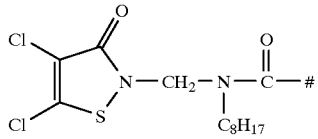
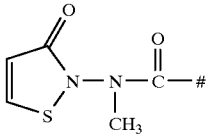
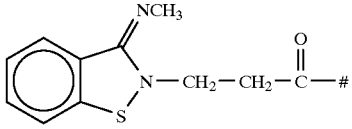
(A-8)
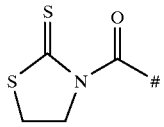
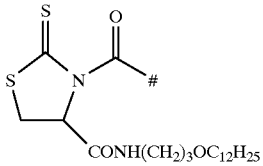
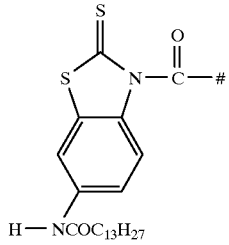
(A-9)
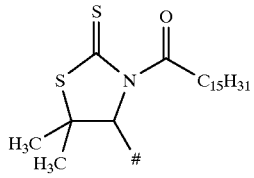
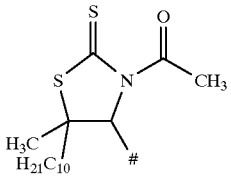

-continued

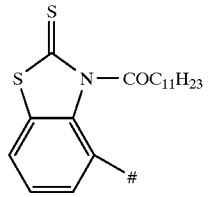

(A-10)

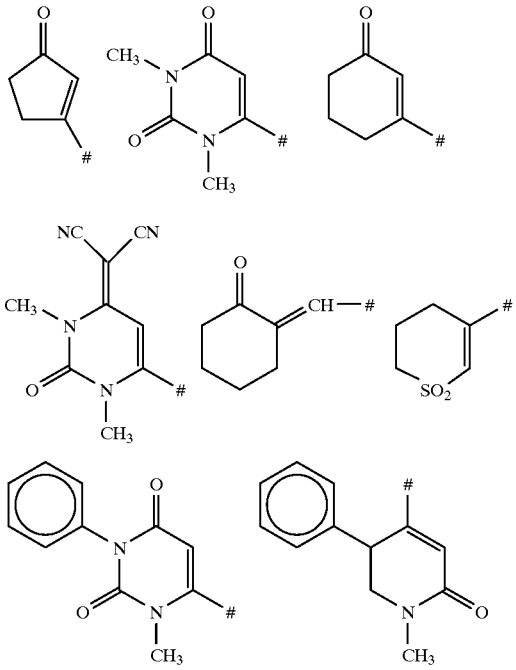

In the compound represented by formula (A), the group represented by L may be any linking group as long as it is a linking group capable of cleaving the bond of $(L)_{n-1}$—PUG after splitting off from the group represented by A upon development. Examples of the group include a group using cleavage of a hemiacetal ring described in U.S. Pat. Nos. 4,146,396, 4,652,516 and 4,698,297; a timing group which causes an intramolecular nucleophilic substitution reaction described in U.S. Pat. Nos. 4,248,962, 4,847,185 and 4,857,440; a timing group which causes cleavage reaction using an electron transfer reaction described in U.S. Pat. Nos. 4,409,323 and 4,421,845; a group which causes cleavage reaction using hydrolysis reaction of iminoketal described in U.S. Pat. No. 4,546,073; a group which causes cleavage reaction using hydrolysis reaction of ester described in West German Patent (OLS) 2,626,317; and a group which causes cleavage reaction using the reaction with sulfite ions described in European Patent 0,572,084. L is bonded to A at the hetero atom, preferably the oxygen atom, the sulfur atom or the nitrogen atom. The group represented by L is preferably represented by the following formula (T-1), (T-2) or (T-3):

$$*—W—(Z^1{=}Z^2)_j—C(R^{51})(R^{52})** \quad (T\text{-}1)$$

$$*—W—CO—** \quad (T\text{-}2)$$

$$*—W—LINK—E—** \quad (T\text{-}3)$$

wherein * represents the group represented by A in formula (A) or the site to be bonded to the group present at the left side, ** represents the site to be bonded to $(L)_{n-1}$—PUG, W represents an oxygen atom, a sulfur atom or —$N(R^{53})$—, $Z^1$ and $Z^2$ each represents a substituted or unsubstituted methine or a nitrogen atom, j represents 0, 1 or 2, $R^{51}$ and $R^{52}$ each has the same meaning as $R^{22}$, and $R^{53}$ has the same meaning as $R^{24}$. When $Z^1$ and $Z^2$ each represents a substituted methine, the substituent thereof has the same meaning as $R^{23}$. When $Z^1$ and $Z^2$ each represents a substituted methine, any two substituents of the substituents $R^{51}$, $R^{52}$ and $R^{53}$ may be bonded with each other to form a ring (e.g., benzene ring, pyrazole ring) or not to form a ring.

In formula (T-3), E represents an electrophilic group and LINK represents a linking group for positioning W and E in a steric relation so that these groups can make intramolecular substitution reaction. Examples of the linking group include a group contained in the block group using intramolecular nucleophilic substitution reaction described in U.S. Pat. Nos. 4,358,525 and 4,330,617, JP-A-55-53330 (corresponding to U.S. Pat. No. 4,310,612), JP-A-59-121328, JP-A-59-218439 and JP-A-63-318555 (corresponding to European Patent (Unexamined) Publication 0295729) and specific examples thereof include a methylene group, a 1,2-ethylene group, a 1,3-propylene group, a 1,4-butylene group, a 1,2-phenylene group, a 1,2-cyclopentenyl group, a 1,2-cyclohexenyl group and a combination of these groups.

Specific examples of the linking group L represented by formula (T-1) are set forth below, but the present invention is by no means limited to these.

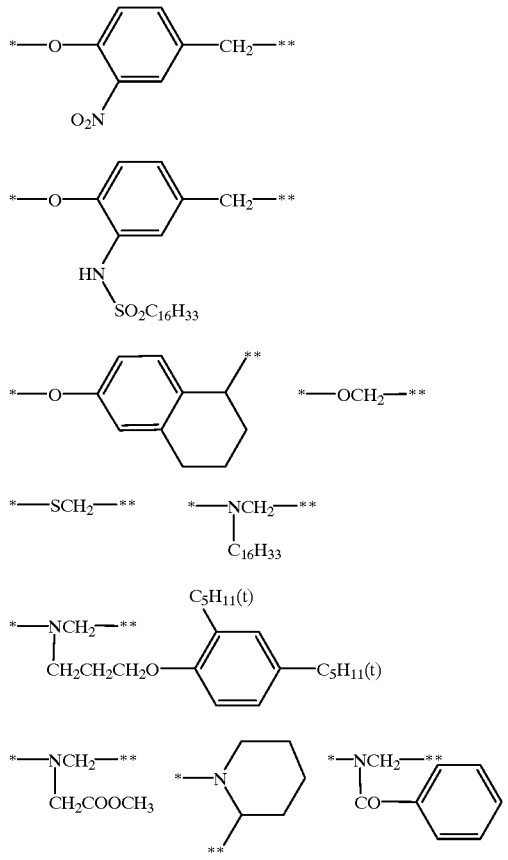

-continued

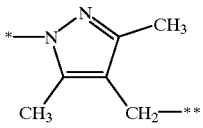

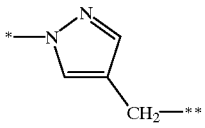

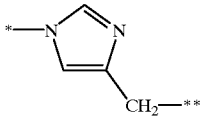

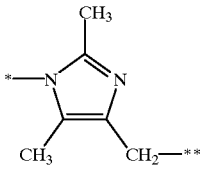

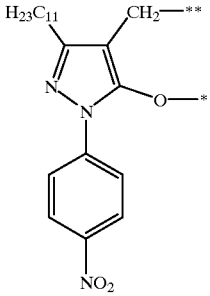

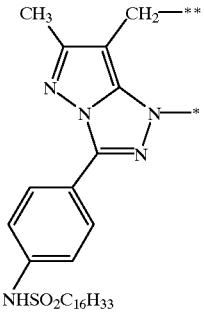

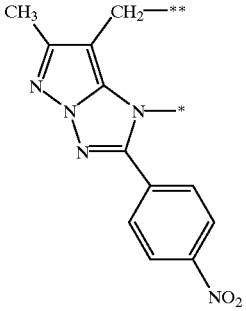

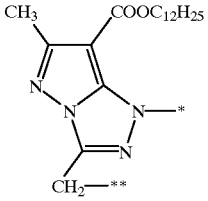

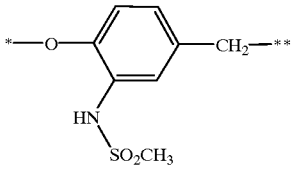

Specific examples of the linking group L represented by formula (T-2) are set forth below, but the present invention is By no means limited to these.

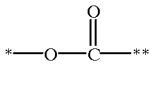

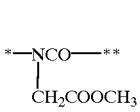

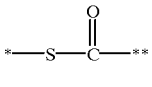

Specific examples of the linking group L represented by formula (T-3) are set forth below, but the present invention is by no means limited to these.

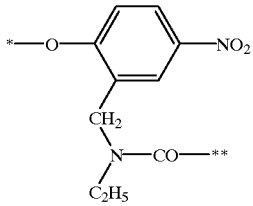

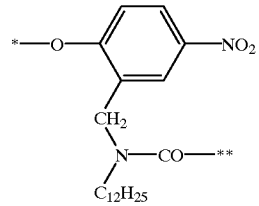

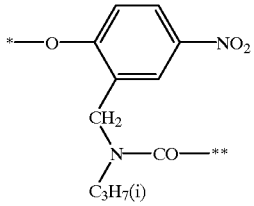

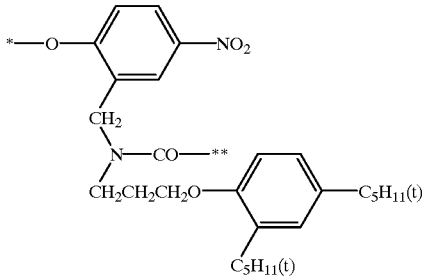

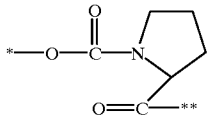

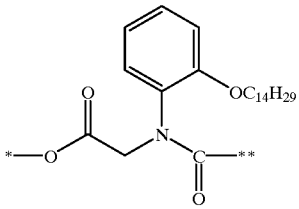

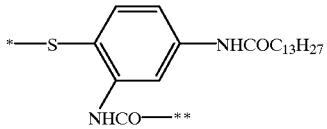

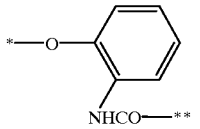

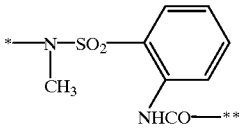

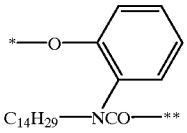

The auxiliary developing agent and the auxiliary developing agent represented by PUG in formula (A) are described below.

The term "auxiliary developing agent" as used herein means a material which acts to accelerate the transfer of electrons from the reducing agent for color formation to silver halide in the development process of silver halide development. The auxiliary developing agent of the present invention is preferably an electron-emitting compound according to Kendall-Perutz law represented by the following formula (B-1), (B-2) or (B-3):

(B-1)

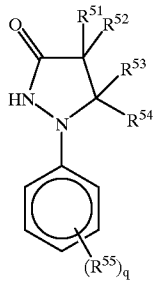

(B-2)

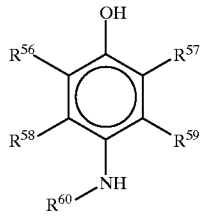

(B-3)

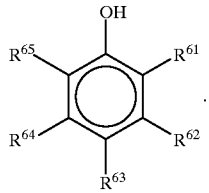

Among these, the compound represented by formula (B-1) is particularly preferred.

In formulae (B-1) and (B-2), $R^{51}$, $R^{52}$, $R^{53}$ and $R^{54}$ each represents a hydrogen atom, an alkyl group (e.g., methyl, ethyl, hydroxymethyl, acetylaminomethyl, benzyl), an aryl group (e.g., phenyl, parachlorophenyl, 3-butoxyphenyl, 2-naphthyl) or a heterocyclic group (e.g., 2-pyridyl, 2-furyl), $R^{55}$, $R^{56}$, $R^{57}$, $R^{58}$ and $R^{59}$ each has the same meaning as $R^{23}$ described above with respect to formula (A), q represents an integer of from 0 to 5 and when q is 2 or greater, the $R^{55}$ groups may be the same or different, and $R^{60}$ represents an alkyl group (e.g., methyl, ethyl, 2-trimethylsilylethyl, isopropyl) or an aryl group (e.g., phenyl, 4-methanesulfonylphenyl).

In formula (B-3), $R^{61}$, $R^{62}$, $R^{63}$, $R^{64}$ and $R^{65}$ each has the same meaning as $R^{23}$ described above with respect to formula (A) and at least one of $R^{61}$, $R^{62}$, $R^{63}$, $R^{64}$ and $R^{65}$ represents a hydroxy group.

The auxiliary developing agent represented by formula (B-1), (B-2) or (B-3) corresponds to PUG in formula (A) and the bonding site to A or L is the oxygen atom or the nitrogen atom of the auxiliary developing agent, and in other words, the auxiliary developing agent is bonded to A or L in place of H in —OH or —NH.

Specific examples of the compounds represented by formulae (B-1), (B-2) and (B-3) and the precursor of these are set forth below, but the auxiliary developing agent and its precursor are by no means limited to these specific examples.

(ETA-1)

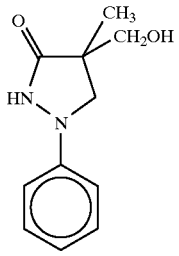

(ETA-2)

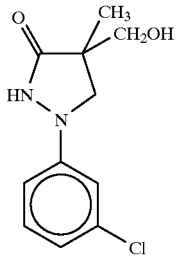

(ETA-3)

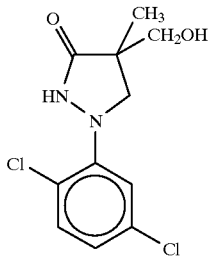

(ETA-4)

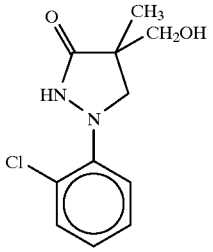

(ETA-5)

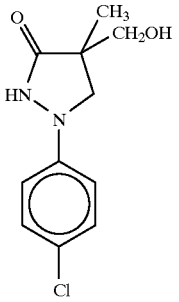

-continued
(ETA-6)
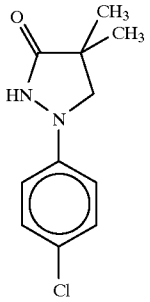
(ETA-7)
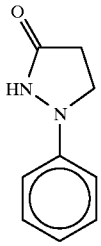
(ETA-8)
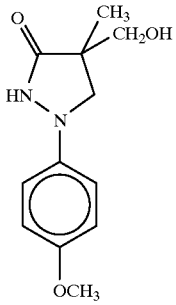
(ETA-9)
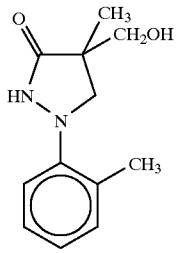
(ETA-10)
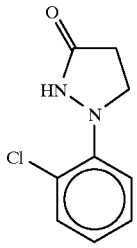
-continued
(ETA-11)
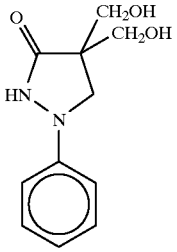
(ETA-12)
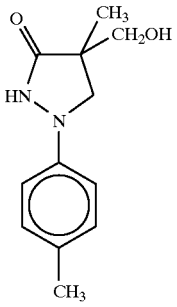
(ETA-13)
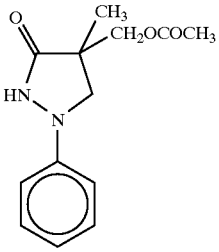
(ETA-14)
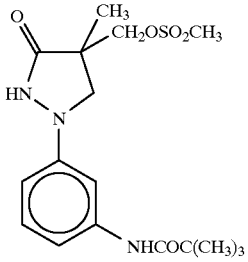
(ETA-15)
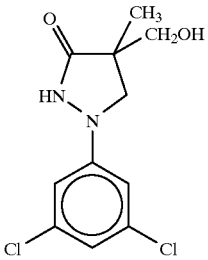

-continued
(ETA-16)
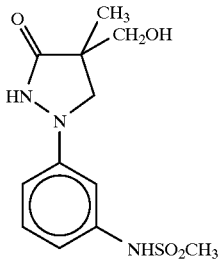
(ETA-17)
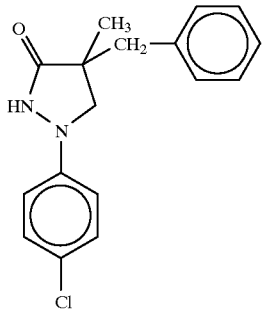
(ETA-18)
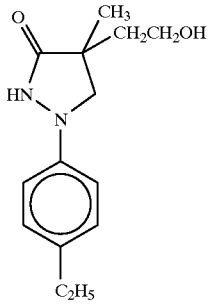
(ETA-19)
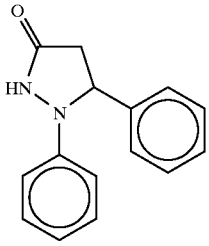
(ETA-20)
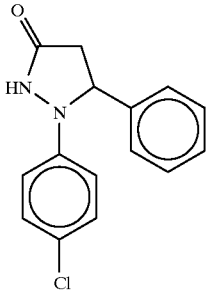
-continued
(ETA-21)
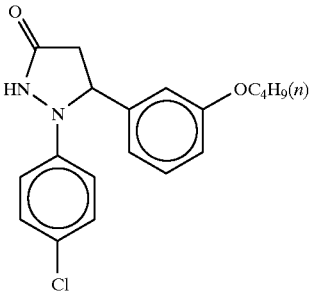
(ETA-22)
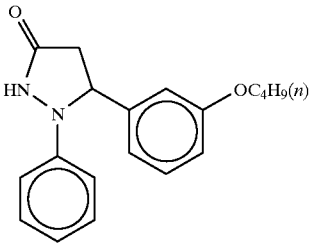
(ETA-23)
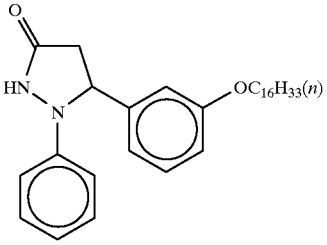
(ETA-24)
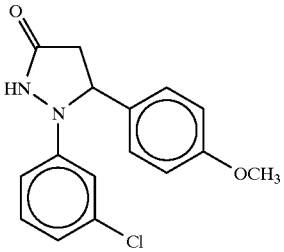
(ETA-25)
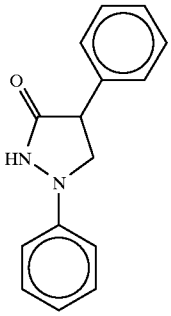

-continued
(ETA-26)
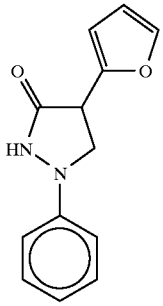
(ETA-27)
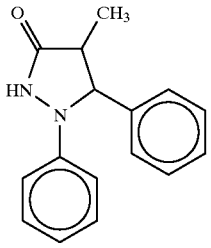
(ETA-28)
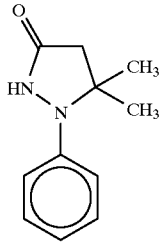
(ETA-29)
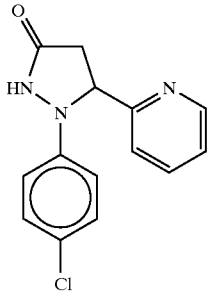
(ETA-30)
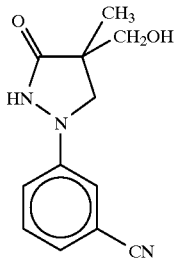
-continued
(ETA-31)
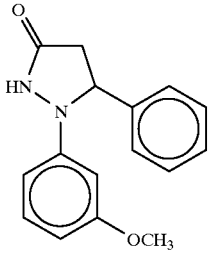
(ETA-32)
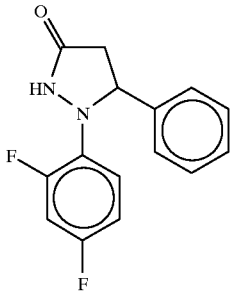
(ETA-33)
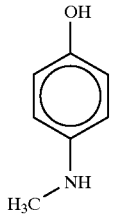
(ETA-34)
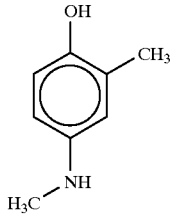
(ETA-35)
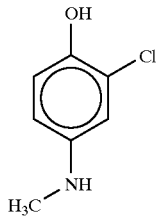
(ETA-36)
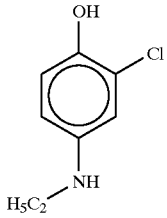

-continued
(ETA-38)
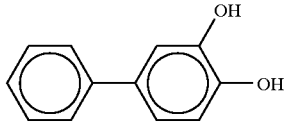
(ETA-39)
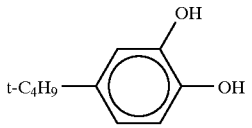
(ETA-40)
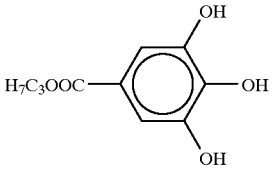
(ETA-41)
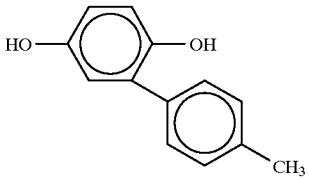
(ETA-42)
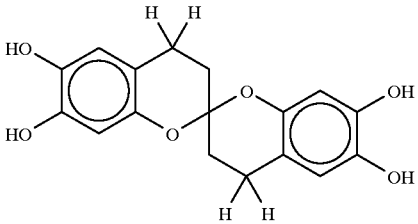
(ETA-43)
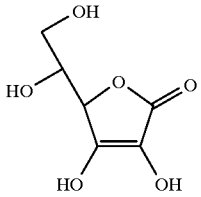
(ETA-44)
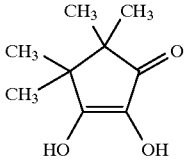
-continued
(ETA-45)
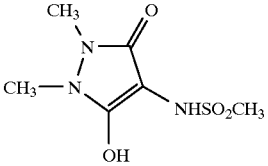
(ETA-46)
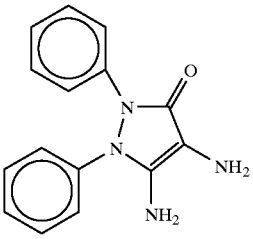
(ETA-47)
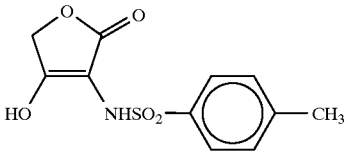
(ETA-48)
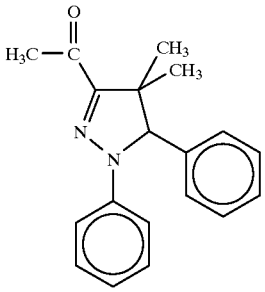
(ETA-49)
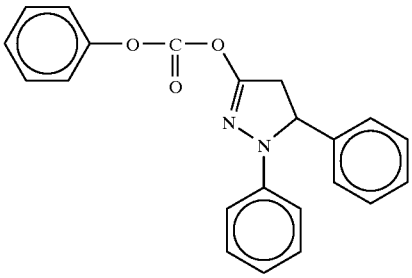
(ETA-50)
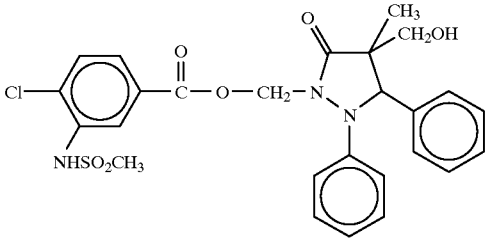

-continued (ETA-51)

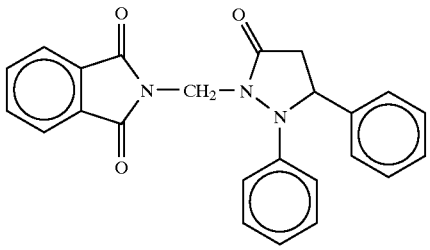

(ETA-52)

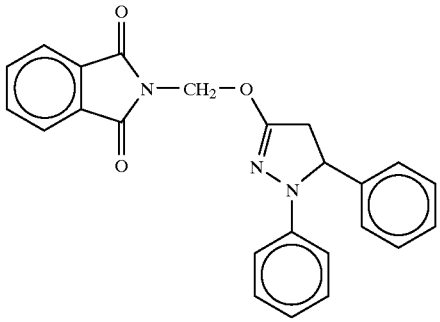

(ETA-53)

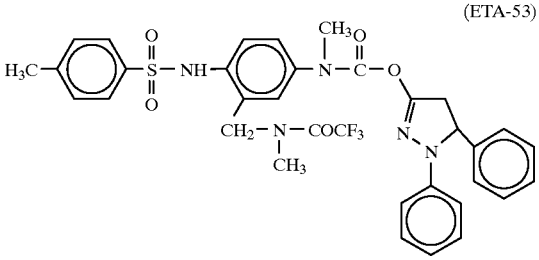

(ETA-54)

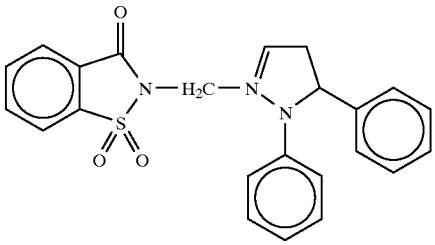

Among these specific compounds, when the auxiliary developing agent itself is incorporated, the diffusibility in a hydrophilic colloid is preferably lower as described above and, for example, of phenidones, ETA-17, ETA-19 to ETA-25, ETA-27, ETA-31 and ETA-32 are preferred, and of dihydroxy-benzenes, ETA-38 to ETA-42 are preferred. In the case where a precursor of the auxiliary developing agent is incorporated, if the solubility of the precursor itself in water is 0.1% or less, any of specific examples are effective with respect to the auxiliary developing agent released, however, the above-described auxiliary developing agent having a low diffusibility is particularly preferably used.

These compounds may be added to any layer of the photographic constituent layers such as a light-sensitive layer, an interlayer, an undercoat layer and a protective layer, however, when the auxiliary developing agent is incorporated, it is preferably added to a light-insensitive layer.

The compound may be incorporated into the light-sensitive material by a method where the compound is dissolved in a water-miscible organic solvent, such as methanol, and then added directly to a hydrophilic colloid layer, a method where the compound is formulated into an aqueous solution or colloid dispersion in the presence of a surface active agent and then added, a method where the compound is dissolved in a substantially water-immiscible solvent or oil, then dispersed in water or hydrophilic colloid and then added, or by a method where the compound is added in the state of a solid fine particle dispersion, and these conventionally known methods may be used individually or in combination.

The addition amount of the auxiliary developing agent or precursor thereof to the light-sensitive material is, based on the reducing agent for color formation, from 1 to 200 mol %, preferably from 5 to 100 mol %, more preferably from 10 to 50 mol %.

The coupler for dye formation of the present invention is a compound which forms a dye upon reaction with an oxidation product of the reducing agent for color formation. The coupler may be either a 4-equivalent coupler or a 2-equivalent coupler and appropriately selected depending on the kind of the reducing agent for color formation used.

For example, when a sulfonylhydrazine-base compound is used, the amino group as the coupling site is protected by sulfonyl and if a substituent is present at the coupling site on the coupler side upon coupling, the reaction is inhibited due to steric hindrance, accordingly, a 4-equivalent coupler is preferred. Further, when a carbamoylhydrazine (semicarbazide)-base compound is used, a 2-equivalent coupler is particularly preferably used because the coupling activity is improved by using the carbamoylhydrazine (semicarbazide)-base compound. Specific examples of the coupler, either a 4-equivalent coupler or a 2-equivalent coupler, are described in detail in T. H. James (compiler), *The Theory of the Photographic Process*, 4th ed., pp. 291–334 and 354–361, Macmillan (1977), JP-A-58-12353, JP-A-58-149046, JP-A-58-149047, JP-A-59-11114, JP-A-59-124399, JP-A-59-174835, JP-A-59-231539, JP-A-59-231540, JP-A-60-2951, JP-A-60-14242, JP-A-60-23474 and JP-A-60-66249.

Examples of the coupler which is preferably used in the present invention are described below.

The coupler which is preferably used in the present invention include the compounds having the following structures (1) to (12). These compounds are generically called an active methylene-base coupler, a pyrazolone-base coupler, a pyrazoloazole-base coupler, a phenol-base coupler, a naphthol-base coupler or a pyrrolotriazole-base coupler and known in the art.

Formula (1)

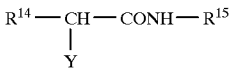

(2)

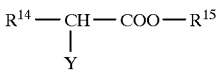

(3)

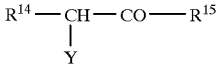

-continued (4)

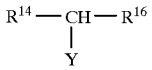

(5)

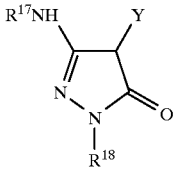

(6)

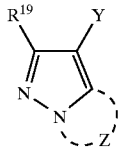

(7)

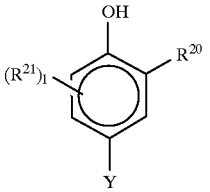

(8)

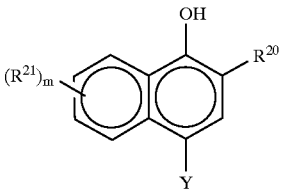

(9)

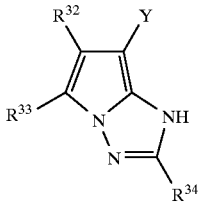

(10)

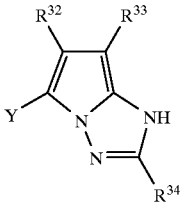

-continued (11)

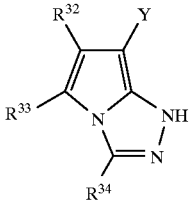

(12)

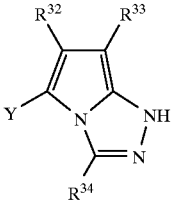

Formulae (1) to (4) each represents a coupler called an active methylene-base coupler and in the formulae, $R_{14}$ represents an acyl group, a cyano group, a nitro group, an aryl group, a heterocyclic group, an alkoxycarbonyl group, an aryloxycarbonyl group, a carbamoyl group, a sulfamoyl group, an alkylsulfonyl group or an arylsulfonyl group, which groups each may have a substituent.

In formulae (1) to (3), $R_{15}$ represents an alkyl, aryl or heterocyclic group which may have a substituent. In formula (4), $R_{16}$ represents an aryl or heterocyclic group which may have a substituent. Examples of the substituent which $R_{14}$, $R_{15}$ or $R_{16}$ may have include various substituents such as an alkyl group, an alkenyl group, an alkynyl group, an aryl group, a heterocyclic group, an alkoxy group, an aryloxy group, a cyano group, a halogen atom, an acylamino group, a sulfonamido group, a carbamoyl group, a sulfamoyl group, an alkoxycarbonyl group, an aryloxycarbonyl group, an alkylamino group, an arylamino group, a hydroxyl group and a sulfo group. Preferred examples of $R_{14}$ include an acyl group, a cyano group, a carbamoyl group and an alkoxycarbonyl group.

In formulae (1) to (4), Y represents a hydrogen atom or a group capable of splitting off upon coupling reaction with an oxidation product of the developing agent. Examples of the group represented by Y include a carboxyl group, a formyl group, a halogen atom (e.g., bromine, iodine), a carbamoyl group, a methylene group having a substituent (a substituent such as an aryl group, a sulfamoyl group, a carbamoyl group, an alkoxy group, an amino group or a hydroxyl group), an acyl group and a sulfo group. Among these, Y is preferably a hydrogen atom.

In formulae (1) to (4), $R_{14}$ and $R_{15}$ or $R_{14}$ and $R_{16}$ may be combined with each other to form a 3-, 4-, 5-, 6- or 7-membered ring.

Formula (5) represents a coupler called a 5-pyrazolone-base magenta coupler and in the formula, $R_{17}$ represents an alkyl group, an aryl group, an acyl group, or a carbamoyl group, $R_{18}$ represents a phenyl group or a phenyl group substituted by at least one of one or more halogen atoms, an alkyl group, a cyano group, an alkoxy group, an alkoxycarbonyl group and an acylamino group, and Y has the same meaning as in formulae (1) to (4).

Among 5-pyrazolone-base magenta couplers represented by formula (5), those where $R_{17}$ is an aryl group or an acyl group, $R_{18}$ is a phenyl group substituted by one or more halogen atoms and Y is a hydrogen atom are preferred.

Describing these preferred groups, $R_{17}$ is an aryl group such as phenyl, 2-chlorophenyl, 2-methoxyphenyl, 2-chloro-5-tetradecanamidophenyl, 2-chloro-5-(3-octadecenyl-1-succinimido)phenyl, 2-chloro-5-octadecylsulfonamidophenyl or 2-chloro-5-[2-(4-hydroxy-3-t-butylphenoxy)tetradecanamido]-phenyl, or an acyl group such as acetyl, pivaloyl, tetradecanoyl, 2-(2,4-di-t-pentylphenoxy)acetyl, 2-(2,4-di-t-pentylphenoxy)butanoyl, benzoyl or 3-(2,4-di-t-amylphenoxy-acetazido)benzoyl, and these groups each may further have a substituent such as an organic substituent bonded at the carbon atom, the oxygen atom, the nitrogen atom or the sulfur atom, or a halogen atom.

$R_{18}$ is preferably a substituted phenyl group such as 2,4,6-trichlorophenyl, 2,5-dichlorophenyl or 2-chlorophenyl.

Formula (6) represents a coupler called a pyrazoloazole-base coupler and in the formula, $R_{19}$ represents a hydrogen atom or a substituent, Z represents a nonmetallic atom group necessary for forming a 5-membered azole ring containing from 2 to 4 nitrogen atoms and the azole ring may have a substituent (including a condensed ring), and Y has the same meaning as defined in formulae (1) to (4).

Among pyrazoloazole-base couplers represented by formula (6), preferred in view of absorption characteristics of the colored dye are imidazo[1,2-b]pyrazoles described in U.S. Pat. No. 4,500,630, pyrazolo[1,5-b][1,2,4]triazoles described in U.S. Pat. No. 450,654 and pyrazolo[5,1-c][1,2,4]triazoles described in U.S. Pat. No. 3,725,067, and further among these, preferred in view of light fastness are pyrazolo[1,5-b][1,2,4]triazoles.

The substituents $R_{19}$ and Y and the substituent of the azole ring represented by Z are described in detail, for example, in U.S. Pat. No. 4,540,654, from column 2, line 41 to column 8, line 27. Preferred examples of the coupler include a pyrazoloazole coupler having a branched alkyl group directly bonded to the 2-, 3- or 6-position of the pyrazolotriazole group described in JP-A-61-65245, a pyrazoloazole coupler containing a sulfonamido group in the molecule described in JP-A-61-65245, a pyrazoloazole coupler having an alkoxyphenylsulfonamido ballast group described in JP-A-61-147254, a pyrazolotriazole coupler having an alkoxy group or an aryloxy group at the 6-position described in JP-A-62-209457 and JP-A-63-307453, and a pyrazolotriazole coupler having a carbonamido group in the molecule described in JP-A-2-201443.

Formulae (7) and (8) represent couplers called a phenol-base coupler and a naphthol-base coupler, respectively and in the formulae, $R_{20}$ represents a hydrogen atom or a group selected from $—NHCOR_{22}—$, $—SO_2NR_{22}R_{23}$, $—NHSO_2R_{22}$, $—NHCOR_{22}$, $—NHCONR_{22}R_{23}$ and $—NHSO_2NR_{22}R_{23}$ (wherein $R_{22}$ and $R_{23}$ each represents a hydrogen atom or a substituent), $R_{21}$ represents a substituent, l represents 0 or an integer selected from 1 and 2, m represents an integer selected from 0 to 4 and Y has the same meaning as defined in formulae (1) to (4). Examples of the substituents represented by $R_{21}$ to $R_{23}$ include those described above as the substituents of $R_{14}$ to $R_{16}$.

Preferred examples of the phenolic coupler represented by formula (7) include 2-alkylamino-5-alkylphenol-base couplers described in U.S. Pat. Nos. 2,369,929, 2,801,171, 2,772,162, 2,895,826 and 3,772,002; 2,5-diacylaminophenol-base couplers described in U.S. Pat. Nos. 2,772,162, 3,758,308, 4,126,396, 4,334,011 and 4,327,173, West German Patent (OLS) 3,329,729 and JP-A-59-166956; and 2-phenylureido-5-acylaminophenol-base couplers described in U.S. Pat. Nos. 3,446,622, 4,333,999, 4,451,559 and 4,427,767.

Preferred examples of the naphthol-base coupler represented by formula (8) include 2-carbamoyl-1-naphthol-base couplers described in U.S. Pat. Nos. 2,474,293, 4,052,212, 4,146,396, 4,228,233 and 4,296,200, and 2-carbamoyl-5-amido-1-naphthol-base couplers described in U.S. Pat. No. 4,690,889.

Formulae (9) to (12) represent couplers called a pyrrolotriazole coupler and in the formulae, $R_{32}$, $R_{33}$ and $R_{34}$ each represents a hydrogen atom or a substituent and Y has the same meaning as defined in formulae (1) to (4). Examples of the substituents represented by $R_{32}$, $R_{33}$ and $R_{34}$ include those described above as the substituents of $R_{14}$ to $R_{16}$. Preferred examples of the pyrrolotriazole-base coupler represented by formulae (9) to (12) are couplers where at least one of $R_{32}$ and $R_{33}$ is an electron withdrawing group described in European Patents 488248A1, 491197A1 and 545300.

In addition, couplers having a structure such as condensed ring phenol, imidazole, pyrrole, 3-hydroxypyridine, active methylene, methine, 5,5-condensed heterocyclic ring or 5,6-condensed heterocyclic ring, may be used.

The condensed ring phenol-base coupler includes couplers described in U.S. Pat. Nos. 4,327,173, 4,564,586 and 4,904,575.

The imidazole-base coupler includes couplers described in U.S. Pat. Nos. 4,818,672 and 5,051,347.

The pyrrole-base coupler includes couplers described in JP-A-4-188137 and JP-A-4-190347.

The 3-hydroxypyridine-base coupler includes couplers described in JP-A-1-315736.

The active methylene-base and methine-base couplers include couplers described in U.S. Pat. Nos. 5,104,783 and 5,162,196.

The 5,5-condensed heterocyclic ring-base coupler includes pyrrolopyrazole-base couplers described in U.S. Pat. No. 5,164,289 and pyrroloimidazole-base couplers described in JP-A-4-174429.

The 5,6-condensed heterocyclic ring-base coupler includes pyrazolopyrimidine-base couplers described in U.S. Pat. No. 4,950,585, pyrrolotriazine-base couplers described in JP-A-4-204730 and couplers described in European Patent 556700.

Other than those couplers described above, couplers described in West German Patents 3,819,051A and 3,823,049, U.S. Pat. Nos. 4,840,883, 5,024,930, 5,051,347 and 4,481,268, European Patents 304856A2, 329036, 354549A2, 374781A2, 379110A2 and 386930A1, JP-A-63-141055, JP-A-64-32260, JP-A-64-32261, JP-A-2-297547, JP-A-2-44340, JP-A-2-110555, JP-A-3-7938, JP-A-3-160440, JP-A-3-172839, JP-A-4-172447, JP-A-4-179949, JP-A-4-182645, JP-A-4-184437, JP-A-4-188138, JP-A-4-188139, JP-A-4-194847, JP-A-4-204532, JP-A-4-204731 and JP-A-4-204732 may also be used.

Specific examples of the coupler which can be used in the present invention are set forth below, but of course the present invention is by no means limited to these.

C-1
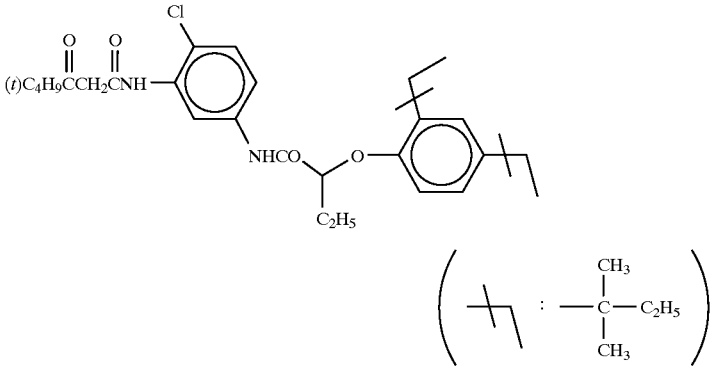
C-2
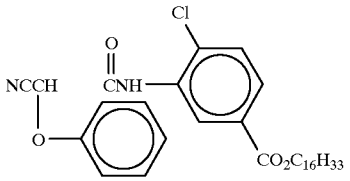
C-3
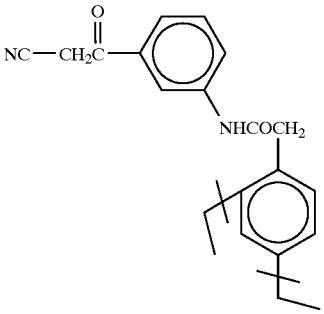
C-4
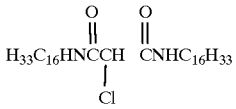
C-5
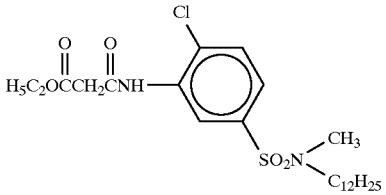
C-6
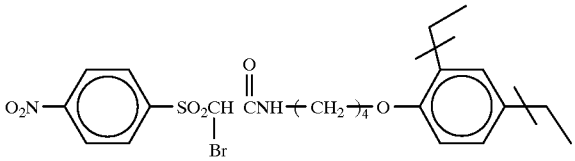

-continued
C-7
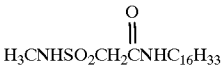
C-8
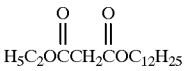
C-9
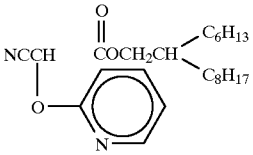
C-10
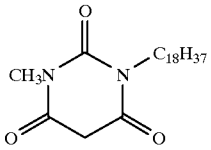
C-11
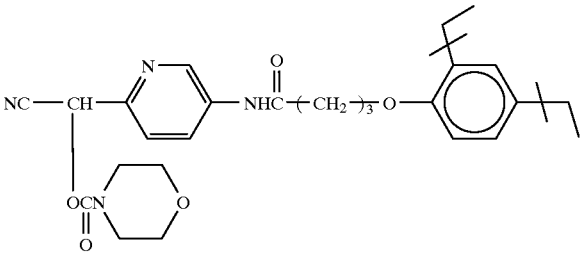
C-12
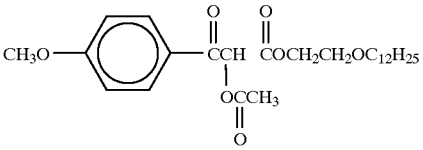
C-13
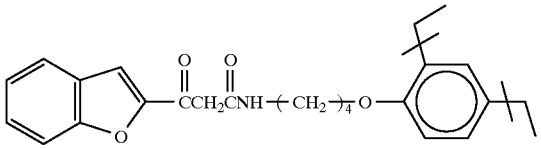
C-14
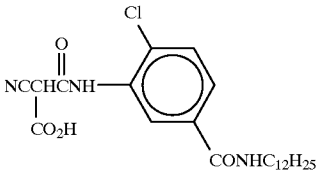

-continued
C-15
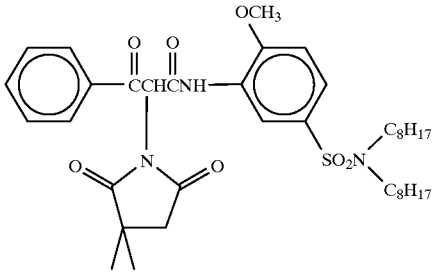
C-16
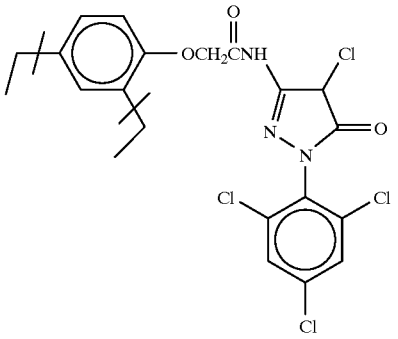
C-17
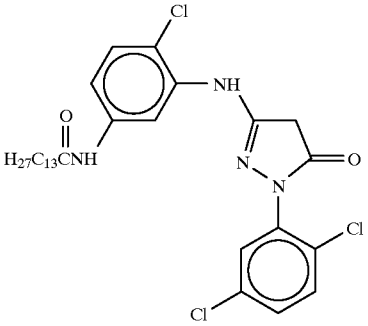
C-18
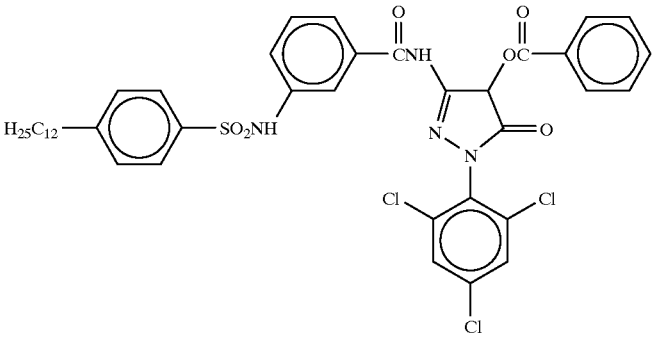

-continued
C-19
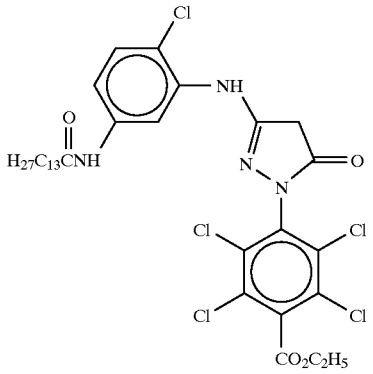
C-20
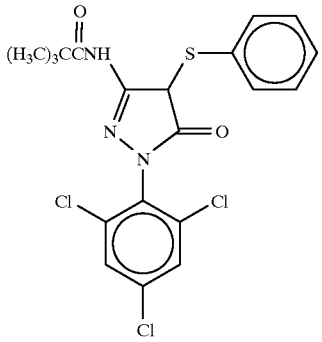
C-21
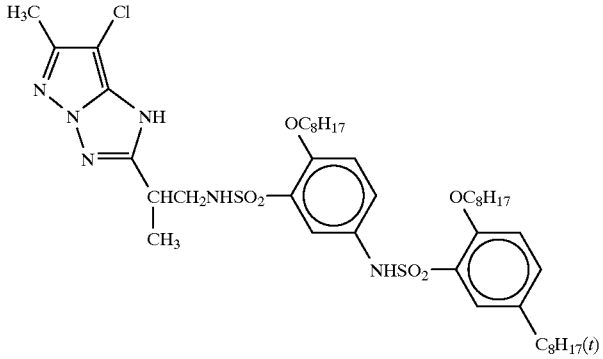
C-22
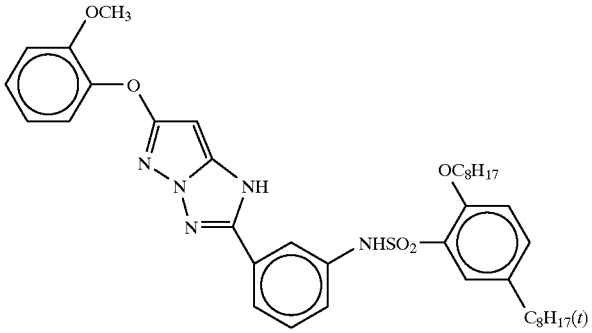

-continued
C-23
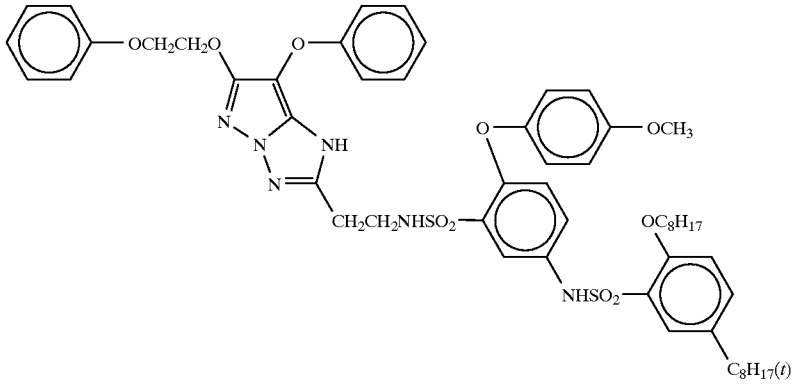
C-24
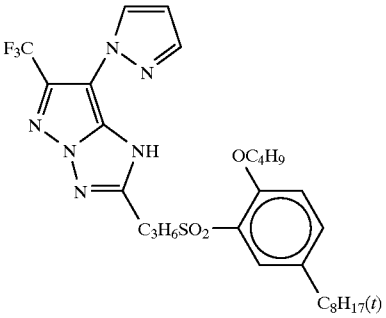
C-25
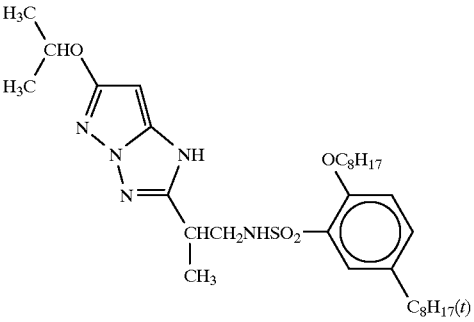
C-26
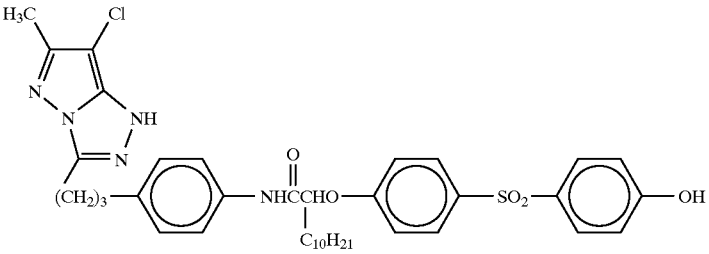

-continued
C-27
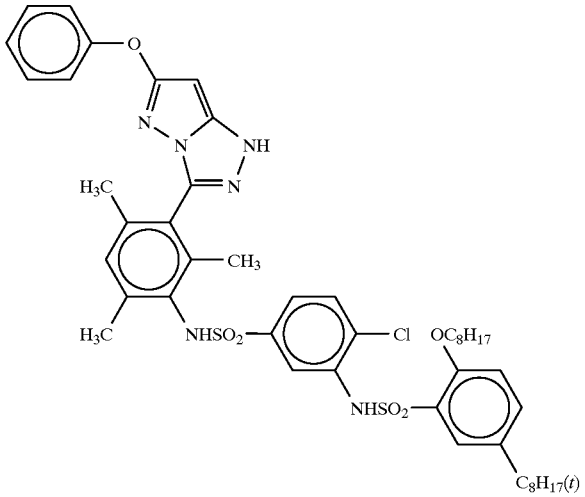
C-28
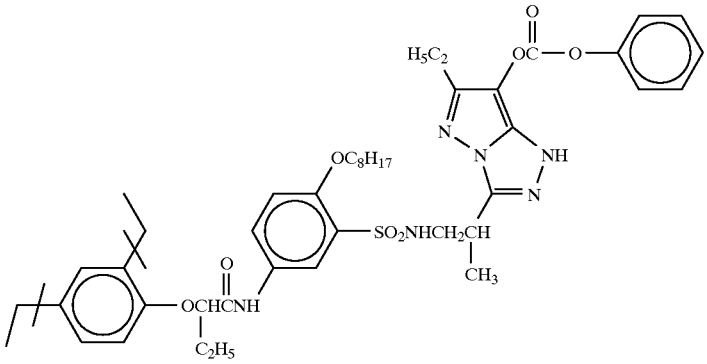
C-29
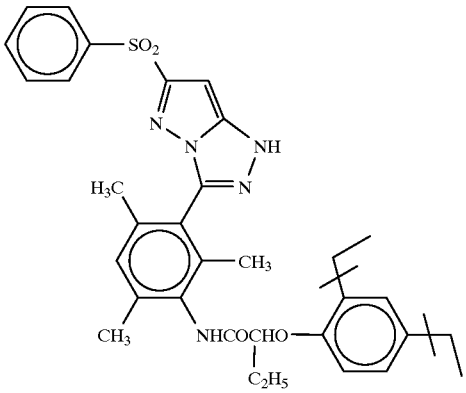
C-30
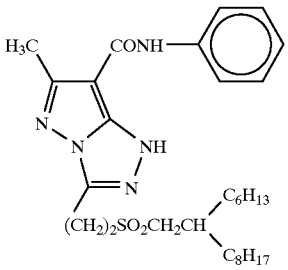

-continued
C-31
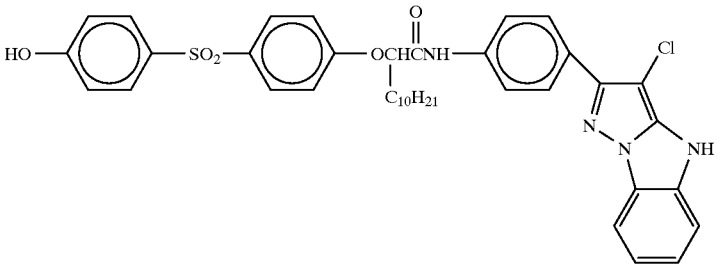
C-32
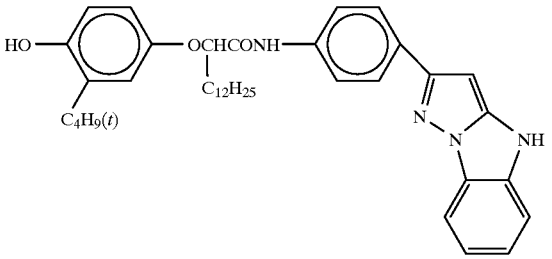
C-33
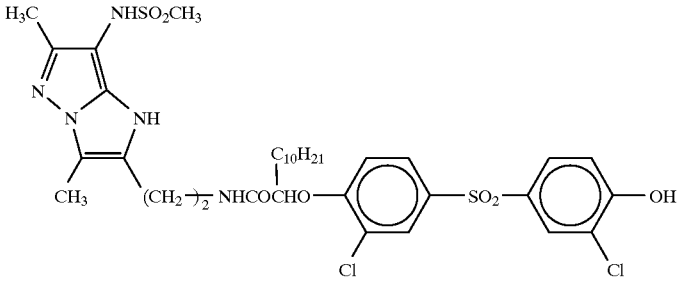
C-34
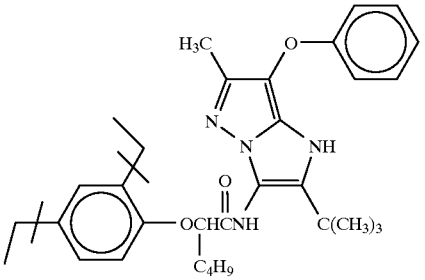
C-35
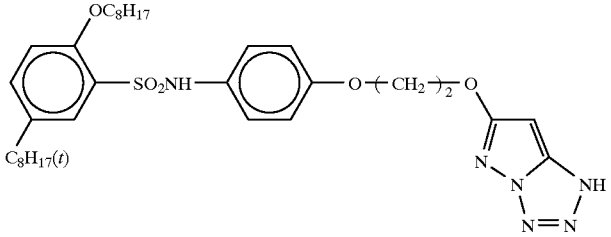

-continued
C-36
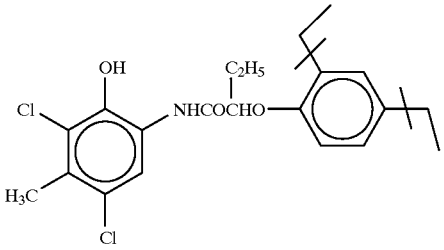
C-37
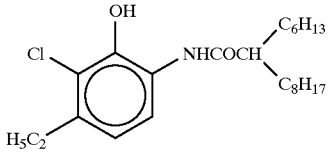
C-38
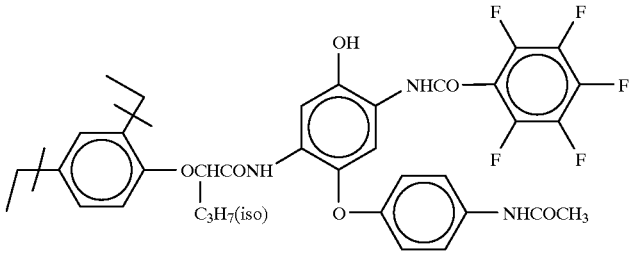
C-39
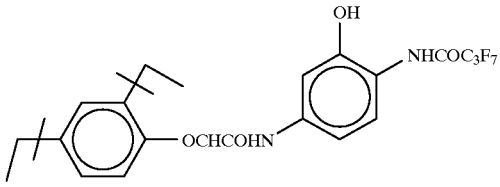
C-40
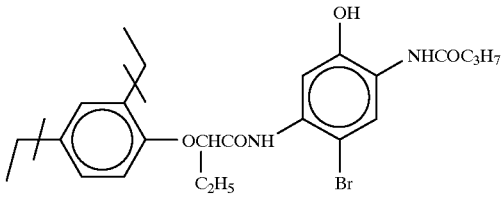
C-41
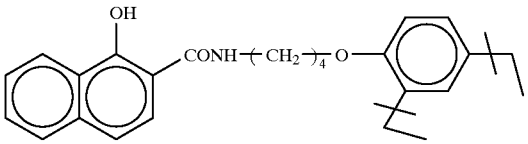
C-42
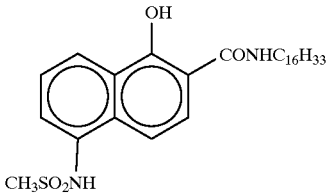

-continued
C-43
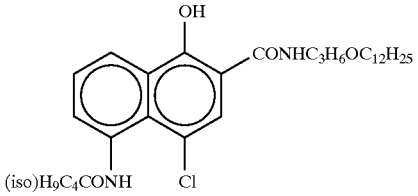
C-44
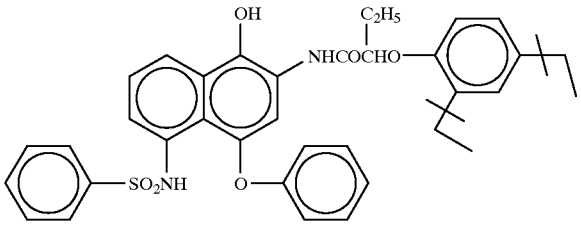
C-45
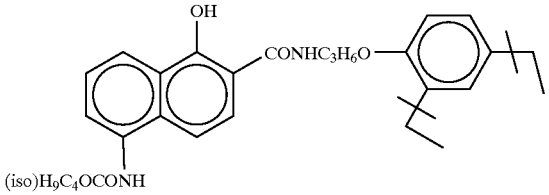
C-46
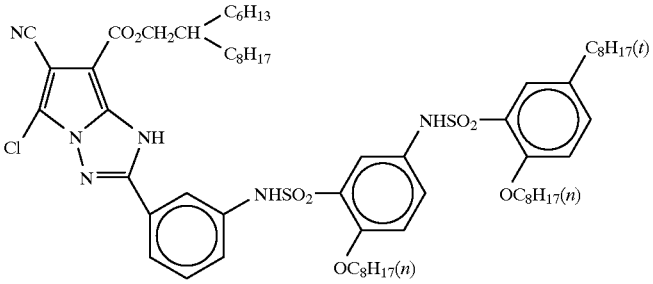
C-47
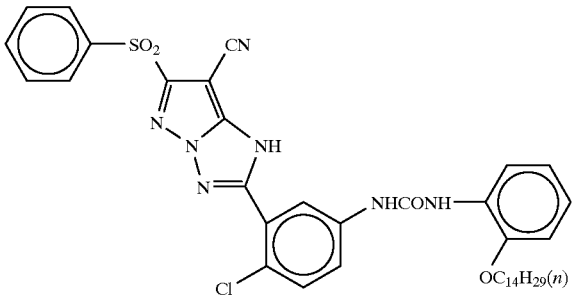

-continued
C-48
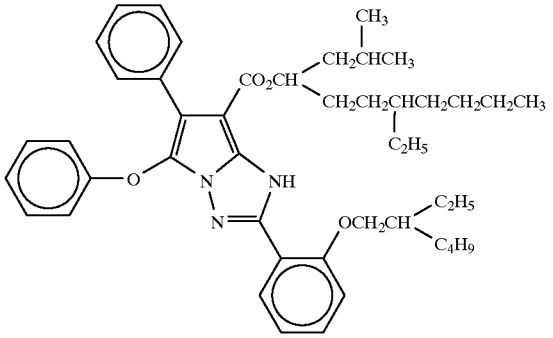
C-49
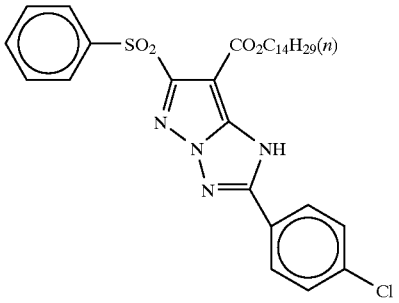
C-50
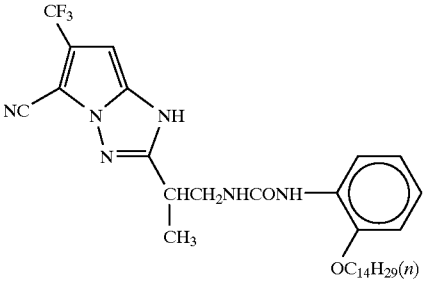
C-51
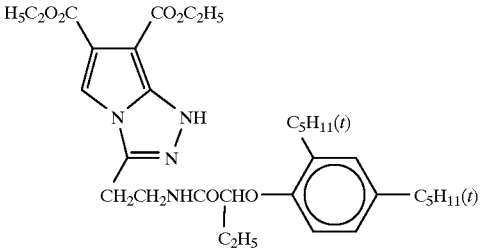

-continued
C-52
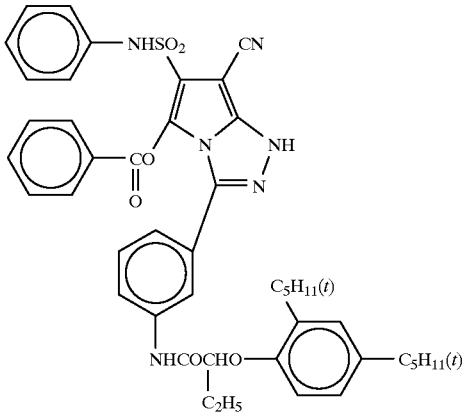
C-53
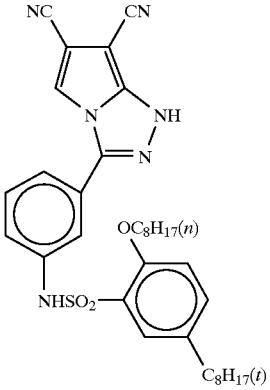
C-54
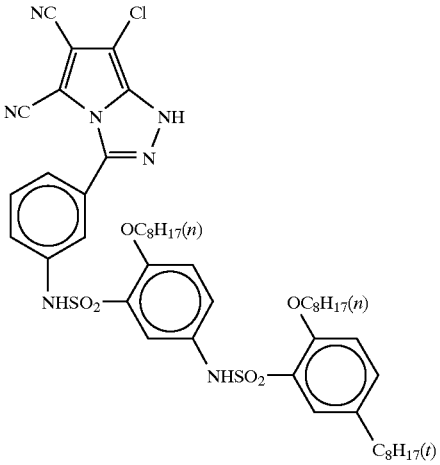
C-55
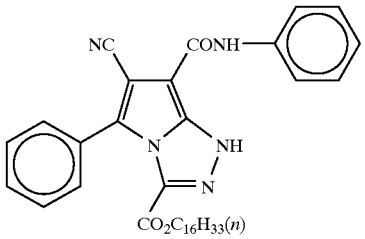

-continued
C-56
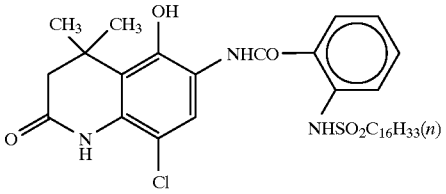
C-57
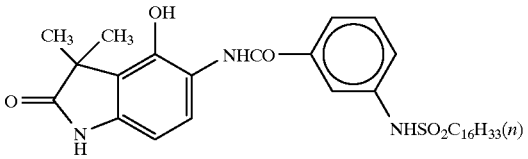
C-58
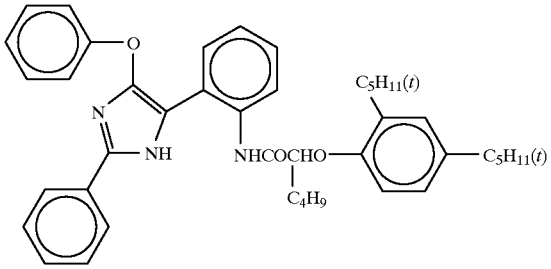
C-59
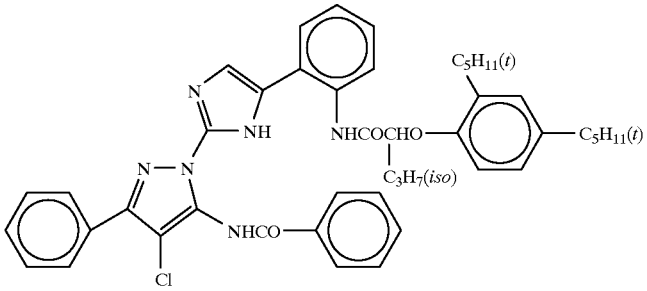
C-60
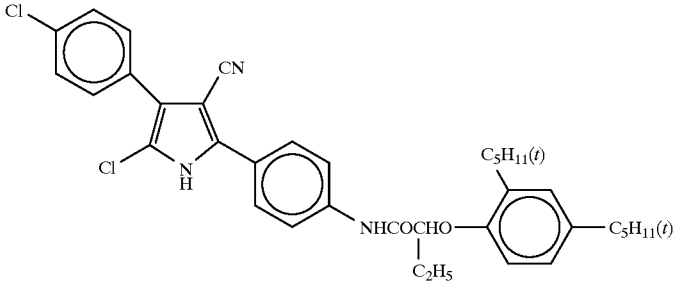

-continued
C-61
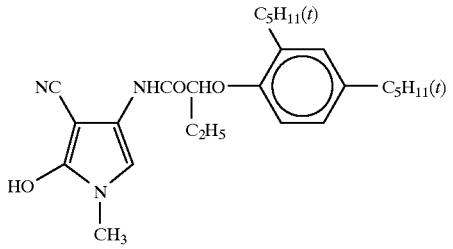
C-62
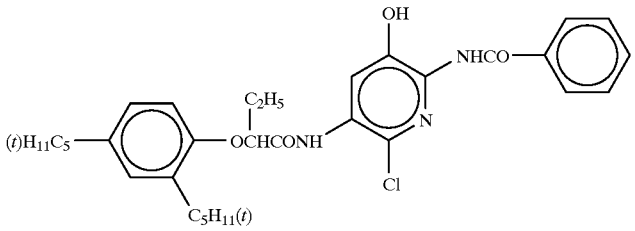
C-63
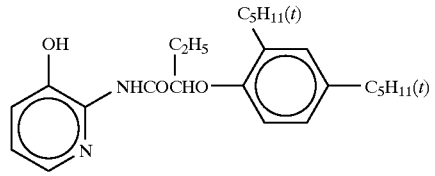
C-64
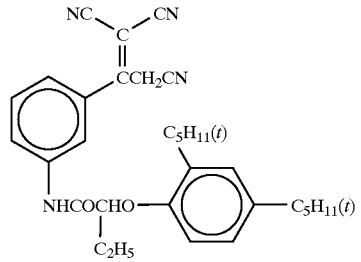
C-65
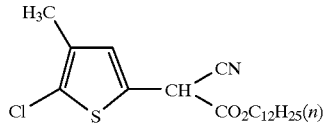
C-66
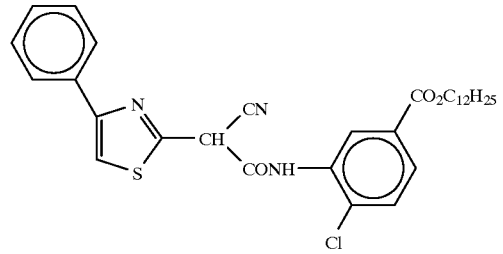

-continued
C-67
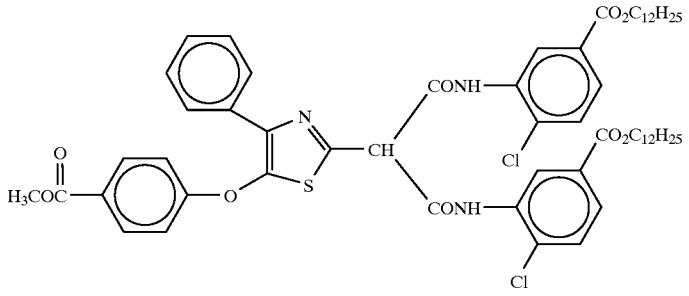
C-68
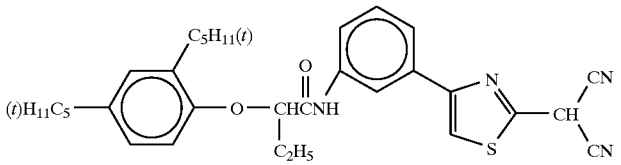
C-69
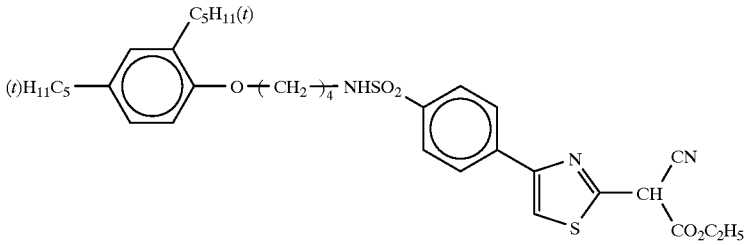
C-70
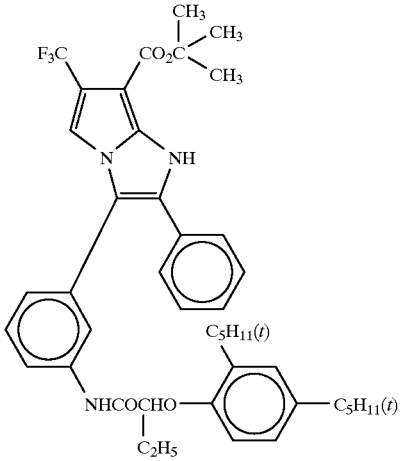
C-71
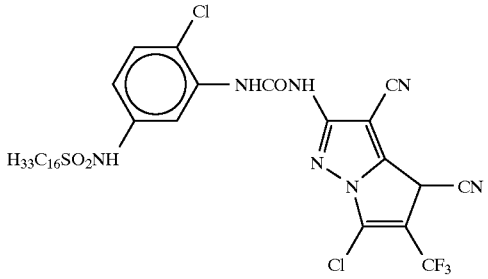

-continued

C-72

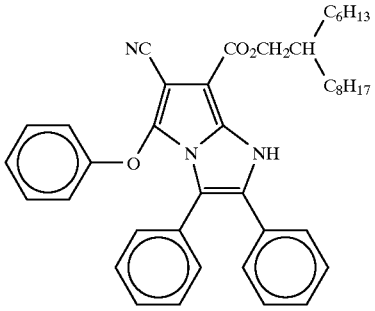

C-73

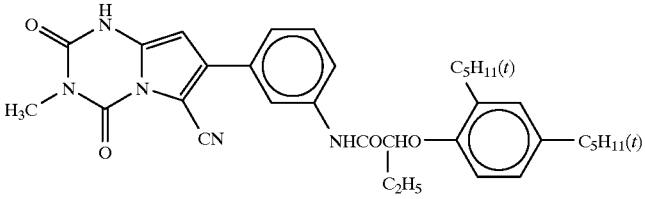

C-74

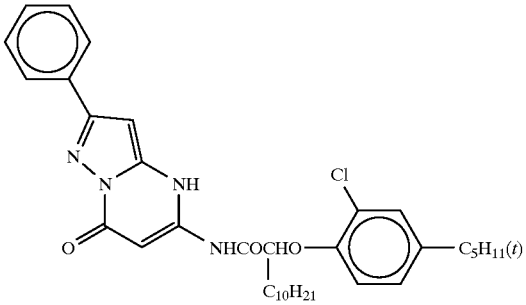

C-75

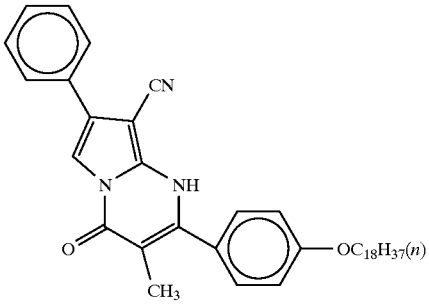

The reducing agent for color formation and couplers of the present invention can be incorporated into a light-sensitive material by various known dispersion methods and an oil-in water dispersion method where the compound is dissolved in a high boiling point organic solvent (if desired, a low boiling point organic solvent is used in combination), then emulsion-dispersed in an aqueous gelatin solution and added to a silver halide emulsion is preferred. The high boiling point organic solvent for use in the present invention is a water-immiscible compound having a melting point of 100° C. or lower and a boiling point of 140° C. or higher and any can be used if it is a good solvent to the reducing agent for color formation or to the coupler. The melting point of the high boiling organic solvent is preferably 80° C. or lower. The boiling point of the high boiling point solvent is preferably 160° C. or higher, more preferably 170° C. or higher. The high boiling point solvent is described in detail in JP-A-62-215272, from page 137, right lower column to page 144, right upper column. In the present invention, the use amount of the high boiling point solvent may be freely selected, however, the weight ratio of the high boiling point organic solvent to the reducing agent for color formation is preferably 20 or less, more preferably from 0.02 to 5.

In the present invention, known polymer dispersion methods may also be used. The process and effect of the latex dispersion as one example of the polymer dispersion method and specific examples of the latexes for impregnation are described in U.S. Pat. No. 4,199,363, West German Patent Applications (OLS) 2,541,274 and 2,541,230, JP-B-53-41091 and European Patent (Unexamined) Publication 029104, and further the dispersion method using an organic solvent-soluble polymer is described in PTC International Patent (Unexamined) Publication No. WO88/00723.

The average grain size of lipophilic fine particles containing the reducing agent for color formation of the present invention may be any grain size but in view of color forming property, it is preferably from 0.05 to 0.3 μm, more preferably from 0.05 to 0.2 μm.

In general, the average grain size of lipophilic grains can be reduced by selecting the kind of a surface active agent, by increasing the use amount of a surface active agent, by increasing the viscosity of a hydrophilic colloid solution, by increasing the viscosity of an lipophilic organic layer using a low boiling point organic solvent in combination, by intensifying the shear force such as increasing the revolution number of stirring impeller of an emulsification apparatus, or by prolonging the emulsification time.

The grain size of a lipophilic fine grain can be determined by an apparatus, for example, Nanocizer manufactured by U.K. Coultar.

The color light-sensitive material of the present invention fundamentally has a light-sensitive silver halide, a coupler for dye formation, a reducing agent for color formation and a binder on a support. These components are in many cases added to the same layer, however, if they are in the state capable of reaction, they may be added to separate layers.

The support for use in the present invention may be any transparent or reflective support as long as it is a support on which photographic emulsion layers can be coated, such as glass, paper or plastic film.

The plastic film for use in the present invention includes a polyester film such as polyethylene terephthalate, polyethylene naphthalate, cellulose triacetate and cellulose nitrate, a polyamide film, a polycarbonate film and a polystyrene film.

The "reflective support" as used in the present invention means a support increased in the reflectivity so as to render the dye image formed on the silver halide emulsion layer sharp, and the reflective support may be a support covered with a hydrophobic resin having dispersed therein a light-reflective substance such as titanium oxide, zinc oxide, calcium carbonate or calcium sulfate, or a hydrophobic resin having dispersed therein a light-reflective substance itself may be used as the support. Examples thereof include polyethylene-coated paper, polyester-coated paper, polypropylene-base synthetic paper and a support having provided thereon a reflection layer or using a reflective substance in combination such as a glass plate, a polyester film (e.g., polyethylene terephthalate, cellulose triacetate, cellulose nitrate), a polyamide film, a polycarbonate film, a polystyrene film and a vinyl chloride resin. As the polyester-coated paper, the polyester-coated paper comprising polyethylene terephthalate as a main component described in European Patent 0507489 is particularly preferred.

The reflective support for use in the present invention is preferably a paper support of which both surfaces are covered with waterproof resin layers, with at least one of waterproof resin layers containing white pigment fine particles. The white pigment particles are preferably contained at a density of 12 wt % or more, more preferably 14 wt % or more. The light-reflective white pigment is preferably obtained by thoroughly kneading a white pigment in the presence of a surface active agent and further by treating the surface of a pigment particle with di-, tri- or tetra-hydric alcohol.

In the present invention, a support having a surface preferably of second-class diffuse reflection is preferably used. The second-class diffuse reflection property means the diffuse reflection property obtained when the specular surface is made uneven to have finely divided specular faces directed toward different directions and the directions of finely divided surfaces (specular faces) are decentralized. The unevenness on the surface of second-class diffuse reflection is preferably provided such that the three-dimensional average height to the center plane is from 0.1 to 2 μm, preferably from 0.1 to 1.2 μm and JP-A-2-239244 describes such a support in detail.

In order to obtain colors over a wide range on the chromaticity diagram using three primary colors of yellow, magenta and cyan, at least three silver halide emulsion layers having sensitivity in different spectral regions are used in combination. For example, a three-layer combination consisting of a blue-sensitive layer, a green-sensitive layer and a red-sensitive layer or of a green-sensitive layer, a red-sensitive layer and an infrared-sensitive layer may be used. Respective layers may be arranged in various orders known for usual color light-sensitive materials. Further, each light-sensitive material may be divided into two or more layers, if desired.

In the light-sensitive material, various auxiliary layers such as a protective layer, an undercoat layer, an interlayer, an antihalation layer and a back layer may be provided. Further, various filter dyes may be added so as to improve the color separation property.

The silver halide grain for use in the present invention is silver bromide, silver chloride, silver iodide, silver chlorobromide, silver chloroiodide, silver iodobromide or silver chloroiodobromide. A silver salt other than these, for example, silver rhodanide, silver sulfide, silver selenide, silver carbonate, silver phosphate or organic acid silver, may be contained as a separate grain or a part of silver halide grains. When rapid development and desilvering (e.g., bleaching, fixing, bleach-fixing) are desired, a silver halide grain having a large silver chloride content is preferred. Further, when the development is appropriately suppressed, silver iodide is preferably contained. The preferred silver iodide content varies depending upon the light-sensitive material as an objective. For example, in case of X-ray light-sensitive material, the silver iodide content is preferably from 0.1 to 15 mol %, and in the case of graphic arts or a micro light-sensitive material, it is preferably from 0.1 to 5 mol %. In the case of a light-sensitive material for photographing represented by color negative film, the silver halide has a silver iodide content of preferably from 1 to 30 mol %, more preferably from 5 to 20 mol %, particularly preferably from 8 to 15 mol %. It is preferred in view of relaxation of the lattice strain that a silver iodobromide grain contains silver chloride.

The silver halide emulsion of the present invention preferably has a distribution or a structure with respect to the halogen composition in the grain. A typical example thereof is a core/shell-type or double structure-type grain having a halogen composition different between the inside of the grain and the surface layer of the grain as disclosed in JP-B-43-13162, JP-A-61-215540, JP-A-60-222845, JP-A-60-143331 and JP-A-61-75337. Also, not only a simple double structure but also a triple structure or greater multiple-layer structure may be used as disclosed in JP-A-60-222844, or silver halide having a different composition may be thinly laminated onto the surface of a core/shell type double structure grain.

In order to let the inside of a grain have a structure, not only the wrapped structure as described above but also a so-called junction structure may be formed in the grain. Examples thereof are described in JP-A-59-133540, JP-A-

58-108526, European Patent 199290A2, JP-B-58-24772 and JP-A-59-16254. The crystal to be joined has a composition different from the host crystal and can be joined to the edge, corner or plane part of the host grain. The junction crystal can be formed either when the host crystal has a uniform halogen composition or a core-shell type structure.

In the case of the junction structure, silver halide and silver halide are of course combined but a silver salt compound not having a rock-salt structure, such as silver rhodanide and silver carbonate, can be combined with silver halide to provide a junction structure. Also, a non-silver salt compound such as lead oxide may be used if the junction structure can be provided.

In the case of a silver iodobromide grain or the like having a structure as described above, the silver iodide content of the core part is preferably higher than that of the shell part. On the contrary, in some cases, it is preferred that the silver iodide content of the core part is low and that of the shell part is high. Similarly, in the case of a grain having a junction structure, the host crystal may have a high silver iodide content and the joined crystal may have a relatively low silver iodide content, and the reverse thereof may also be used. The boundary between portions different in the halogen composition of a grain having the above-described structure may be either clear or unclear. Also, it is a preferred embodiment to positively provide a continuous change in the composition.

In the case of a silver halide grain where two or more silver halides are present as a mixed crystal or to form a structure, the control of the halogen composition distribution among grains is important. The measuring method of the halogen composition distribution among grains is described in JP-A-60-254032. The halogen distribution among grains is preferably uniform. In particular, an emulsion having a high uniformity such that the coefficient of variation is 20% or less is preferred. Another preferred embodiment is an emulsion having a correlation between the grain size and the halogen composition. An example thereof is a case where a correlation such that the larger size grain has a higher iodide content and the smaller size grain has a lower iodide content is present. Depending upon the purpose, a reverse correlation or a correlation with other halogen composition may be selected. For this purpose, two or more emulsions having different compositions are preferably mixed.

The control of the halogen composition in the vicinity of the grain surface is important. To increase the silver iodide content or the silver chloride content in the vicinity of the surface accompanies the change in the adsorptivity of a dye or the developing rate and therefore, the way of increasing the silver halide content may be selected depending upon the purpose. In the case when the halogen composition in the vicinity of the surface is varied, either a structure such that the silver halide wholly embraces the grain or a structure such that the silver halide is adsorbed only a part of the grain may be selected. For example, the halogen composition may be varied only on one face of a tetradecahedral grain comprising a (100) face and a (111) face or the halogen composition may be varied on one plane of the main plane and the side plane of a tabular grain.

The silver halide grain for use in the present invention may be a regular crystal free of twin planes or a crystal as described in *Shashin Kogyo no Kiso, Gin-en Shashin Hen*, compiled by Nippon Shashin Gakkai, p. 163 (Corona Sha), such as a single twin crystal containing one twin plane, a parallel multiple twin crystal containing two or more parallel twin planes or a non-parallel multiple twin crystal containing two or more non-parallel twin planes and these crystals may be selected depending upon the purpose. An example of the method of mixing grains having different forms is disclosed in U.S. Pat. No. 4,865,964 and this method may be selected, if desired. In the case of a regular crystal, a cubic form comprising a (100) face, an octahedral form comprising a (111) face or a dodecahedral form comprising a (110) face disclosed in JP-B-55-42737 and JP-A-60-222842 may be used. Further, as described in *Journal of Imaging Science*, Vol. 30, p. 247 (1986), a (h11) face grain represented by (211) face, (hh1) face grain represented by (311) face, a (hk0) face grain represented by (210) face or a (hk1) face grain represented by (321) face may also be selected and used depending on the purpose although their preparation requires an advanced technique. A grain having two faces or a plurality of faces together may also be selected and used depending on the purpose and examples thereof include a tetradecahedral grain having a (100) face and a (111) face together in one grain, a grain having (100) face and a (110) face together and a grain having a (111) face and a (110) face together.

The value obtained by dividing a circle-corresponding diameter of a projected area by a grain thickness is called an aspect ratio and the form of a tabular grain is defined by the aspect ratio. Tabular grains having an aspect ratio of 1 or more can be used in the present invention. The tabular grain can be prepared according to the methods described in Cleve, *Photography Theory and Practice*, p. 131 (1930), Gutoff, *Photographic Science and Engineering*, Vol. 14, pp. 248–257 (1970), U.S. Pat. Nos. 4,434,226, 4,414,310, 4,433,048 and 4,439,520 and British Patent 2,112,157. The use of a tabular grain is accompanied by advantages such that the covering power is elevated or the spectral sensitization efficiency by a sensitizing dye is increased and U.S. Pat. No. 4,434,226 cited above describes it in detail. The average aspect ratio of 80% or more of the total projected area of grains is preferably from 1 to less than 100, more preferably from 2 to less than 20, particularly preferably from 3 to less than 10. The form of the tabular grain may be selected from a triangle, a hexagon or a circle. A equilateral hexagon consisting of six sides having nearly the same length as described in U.S. Pat. No. 4,797,354 is a preferred embodiment.

A circle-corresponding diameter of a projected area is often used as a grain size of a tabular grain and grains having an average diameter of 0.6 $\mu$m or less as described in U.S. Pat. No. 4,748,106 are preferred to achieve high image quality. Also, an emulsion having a narrow grain size distribution as described in U.S. Pat. No. 4,775,617 is preferred. It is preferred for elevating the sharpness to restrict in terms of the shape of a tabular grain the grain thickness to 0.5 $\mu$m or less, more preferably 0.3 $\mu$m or less. An emulsion having high uniformity such that the coefficient of variation of the grain thickness is 30% or less is also preferred. Further, a grain of which grain thickness and face-to-face dimension of the twin plane are prescribed, described in JP-A-63-163451, is also preferred.

In the case of a tabular grain, the dislocation lines can be observed through a transmission-type electron microscope. It is preferred to select a grain containing no dislocation line, a grain containing several dislocation lines or a grain containing a large number of dislocation lines depending upon the purpose. Also, a grain containing dislocation lines which are integrated linearly to or distorted from a specific direction of the crystal orientation may also be selected. The dislocation lines may be integrated throughout the grain, may be integrated into a specific part of the grain or may be integrated only to, for example, a fringe part of the grain.

The dislocation lines are preferably integrated not only to a tabular grain but also to a regular crystal grain or an amorphous grain represented by a pebble-like grain. Also in this case, the integration site is preferably limited to a specific part such as a peak or an edge of a grain.

The silver halide emulsion for use in the present invention may be subjected to a treatment for rounding a grain as disclosed in European Patents 96727B1 and 64412B1 or may be subjected to surface modification as disclosed in West German Patent 2,306,447C2 and JP-A-60-221320.

The grain surface generally has a flat structure but in some cases, unevenness may be preferably provided thereto by intention. Examples thereof include a grain obtained by a method described in JP-A-58-106532 and JP-A-60-221320 where a part of the crystal, for example, a peak or a center of the plane, is perforated, and a ruffled grain described in U.S. Pat. No. 4,643,966.

The grain size of the emulsion for use in the present invention can be verified from a circle-corresponding diameter of a projected area using an electron microscope, from a sphere-corresponding diameter of the grain volume calculated from the projected area and the grain thickness or from a sphere-corresponding diameter of the volume according to a coultar counter method. In terms of a sphere-corresponding diameter, a grain may be selected over the range of from an ultrafine grain having a grain size of 0.05 $\mu$m or less to a giant grain having a grain size in excess of 10 $\mu$m. Preferably, a grain having a grain size of from 0.1 to 3 $\mu$m is used as a light-sensitive silver halide grain.

The emulsion for use in the present invention may be selected from a so-called polydisperse emulsion having a broad grain size distribution and a monodisperse emulsion having a narrow size distribution depending upon the purpose. As a measure for expressing the size distribution, a coefficient of variation in the circle-corresponding diameter of the projected area of a grain or in the sphere-corresponding diameter of the volume of a grain may be used. In the case of using a monodisperse emulsion, an emulsion having a coefficient of variation in the size distribution of preferably 25% or less, more preferably 20% or less, still more preferably 15% or less, is preferred.

The monodisperse emulsion may be sometimes defined to have a grain size distribution such that 80% or more, by grain number or by weight, of all grains has a grain size falling within the average grain size ±30%. In order to satisfy the gradation as a goal of the light-sensitive material, in the emulsion layers having substantially the same spectral sensitivity, two or more kinds of monodisperse silver halide emulsions having different grain sizes may be mixed in the same layer or may be coated as separate layers by superposing one on another. Further, two or more kinds of polydisperse silver halide emulsions or a combination of a monodisperse emulsion and a polydisperse emulsion may be mixed or superposed.

The photographic emulsion for use in the present invention can be prepared according to the methods described in P. Glafkides, *Chimie et Phisique Photographique*, Paul Montel (1967), G. F. Duffin, *Photographic Emulsion Chemistry*, The Focal Press (1966) and V. L. Zelikman et al, *Making and Coating Photographic Emulsion*, The Focal Press (1964). More specifically, any of acid process, neutral process and ammonia process may be used and the reaction between a soluble silver salt and a soluble halogen salt may be conducted by a single jet method, a double jet method or a combination of these. Also, a method of forming grains in an atmosphere of excess silver ions (so-called reverse mixing method) may be used. A so-called controlled double jet method, which is one system of the double jet method, of keeping constant the pAg of the liquid phase where the silver halide is formed may also be used. According to this method, the silver halide emulsion obtained can have a regular crystal form and a nearly uniform grain size.

In some cases, a method of adding silver halide grains previously precipitated and formed in a reaction vessel for the preparation of an emulsion and methods described in U.S. Pat. Nos. 4,334,012, 4,301,241 and 4,150,994 are preferred. The grain may be used as a seed crystal or may be effectively supplied as a silver halide for use in the growth. In the latter case, an emulsion having a small grain size is preferably added and the emulsion may be added wholly at a time, may be added by several installments or may be continuously added. Further, in order to modify the surface, it is effective in some cases to add grains having various halogen compositions.

A method of converting a majority part or merely a part of the halogen composition of a silver halide grain according to halogen conversion is disclosed in U.S. Pat. Nos. 3,477,852 and 4,142,900, European Patents 273429 and 273430 and West German Patent Application (OLS) 3,819,241 and this is an effective grain formation method. In order to effect conversion into a further difficultly soluble silver salt, a soluble halogen solution or silver halide grain may be added. The halogen composition may be converted all at a time, may be converted in several installments or may be continuously converted.

With respect to the grain growth, in addition to the method of adding a soluble silver salt and a halogen salt at a constant concentration and at a constant flow rate, a method of growing grains by varying the concentration or varying the flow rate as described in British Patent 1,469,480 and U.S. Pat. Nos. 3,650,757 and 4,242,445 is preferred. By increasing the concentration or increasing the flow rate, the amount of silver halide supplied can be varied according to linear function, secondary function or more complicated function of the addition time. It is also preferred to reduce the amount of silver halide to be supplied, if desired. Further, a method where when a plurality of soluble silver salts different in the solution composition are added or when a plurality of soluble halogen salts different in the solution composition are added, one is increased and the other is decreased is also effective.

The mixing vessel used on reaction of a soluble silver salt with a soluble halogen salt solution may be selected from those used in the methods described in U.S. Pat. Nos. 2,996,287, 3,342,605, 3,415,650 and 3,785,777 and West German Patent Applications (OLS) 2,556,885 and 2,555,364.

In order to accelerate the ripening, a silver halide solvent is useful. For example, it is known to let an excessive amount of halogen ions be present in a reaction vessel so as to accelerate ripening. Other ripening agent may also be used. The ripening agent may be wholly blended into a dispersion medium in the reaction vessel before adding silver and halide salts or may be incorporated into the reaction vessel together with the addition of a halide salt, a silver salt or a deflocculant. In another modified embodiment, the ripening agent may be incorporated independently at the stage of adding a halide salt and a silver salt.

Examples of the ripening agent include ammonia, a thiocyanate (e.g., potassium thiocyanate, ammonium thiocyanate), an organic thioether compound (e.g., compounds described in U.S. Pat. Nos. 3,574,628, 3,021,215, 3,057,724, 3,038,805, 4,276,374, 4,297,439, 3,704,130 and 4,782,013, JP-A-57-104926), a thione compound (e.g., quaternary substituted thiourea described in JP-A-53-82408, JP-A-55-77737, U.S. Pat. No. 4,221,863, compounds described in JP-A-53-144319), a mercapto compound capable of accelerating the growth of a silver halide grain described in JP-A-57-202531 and an amine compound (e.g., those described in JP-A-54-100717).

Gelatin is advantageous as a protective colloid used at the preparation of the emulsion of the present invention or as a binder in other hydrophilic colloid layers, however, a hydrophilic colloid other than gelatin may also be used.

Examples thereof include proteins such as gelatin derivatives, graft polymers of gelatin to other high polymer, albumin and casein; saccharide derivatives such as cellulose derivatives, e.g., hydroxyethyl cellulose, carboxymethyl cellulose and cellulose sulfate, sodium arginates and starch derivatives; and various synthetic hydrophilic high polymer materials such as homopolymers and copolymers of polyvinyl alcohol, polyvinyl alcohol partial acetal, poly-N-vinylpyrrolidone, polyacrylic acid, polymethacrylic acid, polyacrylamide, polyvinyl imidazole or polyvinyl pyrazole.

The gelatin may be a lime-processed gelatin, an acid-processed gelatin or an enzyme-processed gelatin as described in *Bull. Soc. Photo. Japan*, No. 16, p. 30 (1966), and a hydrolysate or enzymolysate of gelatin may also be used. The use of a low molecular weight gelatin described in JP-A-1-158426 is preferred for the preparation of tabular grains.

It is preferred to water wash the emulsion of the present invention for desalting and to prepare a new protective colloid dispersion. The temperature for water washing may be selected depending upon the purpose, but it is preferably from 5 to 50° C. The pH at the time of water washing may be also selected depending upon the purpose, but it is preferably from 2 to 10, more preferably from 3 to 8. The pAg at the time of water washing may also be selected depending upon the purpose, but it is preferably from 5 to 10. The method of water washing may be selected from a noodle water washing method, a dialysis method using a semipermeable membrane, a centrifugal separation method, a coagulation precipitation method and an ion exchange method. The coagulation precipitation method may be selected from a method using sulfate, a method using an organic solvent, a method using a water-soluble polymer and a method using a gelatin derivative.

At the time of preparing the emulsion of the present invention, it is preferred depending on the purpose to let a metal ion salt be present, for example, during grain formation, at the desilvering step, at the time of chemical sensitization or before coating. The metal ion salt is preferably added at the grain formation when it is doped to a grain, and between after grain formation and before the completion of chemical sensitization when it is used for modification of the grain surface or as a chemical sensitizer. The metal ion salt may be doped to the entire of a grain, only to the core part, only to the shell part or only to the epitaxial part of a grain, or only to the substrate grain. Examples of the metal include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. These metals may be added if it is in the form of a salt capable of dissolution at the grain formation, such as an ammonium salt, an acetic acid salt, a nitric acid salt, a sulfuric acid salt, a phosphoric acid salt, a hydroxyl salt, a 6-coordinated complex salt or a 4-coordinated complex salt. Examples thereof include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$ and $K_4Ru(CN)_6$. The ligand of the coordination compound can be selected from halogen, $H_2O$, $NH_3$, a cyano group, a cyanate group, a thiocyanate group, a nitrosyl group, a thionitrosyl group, an oxo group and a carbonyl group. These metal compounds may be used individually or in combination of two or more.

A method of adding a chalcogen compound during the preparation of an emulsion as described in U.S. Pat. No. 3,772,031 is also useful in some cases. Other than S, Se and Te, a cyano salt, a thiocyano salt, a selencyano acid, a carbonate, a phosphate or an acetate may also be present.

The silver halide grain of the present invention may be subjected to at least one of sulfur sensitization, selenium sensitization, tellurium sensitization (these three methods are collectively called chalcogen sensitization), noble metal sensitization and reduction sensitization at any step during the preparation of a silver halide emulsion. A combination of two or more sensitization methods is preferred. By selecting the step when the chemical sensitization is carried out, various types of emulsions may be prepared. The chemical sensitization specks are embedded, in one type, inside the grain, in another type, embedded in the shallow part from the grain surface, and in still another type, formed on the grain surface. In the emulsion of the present invention, the site of chemical sensitization specks may be selected according to the purpose, however, in general, it is preferred that at least one kind of chemical sensitization specks are formed in the vicinity of the surface.

The chemical sensitization which can be preferably used in the present invention is chalcogen sensitization, noble metal sensitization or a combination of these sensitizations, and it may be carried out using an active gelatin as described in T. H. James, *The Theory of the Photographic Process*, 4th ed. Macmillan, pp. 67–76 (1977), or using sulfur, selenium, tellurium, gold, platinum, palladium, iridium or a combination of these sensitizing dyes in plurality at a pAg of from 5 to 10, a pH of from 5 to 8 and a temperature of from 30 to 80° C. as described in *Research Disclosure*, Item 12008 (April, 1974), ibid., Item 13452 (June, 1975), ibid., Item 307105 (November, 1989), U.S. Pat. Nos. 2,642,361, 3,297,446, 3,772,031, 3,857,711, 3,901,714, 4,266,018 and 3,904,415 and British Patent 1,315,755.

In he sulfur sensitization, a labile sulfur compound is used and specific examples of the compound include a thiosulfate (e.g., hypo), a thiourea (e.g., diphenylthiourea, triethylthiourea, allylthiourea), a rhodanine, a mercapto, a thioamide, a thiohydantoin, a 4-oxo-oxazolidine-2-thione, a di- or poly-sulfide, a polythionate, an elemental sulfur and known sulfur-containing compounds described in U.S. Pat. Nos. 3,857,711, 4,266,018 and 4,054,457. The sulfur sensitization is used in many cases in combination with noble metal sensitization.

The use amount of the sulfur sensitizer to the silver halide grain of the present invention is preferably from $1\times10^{-7}$ to $1\times10^{-3}$ mol, more preferably $5\times10^{-7}$ to $1\times10^{-4}$ mol, per mol of silver halide.

In the selenium sensitization, known labile selenium compounds are used, such as selenium compounds described in U.S. Pat. Nos. 3,297,446 and 3,297,447, and specific examples of the selenium compound include colloidal metal selenium, selenoureas (e.g., N,N-dimethylselenourea, tetramethylselenourea), selenoketones (e.g., selenoacetone), selenoamides (e.g., selenoacetamido), selenocarboxylic acids and esters, isoselenocyanates, selenides (e.g., diethylselenide, triphenylphosphineselenide) and selenophosphates (e.g., tri-p-tolylselenophosphate). The selenium sensitization is preferably used in some cases in combination with sulfur sensitization, noble metal sensitization or both of these sensitizations.

The use amount of the selenium sensitizer varies depending upon the selenium compound used, the silver halide grain or chemical ripening conditions, but it is usually from $10^{-8}$ to $10^{-4}$ mol, preferably on the order of from $1\times10^{-7}$ to $1\times10^{-5}$ mol, per mol of silver halide.

As the tellurium sensitizer for use in the present invention, the compounds described in Canadian Patent 800,958, British Patents 1,295,462 and 1,396,696 and Japanese Patent Application Nos. 2-333819 and 3-131598 can be used, and specific examples of the tellurium sensitizer include colloidal tellurium, telluroureas (e.g., tetramethyltellurourea, N-carboxyethyl-N',N'-dimethyltellurourea, N,N'-dimethylethylenetellurourea), isotellurocyanates, telluroketones, telluroamides, tellurohydrazides, telluroesters, phosphinetellurides (e.g., tributylphosphinetelluride, butyldiisopropylphosphinetelluride) and other tellurium compounds (e.g., potassium telluride, potassium tellurocyanate, telluropentathionate sodium salt).

The use amount of the tellurium sensitizer is from $1\times10^{-7}$ to $5\times10^{-3}$ mol, preferably from $5\times10^{-7}$ to $1\times10^{-3}$ mol, per mol of silver halide.

In the noble metal sensitization, a noble metal salt such as gold, platinum, palladium or iridium may be used and in particular, gold sensitization, palladium sensitization and a combination use of these two sensitizations are preferred. In the case of gold sensitization, a known compound such as chloroaurate, potassium chloroaurate, potassium aurithiocyanate, gold sulfide or gold selenide may be used. The palladium compound means a palladium divalent salt or tetravalent salt. The preferred palladium compound is represented by $R_2PdX_6$ or $R_2PdX_4$, wherein R represents a hydrogen atom, an alkali metal atom or an ammonium group and X represents a halogen atom such as chlorine, bromine or iodine.

More specifically, $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$ are preferred. The gold compound and the palladium compound each is preferably used in combination with a thiocyanate or a selenocyanate.

To the emulsion of the present invention, the gold sensitization is preferably applied in combination. The amount of the gold sensitizer is preferably from $1\times10^{-7}$ to $1\times10^{-3}$, more preferably from $5\times10^{-7}$ to $5\times10^{-4}$ mol, per mol of silver halide. The amount of the palladium compound is preferably from $5\times10^{-7}$ to $1\times10^{-3}$ mol per mol of silver halide. The amount of the thiocyanogen compound or the selenocyanogen compound is preferably from $1\times10^{-6}$ to $5\times10^{-2}$ mol per mol of silver halide.

The silver halide emulsion of the present invention is preferably subjected to reduction sensitization during grain formation, before or during chemical sensitization after grain formation, or after chemical sensitization.

The reduction sensitization may be carried out by any of a method of adding a reduction sensitizer to the silver halide emulsion, a method of growing or ripening the emulsion in a low pAg atmosphere at a pAg of from 1 to 7 called silver ripening and a method of growing or ripening the emulsion in a high pH atmosphere at a pH of from 8 to 11 called high pH ripening. Two or more of the above-described methods may also be used in combination.

The method of adding a reduction sensitizer is preferred because the reduction sensitization level can be delicately controlled.

The reduction sensitizer may be selected from known reduction sensitizers such as a stannous salt, an ascorbic acid and a derivative thereof, amines and polyamines, a hydrazine and a derivative thereof, a formamidinesulfinic acid, a silane compound and a borane compound, and these compounds may be used in combination of two or more. Preferred compounds as the reduction sensitizer are a stannous chloride, an aminoiminomethanesulfinic acid (common name: thiourea dioxide), a dimethylamineborane, an ascorbic acid and a derivative thereof. The addition amount of the reduction sensitizer depends on the preparation condition of the emulsion and must be carefully selected, however, it is suitably from $1\times10^{-7}$ to $1\times10^{-3}$ mol per mol of silver halide.

The chemical sensitization may also be carried out in the presence of a so-called chemical sensitization aid. The useful chemical sensitization aid includes compounds known to suppress the fogging and at the same time, increase the sensitivity during the chemical sensitization, such as azaindene, azapyridazine and azapyrimidine. Examples of the chemical sensitization aid modifier are described in U.S. Pat. Nos. 2,131,038, 3,411,914 and 3,554,757, JP-A-58-126526 and Duffin, *Photographic Emulsion Chemistry* (cited above), pp. 138–143.

An oxidizing agent for silver is preferably used during the production step of the emulsion of the present invention. The oxidizing agent for silver as used herein means a compound capable of acting on a metal silver to convert it into a silver ion. In particular, a compound which converts very fine silver grains by-produced during grain formation and chemical sensitization of silver halide grains into silver ions is useful. The silver ion produced here may be in the form of a difficultly water-soluble silver salt such as silver halide, silver sulfide or silver selenide or in the form of an easily water-soluble silver salt such as silver nitrate. The oxidizing agent for silver may be either an inorganic material or an organic material. Examples of the inorganic oxidizing agent include ozone, a hydrogen peroxide and an adduct thereof (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$), a peroxy acid salt (e.g., $K_2S_2O_8$, $K_2C_2O_6$, $K_2P_2O_8$), a peroxy complex compound (e.g., $K_2[Ti(O_2)C_2O_4].3H_2O$, $4K_2SO_4.Ti(O_2)OH.SO_4.2H_2O$, $Na_3[VO(O_2)(C_2H_4)_2.6H_2O)$, a permanganate (e.g., $KMnO_4$), an oxyacid salt such as a chromate (e.g., $K_2Cr_2O_7$), a halogen element such as iodine and bromine, a perhalogen acid salt (e.g., potassium periodate), a salt of high-valence metal (e.g., potassium hexanocyanoferrate) and a thiosulfonate.

Examples of the organic oxidizing agent include quinones such as p-quinone, organic peroxides such as peracetic acid and perbenzoic acid, and active halogen-releasing compounds (e.g., N-bromosuccinimide, chloramine-T, chloramine-B).

Preferred oxidizing agents of the present invention are an inorganic oxidizing agent such as ozone, a hydrogen peroxide and an adduct thereof, a halogen element and a thiosulfonate and an organic oxidizing agent such as quinones. The oxidizing agent for silver is preferably used in combination with the above-described reduction sensitization. A method where an oxidizing agent is used and then reduction sensitization is conducted, a method reverse thereto or a method where the use of an oxidizing agent and the reduction sensitization concur may be appropriately selected. These methods may be used either at the grain formation step or at the chemical sensitization step.

Various compounds may be incorporated into the photographic emulsion for use in the present invention so as to prevent fogging or to stabilize the photographic capability, during preparation, storage or photographic processing of the light-sensitive material. More specifically, a large number of compounds known as an antifoggant or a stabilizer may be added, for example, thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (in particular, 1-phenyl-5-mercaptotetrazole); mercaptopyrimidines; mercaptotriazines; thioketo compounds such as oxazolinethione; and azaindenes such as triazaindenes, tetrazaindenes (in particular, 4-hydroxy-6-methyl-(1,3,3a,7)tetrazaindenes) and pentazaindenes. For example, those described in U.S. Pat. Nos. 3,954,474 and 3,982,947 and JP-B-52-28660 may be used. One preferred compound is the compound described in Japanese Patent Application No. 62-47225. The antifoggant and the stabilizer each may be added at various stages such as before grain formation, during grain formation, after grain formation, at water washing, at dispersion after water washing, before chemical sensitization, during chemical sensitization, after chemical sensitization or before coating, depending upon the purpose. These compounds are added during the preparation of emulsion so as not only to exhibit antifogging and stabilization effects originally intended but also to work for various purposes such as control of crystal habit of a grain, reduction of grain size, reduction of solubility of a grain, control of chemical sensitization or control of dye orientation.

The photographic emulsion for use in the present invention is preferably spectrally sensitized by a methine dye or others so as to exert the effects of the present invention. Examples of the dye used include a cyanine dye, a merocyanine dye, a composite cyanine dye, a composite merocyanine dye, a holopolar cyanine dye, a hemicyanine dye, a styryl dye and a hemioxonol dye. Among these, particularly useful are dyes belonging to the cyanine dye, the merocyanine dye and the composite merocyanine dye. To these dyes, any nucleus commonly used for cyanine dyes as a basic heterocyclic nucleus can be applied. Examples of the nucleus include pyroline nucleus, oxazoline nucleus, thiazoline nucleus, pyrrole nucleus, oxazole nucleus, thiazole nucleus, selenazole nucleus, imidazole nucleus, tetrazole nucleus and pyridine nucleus; a nucleus resulting from fusion of an alicyclic hydrocarbon ring to the above-described nuclei; and a nucleus resulting from fusion of an aromatic hydrocarbon ring to the above-described nuclei, e.g., indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus and quinoline nucleus. These nuclei may have a substituent on the carbon atom thereof.

To the merocyanine dye or composite merocyanine dye, a 5- or 6-membered heterocyclic nucleus such as pyrazolin-5-one nucleus, thiohydantoin nucleus, 2-thioxazolidine-2,4-dione nucleus, thiazolidine-2,4-dione nucleus, rhodanine nucleus or thiobarbituric acid nucleus may be applied as a nucleus having a ketomethylene structure.

These sensitizing dyes may be used individually or in combination thereof and the combination of sensitizing dyes is often used for the purpose of supersensitization. Representative examples thereof are described in U.S. Pat. Nos. 2,688,545, 2,977,229, 3,397,060, 3,522,052, 3,527,641, 3,617,293, 3,628,946, 3,666,480, 3,672,898, 3,679,428, 3,703,377, 3,769,301, 3,814,609, 3,837,862 and 4,026,707, British Patents 1,344,281 and 1,507,803, JP-B-43-4936, JP-B-53-12375, JP-A-52-110618 and JP-A-52-109925.

In combination with a sensitizing dye, a dye which by itself does not have a spectral sensitization effect or a material which absorbs substantially no visible light, but exhibits supersensitization may be contained in the emulsion.

The time when the spectral sensitizing dye is added to the emulsion may be any stage hitherto known to be useful during preparation of the emulsion. Most commonly, the dye is added to the emulsion between after the completion of chemical sensitization and before coating, but the dye may be added at the same time with a chemical sensitizer to effect spectral sensitization and chemical sensitization simultaneously as described in U.S. Pat. Nos. 3,628,969 and 4,225,666, the dye may be added in advance of chemical sensitization as described in JP-A-58-113928, or the dye may be added before the completion of silver halide grain formation by precipitation to start spectral sensitization. Further, the above-described compound may be added in installments, namely, a part of the compound may be added in advance of chemical sensitization and the remaining may be added after chemical sensitization, as described in U.S. Pat. No. 4,225,666, and the compound may be added at any time during formation of silver halide grains as in the method described in U.S. Pat. No. 4,183,756.

The light-sensitive material of the present invention uses various additives as described above but other than those, various additives may be used according to the purpose.

These additives are described in more detail in *Research Disclosure*, Item 17643 (December, 1978), ibid., Item 18716 (November, 1979) and ibid., No. 307105 (November, 1989), and the pertinent portions thereof are summarized in the table below.

TABLE 1

| Kinds of Additives | RD17643 | RD18716 | RD307105 |
|---|---|---|---|
| 1. Chemical sensitizer | p. 23 | p. 648, right col. | p. 996 |
| 2. Sensitivity increasing agent | | p. 648, right col. | |
| 3. Spectral sensitizer, supersensitizer | pp. 23–24 | p. 648, right col.-p. 649, right col. | p. 996, right col.-p. 998, right col. |
| 4. Brightening agent | p. 24 | | p. 998, right col. |
| 5. Antifoggant, stabilizer | pp. 24–25 | p. 649, right col. | p. 998, right col.-p. 1,000, right col. |
| 6. Light absorbent, filter dye, UV absorbent | pp. 25–26 | p. 649. right col.-p. 650, left col. | p. 1,003, left col.-p. 1,003, right col. |
| 7. Stain inhibitor | p. 25, right col. | p. 650, left to right cols. | |
| 8. Dye image stabilizer | p. 25 | | |
| 9. Hardening agent | p. 26 | p. 651, left col. | p. 1,004, right col.-p. 1,005, left col. |
| 10. Binder | p. 26 | p. 651, left col. | p. 1,003, right col.-p. 1,004, right col. |
| 11. Plasticizer, lubricant | p. 27 | p. 650, right col. | p. 1,006, left col.-p. 1,006, right col. |
| 12. Coating aid, surface active agent | pp. 26–27 | p. 650, right col. | p. 1,005, left col.-p. 1,006, left col. |
| 13. Antistatic agent | p. 27 | p. 650, right col. | p. 1006, right col.-p. 1,007, left col. |

The light-sensitive material of the present invention is suitable for forming an image by the development intensification process using a light-sensitive material having a low silver amount and accordingly, silver chloride, silver chlorobromide or silver chloroiodobromide having a silver chloride content of 95% or more is preferably used. In particular, since the iodide ion is subjected to silver catalyst poisoning upon image intensification by the hydrogen peroxide in the present invention, silver chlorobromide or silver chloride containing substantially no silver iodide is preferably used. The term "containing substantially no silver iodide" as used herein means that the silver iodide content is 1 mol % or less, preferably 0.2 mol % or less.

The coated silver amount as a total of silver amounts in all coated layers (e.g., three kinds of silver halide emulsion layers sensitive to blue, green and red, respectively) of the light-sensitive material of the present invention is in terms of silver, from 0.003 to 0.3 g/m$^2$, preferably 0.01 to 0.10 g/m$^2$, more preferably from 0.015 to 0.050 g/m$^2$. The coated silver amount in each layer is from 0.001 to 0.1 g, preferably from 0.003 to 0.03 g, per one light-sensitive layer. In the present invention, in order to obtain a sufficiently high image density, the coated silver amount of each light-sensitive layer is preferably 0.001 g/m$^2$ or more and in order to prevent the increase in Dmin or the generation of bubbles, it is preferably 0.1 g/m$^2$ or less.

In particular, as a red-sensitive spectral sensitizing dye for a silver halide emulsion grain having a high silver chloride content, the spectral sensitizing dyes described in JP-A-3-123340 are very preferred in view of the stability, the adsorption strength and the temperature dependency of exposure.

In the light-sensitive material of the present invention, for achieving efficient spectral sensitization in the infrared region, sensitizing dyes described in JP-A-3-15049, from page 12, left upper column to page 21, left lower column, JP-A-3-20730, from page 4, left lower column to page 15, left lower column, European Patent 0420011, from page 4, line 21 to page 6, line 54, European Patent 0420012, from page 4, line 12 to page 10, line 33, European Patent 0443466 and U.S. Pat. No. 4,975,362 are preferably used.

In incorporating the spectral sensitizing dye into the silver halide emulsion, it may be dispersed directly in the emulsion or may be added to the emulsion after dissolving it in a single or mixed solvent of solvents such as water, methanol, ethanol, propanol, methyl cellosolve and 2,2,3,3-tetrafluoropropanol. Also, the spectral sensitizing dye may be added to the emulsion after forming it into an aqueous solution in the presence of an acid or a base together as described in JP-B-44-23389 and JP-B-44-27555, or after forming it into an aqueous solution or a colloid dispersion in the presence of a surface active agent together as described in U.S. Pat. Nos. 3,822,135 and 4,006,025. Further, the spectral sensitizing dye may be added after dissolving it in a solvent substantially immiscible with water such as phenoxyethanol, and then dispersing the solution in water or a hydrophilic colloid. Furthermore, a dispersion resulting from direct dispersion of the spectral sensitizing dye in a hydrophilic colloid may be added to the emulsion as described in JP-A-53-102733 and JP-A-58-105141. The addition time to the emulsion may be any stage conventionally known to be useful in the preparation of emulsion. More specifically, the spectral sensitizing dye may be added before grain formation of the silver halide emulsion, during grain formation of the emulsion, between immediately after grain formation and before entering in water washing of the emulsion, before chemical sensitization of the emulsion, during chemical sensitization of the emulsion, between immediately after chemical sensitization and until cool-solidification of the emulsion, or at the preparation stage of processing solutions. Most commonly, the spectral sensitizing dye is added in the time period between after the completion of chemical sensitization and before coating, but the dye may be added at the same time with the chemical sensitizer to effect spectral sensitization and chemical sensitization simultaneously as described in U.S. Pat. Nos. 3,628,969 and 4,225,666, the dye may be added in advance of chemical sensitization as described in JP-A-58-113928, or the dye may be added before the completion of silver halide grain formation by precipitation to start spectral sensitization as described in JP-A-58-113928. Further, the dye may be added in installments, namely, a part may be added in advance of chemical sensitization and the remaining may be added after chemical sensitization, as described in U.S. Pat. No. 4,225,666, thus the dye may be added at any time during formation of silver halide grains as in the method described in U.S. Pat. No. 4,183,756. Among these, the sensitizing dye is preferably added before water washing of the emulsion or before chemical sensitization of the emulsion.

The addition amount of the spectral sensitizing dye varies over a wide range depending on the case, however, it is preferably from $0.5\times10^{-6}$ to $1.0\times10^{-2}$ mol, more preferably from $1.0\times10^{-6}$ to $5.0\times10^{-3}$ mol, per mole of silver halide.

In the present invention, when a sensitizing dye having spectral sensitization sensitivity in the range of from the red region to the infrared region, the compound described in JP-A-2-157749, from page 13, right lower column to page 22, right lower column are preferably used in combination. By using the compound, the storage stability, the processing stability and the supersensitization effect of the light-sensitive material can be peculiarly elevated. Among those compounds, a compound represented by formula (IV), (V) or (VI) of the above-described patent publication is particularly preferably used in combination. The compound is used in an amount of from $0.5\times10^{-5}$ to $5.0\times10^{-2}$ mol, preferably from $5.0\times10^{-5}$ to $5.0\times10^{-3}$ mol, per mol of silver halide and the advantageous use amount is present in the range of from 0.1 to 10,000 times, preferably from 0.5 to 5,000 times, per mol of the sensitizing dye.

The light-sensitive material of the present invention is used in a print system using a normal negative printer and in addition, it is preferably used in digital scan exposure using a monochromatic high density light such as a gas laser, a light emitting diode, a semiconductor laser or a second harmonic generation (SHG) light source as a combination of a semiconductor laser or a solid state laser using a semiconductor laser as an excitation light source with a nonlinear optical crystal. In order to achieve a compact and cheap system, the semiconductor laser or the second harmonic generation (SHG) light source as a combination of a semiconductor laser or a solid state laser with a nonlinear optical crystal is preferably used. In particular, in order to design a compact and cheap apparatus having a long life and high stability, the semiconductor laser is preferably used and at least one of light sources for exposure is preferably a semiconductor laser.

In using the above-described light source for scan exposure, the spectral sensitivity maximum of the light-sensitive material of the present invention can be freely set depending upon the wavelength of the light source for scan exposure used. In the case of an SHG light source obtained by combining a solid state laser using a semiconductor laser as an excitation light source or a semiconductor laser with a nonlinear optical crystal, the oscillation wavelength of the laser can be reduced to a half and therefore, blue light and green light can be obtained. Accordingly, the light-sensitive material can have a spectral sensitivity maximum in normal three regions of blue, green and red. When a semiconductor laser is used as a light source for achieving a cheap, highly stable and compact apparatus, it is preferred that at least two layers have a spectral sensitivity maximum at 670 nm or more. This is because the semiconductor laser of Group III–V series, which is available, cheap and stable, has an emission wavelength region in the region of from red to infrared at present. However, on a laboratory level, oscillations of Group II–VI series semiconductor laser in green and blue regions is confirmed and it can be well expected that if the production technique of semiconductor lasers is developed, the above-described semiconductor laser would be used cheaply and stably. If so, the necessity that at least two layers must have a spectral sensitivity maximum at 670 nm or higher would be diminished.

In the scan exposure, the exposure time of the silver halide in a light-sensitive material is a time period required to expose a certain fine area. The fine area is generally a minimum unit capable of controlling the quantity of light from respective digital data and called a picture element. Accordingly, the exposure time per picture element varies depending on the size of the picture element. The size of the picture element depends on the picture element density which is practically in the range of from 50 to 2,000 dpi. If the exposure time is defined as the time required to expose a picture element in a size such that the picture element density is 400 dpi, the exposure time is preferably $1\times10^{-4}$ second or less, more preferably $1\times10^{-6}$ second or less.

In the present invention, a colored layer capable of decolorization by the processing is used in combination with a water-soluble dye. The colored layer capable of decolorization by the processing may be put into direct contact with the emulsion layer or may be provided in contact with the emulsion layer through an interlayer containing gelatin or a processing color mixing inhibitor such as hydroquinone. The colored layer is preferably provided as an underlayer (on the support side) of an emulsion layer to be colored to the same elementary color as the color of the colored layer. Colored layers corresponding to all elementary colors may be individually provided or a part of such colored layers may be freely selected and provided. Also, a colored layer colored so as to correspond to a plurality of elementary color regions may be provided. With respect to the optical reflection density of the colored layer, the optical density at a wavelength having the highest optical density in the wavelength regions used for exposure (in a visible light region of from 400 to 700 nm in the case of a normal printer exposure and in the wavelength of the scan exposure light source used in the case of scan exposure) is preferably from 0.2 to 3.0, more preferably from 0.5 to 2.5, particularly preferably from 0.8 to 2.0.

In forming a colored layer, conventionally known methods may be used in combination. For example, a method where a dye described in JP-A-2-282244, from page 3, right upper column to page 8, or a dye as described in JP-A-3-7931, from page 3, right upper column to page 11, left lower column is incorporated into a hydrophilic colloid layer in the sate of a solid fine particle dispersion, a method where an anionic dye is mordanted to a cation polymer, a method where a dye is adsorbed to a fine particle, for example, of silver halide to fix it in the layer, or a method of using colloidal sliver as described in JP-A-1-239544 may be used. The method of dispersing fine dye powder in the solid state is described, for example, in JP-A-2-308244, pp. 4–13, where a fine powder dye which is substantially water-insoluble at a pH of 6 or less but substantially water-soluble at a pH of 8 or more is incorporated. The method of mordanting an anionic dye to a cation polymer is described, for example, in JP-A-2-84637, pp. 18–26. The preparation method of colloidal silver as a light absorbent is described in U.S. Pat. Nos. 2,688,601 and 3,459,563. Among these methods, preferred are a method of incorporating a fine powder dye and a method of using colloidal silver.

Gelatin is advantageous as the binder or protective colloid which can be used in the light-sensitive material according to the present invention, but other hydrophilic colloids may be used solely or in combination with gelatin. Preferred gelatin is a low-calcium gelatin having a calcium content of 800 ppm or less, more preferably 200 ppm or less. Further, an antimold as described in JP-A-63-271247 is preferably added for preventing proliferation of various molds or bacteria in the hydrophilic colloidal layer which cause deterioration of an image.

At the time when the light-sensitive material of the present invention is subjected to printer exposure, a band stop filter described in U.S. Pat. No. 4,880,726 is preferably used. By using this filter, color mixing is eliminated and color reproduction is outstandingly improved.

The processing materials and processing method for use in the present invention are described below in detail. In the present invention, the light-sensitive material is processed in an alkali activation bath (cross-oxidation between silver development and reducing agent incorporated), a desilvering bath and a water washing or stabilization bath. Further, after the water washing or stabilization, a processing may be provided for reinforcing color formation such as alkali impartation.

In the present invention, for developing a light-sensitive material, it is processed in an alkali activation bath. The alkali activation bath may contain a part of auxiliary developing agent released from the light-sensitive material at the time of continuous processing. The pH of the alkali activation bath is preferably from 8 to 13, more preferably from 9 to 12.

The alkali activating solution of the present invention may use an antioxidant such as sodium sulfite, potassium sulfite, lithium sulfite, ammonium sulfite, sodium bisulfite, potassium metabisulfite, sodium formaldehyde bisulfite and hydroxylamine sulfate. The use amount of the antioxidant is 0.1 mol/l or less, preferably from 0.001 to 0.02 mol/l. In the case of using a high silver chloride emulsion in the light-sensitive material, the antioxidant is used in an amount of 0.001 mol/l or less, or may not be contained at all.

In the present invention, an organic preservative is preferably contained in place of the above-described hydroxylamine or sulfite ion.

The organic preservative as used herein means an organic compound in general which is added to an alkali activation solution to reduce the deterioration rate of the auxiliary developing agent partly eluted from the light-sensitive material. In other words, it is an organic compound having a function to prevent oxidation of the auxiliary developing agent due to air and in particular, effective organic preservatives are hydroxylamine derivatives (excluding hydroxylamine), hydroxamic acids, hydrazines, phenols, α-hydroxyketones, α-aminoketones, saccharides, monoamines, diamines, polyamines, quaternary ammoniums, nitroxy radicals, alcohols, oximes, diamide compounds and condensed ring-type amines. These are described in JP-A-63-4235, JP-A-63-5341, JP-A-63-30845, JP-A-63-21647, JP-A-63-44655, JP-A-63-46454, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, and JP-B-48-30496. Other preservatives such as various metals described in JP-A-57-44148 and JP-A-57-53749, salicylic acids described in JP-A-59-180588, alkanolamines described in JP-A-54-3532, polyethyleneimines described in JP-A-56-94349 and aromatic polyhydroxy compounds described in U.S. Pat. No. 3,746,544 may be incorporated, if desired. In particular, alkanolamines described in JP-A-4-97355, pp. 631–632 and dialkylhydroxyamines described in ibid., pp. 627–630 are preferably used. Further, it is also preferred to use a dialkylhydroxyamine and/or a hydrazine derivative in combination with an alkanolamine or to use a dialkylhydroxyamine described in European Patent 0530921A1 in combination with α-amino acid represented by glycine.

The use amount of these compounds is preferably from $1\times10^{-3}$ to $5\times10^{-1}$ mol, more preferably from $1\times10^{-2}$ to $2\times10^{-1}$ mol, per l of the alkali activating solution.

In the present invention, the alkali activating solution contains halogen ions such as chlorine ion, bromine ion or iodine ion. Particularly, when a high silver chloride emulsion is used, the solution contains chlorine ions in an amount of preferably from $3.5\times10^{-3}$ to $3.0\times10^{-3}$ mol/l, more preferably from $1\times10^{-2}$ to $2\times10^{-1}$ mol/l, and/or bromine ions in an amount of preferably from $0.5\times10^{-5}$ to $1.0\times10^{-3}$ mol/l, more preferably from $3.0\times10^{-5}$ to $5\times10^{-4}$ mol/l.

The halide may be added directly to the alkali activating solution or may be eluted from the light-sensitive material into the alkali activating solution during the development processing.

When it is added to the alkali activating solution, examples of the source material include sodium salt, potassium salt, ammonium salt, lithium salt, magnesium salt and lithium salt of each halide. When it elutes from the light-sensitive material, the halide is mainly supplied from the silver halide emulsion but it may be supplied from other than the emulsion.

In order to keep the above-described pH, various buffer solutions are preferably used. Examples of the buffer agent include carbonate, phosphate, borate, tetraborate, hydroxybenzoate, glycyl salt, N,N-dimethylglycyl salt, leucine salt, norleucine salt, guanine salt, 3,4-dihydroxyphenylalanine salt, alanine salt, aminobutyrate, 2-amino-2-methyl-1,3-propanediol salt, valine salt, proline salt, trishydroxyaminomethane salt and lysine salt. In particular, carbonate, phosphate, tetraborate and hydroxybenzoate are excellent in the solubility and in the buffer capacity in the high pH region of 9.0 or more, and cause no adverse effect on the photographic properties even when they are added to the developer, thus the use of buffer solution of these are preferred.

Specific examples of the buffer agent include lithium carbonate, sodium carbonate, potassium carbonate, potassium bicarbonate, tripotassium phosphate, trisodium phosphate, dipotassium phosphate, disodium phosphate, potassium borate, sodium borate, sodium tetraborate, potassium tetraborate, sodium o-hydroxybenzoate (sodium salicylate) and sodium 5-sulfo-2-hydroxybenzoate (sodium 5-sulfosalicylate).

The addition amount of the buffer agent to the alkali activating solution is preferably 0.05 mol/l or more, more preferably from 0.1 to 0.4 mol/l.

In addition to the foregoing, the alkali activating solution may contain various chelating agents as a sedimentation inhibitor for calcium or magnesium or for improving stability of the developer. Examples of the chelating agent include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, 1,2-diaminopropanetetraacetic acid, glycol ether diaminetetraacetic acid, ethylenediamine-orthohydroxyphenylacetic acid, 2-phosphonobutane-1,2,4-tricarboxylic acid, 1-hydroxyethylidene-1,1-diphosphonic acid, 1,2-dihydroxybenzene-4,6-disulfonic acid and an alkali metal salt of these. These chelating agents may be used in combination of two or more thereof, if desired.

The addition amount of the chelating agent may suffice if it is an amount sufficiently high to conceal metal ions in the alkali activating solution and it is, for example, approximately from 0.1 to 10 g/l.

In the present invention, a freely selected antifoggant may be added, if desired. The antifoggant includes alkali metal halides such as sodium chloride, potassium bromide and potassium iodide, and nitrogen-containing heterocyclic compounds. Representative examples of the nitrogen-containing heterocyclic compound include benzotriazole, 5-nitrobenzotriazole, 5-methylbenzotriazole, 6-nitrobenzimidazole, 5-nitroisoimidazole, 2-thiazolylbenzimidazole, indazole, hydroxyazaindolizine, adenine, 1-phenyl-5-mercaptotetrazole and a derivative of these.

The addition amount of the nitrogen-containing heterocyclic compound is from $1\times10^{-5}$ to $1\times10^{-2}$ mol/l, preferably from $2.5\times10^{-5}$ to $1\times10^{-3}$ mol/l.

To the alkali activating solution, any freely selected development accelerator may be added, if desired. Examples of the development accelerator include thioether compounds described in JP-B-37-16088, JP-B-37-5987, JP-B-38-7826, JP-B-44-12380, JP-B-45-9019 and U.S. Pat. No. 3,813,247, p-phenylenediamine compounds described in JP-A-52-49829 and JP-A-50-15554, quaternary ammonium salts described in JP-A-50-137726, JP-B-44-30074, JP-A-56-156826 and JP-A-52-43429, amine compounds described in U.S. Pat. Nos. 2,494,903, 3,128,182, 4,230,796 and 3,253,919, JP-B-41-11431, U.S. Pat. Nos. 2,482,546, 2,596,926 and 3,582,346, and polyalkylene oxides described in JP-B-37-16088, JP-B-42-25201, U.S. Pat. No. 3,128,183, JP-B-41-11431, JP-B-42-23883 and U.S. Pat. No. 3,532,501.

The alkali activating solution preferably contains a fluorescent brightening agent. In particular, 4,4'-diamino-2,2'-disulfostilbene-base compounds are preferably used. More specifically, a commercially available fluorescent brightening agent, such as compounds described in *Senshoku Note (Dyeing Note) Ver.* 19, pp. 165–168 and compounds described in JP-A-4-242943, pp. 3–7, may be used. The addition amount of the fluorescent brightening agent is from 0.1 to 10 g/l, preferably from 0.5 to 5 g/l.

The processing temperature of the alkali activating solution for use in the present invention is from 20 to 50° C., preferably from 30 to 45° C. The processing time is from 5 seconds to 2 minutes, preferably from 10 seconds to 1 minute. The replenishing amount is preferably lower but it is usually from 15 to 600 ml, preferably from 25 to 200 ml, more preferably from 35 to 100 ml, per $m^2$ of the light-sensitive material.

The development is followed by desilvering. The desilvering may comprise fixing or may comprise bleaching and fixing. When it comprises bleaching and fixing, the bleaching and the fixing may be conducted separately or may be conducted simultaneously (bleach-fixing). Further, a processing in a bleach-fixing bath consisting of two continuous tanks, a fixing processing before bleach-fixing or a bleaching processing after bleach-fixing may be freely selected depending upon the purpose.

In some cases, it is preferred to conduct stabilization after development without effecting desilvering to stabilize the silver salt or the dye image.

Also, an image reinforcing processing (intensification) may be conducted after development, using peroxides, halogenous acids, iodoso compounds and cobalt(III) complex compounds described in West German Patents (OLS) 1,813,920, 2,044,993 and 2,735,262, JP-A-48-9728, JP-A-49-84240, JP-A-49-102314, JP-A-51-53826, JP-A-52-13336 and JP-A-52-73731. In order to further intensify the image reinforcement, the above-described oxidizing agent for image reinforcement may be added to the developer to effect the development and the image intensification at the same time in a single bath. In particular, hydrogen peroxide is preferred because of its high amplification factor. The above-described image intensification method is a preferred processing method in view of environmental conservation because the silver amount of the light-sensitive material can be greatly reduced to dispense with bleaching and at the same time, to involves no discharge of silver (or silver salt) at the stabilization.

Examples of the bleaching agent for use in the bleaching solution or the bleach-fixing solution include compounds of a polyvalent metal such as iron(III), cobalt(III), chromium (III) and copper(II), peracids, quinones and nitro compounds. Representative examples of the bleaching agent include iron chloride, ferricyanic compounds, bichromate, organic complex salts of iron(III) (e.g., metal salts with ethylenediaminetetraacetic acid, diethylenetriaminepentaacetic acid, cyclohexanediaminetetraacetic acid, 1,3-diaminopropanetetraacetic acid, methyliminodiacetic acid or an aminopolycarboxylic acid described in JP-A-4-365036, pp. 5–17), persulfate, permanganate, bromate, hydrogen peroxide and its release compounds (e.g., percarbonic acid, perboric acid), and nitrobenzenes. Among these, an aminopolycarboxylic acid ferrate including an ethylenediaminetetraacetato ferrate complex salt and 1,3-diaminopropanetetraacetato ferrate complex salt, hydrogen peroxide and persulfate are preferred in view of rapid processing and prevention of environmental pollution.

The bleaching solution or the bleach-fixing solution using the aminopolycarboxylic acid ferrate complex salt is used at a pH of from 3 to 8, preferably from 5 to 7. The bleaching solution using persulfate or hydrogen peroxide is used at a ph of from 4 to 11, preferably from 5 to 10.

A bleaching accelerator may be used, if desired, in the bleaching solution, the bleach-fixing solution or a prebath thereof. Specific examples of useful bleaching accelerators include compounds having a mercapto group or a disulfide bond described in U.S. Pat. No. 3,893,856, German Patent 1,290,812, JP-A-53-95630 and *Research Disclosure* No. 17129 (July, 1978); thiazolidine derivatives described in JP-A-50-140129; thiourea derivatives described in U.S. Pat. No. 3,706,561; iodide salts described in JP-A-58-16235; polyoxyethylene compounds described in German Patent 2,748,430; polyamine compounds described in JP-B-45-8836; and bromide ions.

Among these, compounds having a mercapto group or a disulfide group are preferred because of a large acceleration effect. In particular, these bleaching accelerators are effective in desilvering a color light-sensitive material for photographing.

As the accelerator of persulfate bleaching, a complex salt of an iron(III) ion with a 2-pyridinecarboxylic acid or 2,6-pyridinedicarboxylic acid described in JP-A-6-214365 (corresponding to European Patent 0602600A1) is effective. Further, as the accelerator of hydrogen peroxide bleaching, a metal complex salt of organic acids described in JP-B-61-16067 and JP-B-61-19024 is effective.

The bleaching solution, the bleach-fixing solution or the fixing solution may contain known additives, for example, a rehalogenation agent such as ammonium bromide or ammonium chloride; a pH buffer such as ammonium nitrate, acetic acid, boric acid, citric acid and its salt, tartaric acid and its salt, succinic acid and its salt and imidazole; and an anticorrosive for metal such as ammonium sulfate. In particular, the bleaching solution, bleach-fixing solution or the fixing solution preferably contains an organic acid to prevent bleaching stains. The organic acid is a compound having an acid dissociation constant (pKa) of from 2 to 7 and specifically, an acetic acid, a succinic acid, a citric acid and a propionic acid are preferred.

Examples of the fixing agent for use in the fixing solution or in the bleach-fixing solution include thiosulfates, thiocyanates, thioureas, a large quantity of iodide salts and nitrogen-containing heterocyclic compounds, mesoionic compounds and thioether-base compounds described in JP-A-4-365037, pp. 11–21, JP-A-5-66540, pp. 1088–1092. Among these, thiosulfates are usually used and ammonium thiosulfate is most widely used. A combination use of a thiosulfate with a thiocyanate, a thioether compound, a thiourea or a mesoionic compound is also preferred.

Preferred examples of the preservative for the fixing solution or the bleach-fixing solution include sulfites, bisulfites, carbonyl bisulfite adducts and sulfinic acid compounds described in European Patent 294769A. Further, the fixing solution, the bleaching solution or the bleach-fixing solution preferably contains various aminopolycarboxylic acids, organic phosphonic acids (e.g., 1-hydroxyethylidene-1,1-diphosphonic acid, N,N,N',N'-ethylenediaminetetraphosphonic acid, 2-phosphonobutane-1,2,4-tricarboxylic acid) or sodium stannate for the purpose of stabilization of the solution.

Furthermore, the fixing solution or the bleach-fixing solution may contain various fluorescent brightening agents, defoaming agents, surface active agents, polyvinylpyrrolidones or methanols.

The processing temperature in the desilvering is from 20 to 50° C., preferably from 30 to 45° C. The processing time is from 5 seconds to 2 minutes, preferably from 10 seconds to 1 minute. The replenishing amount is preferably lower, but it is usually from 15 to 600 ml, preferably from 25 to 200 ml, more preferably from 35 to 100 ml, per $m^2$ of the light-sensitive material. A processing free of replenishment but only with compensation for the evaporation loss by water is also preferred.

The light-sensitive material of the present invention is usually subjected to water washing after desilvering. When stabilization is effected, the water washing may be omitted. In such a stabilization processing, any of known methods described in JP-A-57-8543, JP-A-58-14834, JP-A-60-220345, JP-A-58-127926, JP-A-58-127837 and JP-A-58-140741 can be used. Water washing-stabilization as represented by the processing of a color light-sensitive material for photographing may also be conducted, where the stabilization bath containing a dye stabilizer and a surface active agent is used as the final bath.

The water-washing solution and the stabilizing solution may contain a sulfite; a hard water softening agent such as inorganic phosphoric acid, polyaminocarboxylic acid and organic aminophosphonic acid; a metal salt such as Mg salt, Al salt and Bi salt; a surface active agent; a hardening agent; a pH buffer; a fluorescent brightening agent; and a silver salt forming agent such as nitrogen-containing heterocyclic compound.

Examples of the dye stabilizer for the stabilizing solution include aldehydes such as formalin and glutaraldehyde, N-methylol compounds, hexamethylenetetramine and aldehyde-sulfurous acid adducts.

The pH of the water washing or stabilizing solution is from 4 to 9, preferably from 5 to 8. The processing temperature is from 15 to 45° C., preferably from 25 to 40° C. The processing time is from 5 seconds to 2 minutes, preferably from 10 to 40 seconds.

The overflow solution accompanying the replenishment of the above-described washing water and/or stabilizing solution can be re-used in other steps such as desilvering.

The amount of washing water and/or stabilizing solution may be set over a wide range depending upon various conditions but the replenishing amount is preferably from 15 to 360 ml, more preferably from 25 to 120 ml, per $m^2$ of the light-sensitive material. In order to reduce the replenishing water amount, it is preferred to use a plurality of tanks in a countercurrent system. The number of tanks is preferably from 2 to 5. In order to prevent the proliferation of bacteria or adherence of floats generated to the light-sensitive material, which takes place when the amount of replenishing water is reduced, isothiazolone compounds and thiabendazoles described in JP-A-57-8542, bactericides such as chlorinated sodium isocyanurate, or bactericides such as benzotriazole described in Hiroshi Horigushi, *Bokin, Bobai-Zai no Kagaku* (Sankyo Shuppan, 1986), *Biseibutsu no Mekkin, Sakkin, Bobai-Gijutsu* compiled by Eisei Gijutsu Kai (Kogyo Gijutsu Kai, 1982), and *Bokin-Bobai Zai Jiten* compiled by Nippon Bokin Bobai Gakkai (1986) may be used. Also, a method of reducing the Mg or Ca ions described in JP-A-62-288838 can be preferably used.

In the present invention, water resulting from treating the overflow solution or solution inside tanks with a reverse osmosis membrane may be used for saving water. For example, the treatment with a reverse osmosis membrane is preferably applied to water in the second or subsequent tanks for water washing and/or stabilization in a multi-stage countercurrent system. More specifically, in the case of two-tank structure, water in the second tank, and in the case of four-tank structure, water in the third or fourth tank is treated with a reverse osmosis membrane and the penetrated water is returned to the same tank (the tank where water is sampled for the reverse osmosis membrane treatment) or to the water washing and/or stabilization tank subsequent thereto. The thickened solution may be, as one countermeasure, returned to the tanks positioned upstream of the above-described same tank and then to the desilvering bath.

The material for the reverse osmosis membrane includes cellulose acetate, crosslinked polyamide, polyether, polysulfone, polyacrylic acid or polyvinylene carbonate.

The pressure necessary to send the solution in using the membrane is preferably from 2 to 10 kg/cm$^2$, more preferably from 3 to 7 kg/cm$^2$.

In the present invention, the stirring is preferably intensified as highly as possible. Specific examples of the method for intensifying stirring include a method of colliding a jet stream of a processing solution against the emulsion surface of the light-sensitive material described in JP-A-62-183460 and JP-A-62-183461, a method of increasing the stirring effect by using a rotary means described in JP-A-62-183461, a method of increasing the stirring effect by causing turbulence on the emulsion surface while moving the light-sensitive material with the emulsion surface being brought into contact with a wire blade provided in the solution, and a method of increasing the circulative flow rate of the entire processing solutions. Such a means for intensifying the stirring is effective in any of the developer, the bleaching solution, the fixing solution, the bleach-fixing solution, the stabilizing solution and the washing water. These methods are advantageous in that the supply of effective components in the solution to the light-sensitive material or the diffusion of unnecessary components of the light-sensitive material is accelerated.

The present invention can exhibit superior capabilities whatever state the solution open ratio [contact area with air (cm$^2$)/solution volume (cm$^3$)] of any bath is in, however, in view of stability of solution components, the solution open ratio is preferably from 0 to 0.1 cm$^{-1}$ and in the case of a continuous processing, it is in practice preferably from 0.001 to 0.05 cm$^{-1}$, more preferably from 0.002 to 0.03 cm$^{-1}$.

The automatic developing machine used for the light-sensitive material of the present invention preferably comprises a transportation means of a light-sensitive material described in JP-A-60-191257, JP-A-60-191258 and JP-A-60-191259. The transportation means can extremely decrease the amount of a processing solution carried over from a previous bath to a post bath and provides a great effect in preventing the deterioration in capability of the processing solution. Such an effect is particularly useful in reducing the processing time or decreasing the replenishing amount of the processing solution, in each step. Further, in order to reduce the processing time, the crossover time (airing time) is preferably shortened and, for example, a method described in JP-A-4-86659, FIGS. 4, 5 or 6 and JP-A-5-66540, FIGS. 4 or 5 is preferably used, where the solution is transferred between respective processings through blades having a shielding effect.

In the case when each processing solution is concentrated due to evaporation, it is preferred to correct the concentration by adding water.

The processing time in a step as used in the present invention means the time period spent between the initiation of processing of a light-sensitive material in a certain step and the initiation of processing in the next step. The practical processing time in an automatic developing machine is usually determined by the linear velocity and the volume of a processing bath, and in the present invention, the linear velocity is from 500 to 4,000 mm/min. as a standard. In the case of a small-size developing machine, the linear velocity is preferably from 500 to 2,500 mm/min.

The total processing time, in other words, the processing time from development to drying is preferably 360 seconds or less, more preferably 120 seconds or less, particularly preferably from 30 to 90 seconds. The processing time as used herein means the time period since the light-sensitive material is dipped in a developer until it comes out from the drying zone of a processor.

The present invention will be described in greater detail with reference to the following examples but the present invention should not be construed as being limited thereto.

EXAMPLE 1

Preparation of Light-Sensitive Material

The surface of a paper support having laminated on both surfaces thereof with polyethylene was subjected to corona discharge treatment, an undercoat layer of a gelatin layer containing sodium dodecylbenzenesulfonate was provided thereon and various photographic constituent layers were coated thereon to prepare a multi-layer color printing paper having a layer structure as described below. The printing paper obtained was designated as Sample (100).

The coating solutions were prepared as follows.

Preparation of Coating Solution for First Layer

Coupler (ExC-1) for cyan coloration (22.5 g) and 27.8 g of Reducing Agent (I-7) for color formation were dissolved in 52 g of Solvent (Solv-1) and 73 ml of ethyl acetate, the resulting solution was emulsion-dispersed in 420 ml of a 12% aqueous gelatin solution containing a 10% sodium dodecylbenzenesulfonate and a citric acid to prepare Emulsion A.

Separately, Silver Chlorobromide Emulsion A (cubic, average grain size: 0.18 $\mu$m, silver bromide: 25 mol %) was prepared. To this emulsion, Red-Sensitive Sensitizing Dyes A-1 and A-2 were added. Further, the chemical ripening of this emulsion was conducted by adding a sulfur sensitizer and a gold sensitizer.

Emulsified Dispersion A and Silver Chlorobromide Emulsion A were mixed and dissolved to prepare a coating solution for the first layer having the following composition.

Preparation of Coating Solutions for Second to Seventh Layers

The coating solutions for the second to seventh layers were prepared in the same manner as the coating solution for the first layer.

The above-described coating solutions for respective layers were coated on a support to prepare Sample (100) as a light-sensitive material having a layer structure described later.

To each layer, 1-oxy-3,5-dichloro-s-triazine sodium salt was added as a gelatin hardening agent.

Further, Cpd-4 and Cpd-5 were added to each layer to have the total coverages of 25.0 mg/M$^2$ and 50 mg/m$^2$, respectively.

The silver chlorobromide emulsion in each light-sensitive emulsion layer used the following spectral sensitizing dyes.

TABLE 2

Red-sensitive Emulsion Layer

Sensitizing Dye A-1

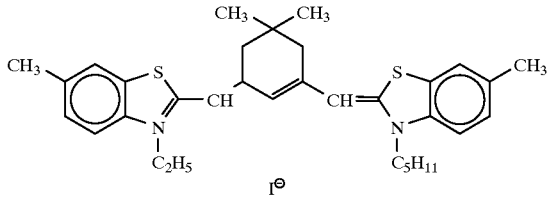

(2.5 × $10^{-4}$ mol per mol of silver halide)

Further, the following compound was added in an amount of $5\times10^{-3}$ mol per mol of silver halide.

A-2

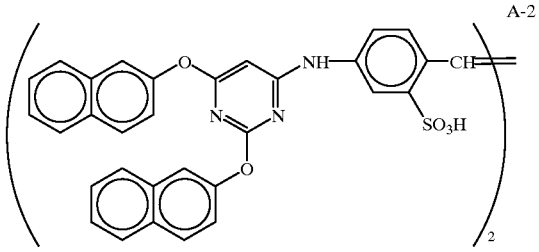

TABLE 3

Green-sensitive Emulsion Layer

Sensitizing Dye B

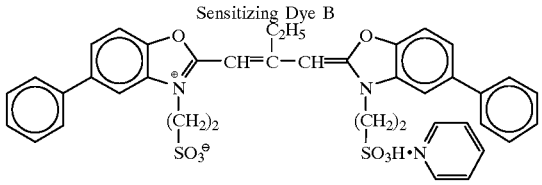

(9.5 × $10^{-4}$ mol per mol of silver halide)

Blue-sensitive Emulsion Layer

Sensitizing Dye C

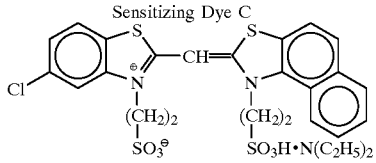

(3.0 × $10^{-4}$ mol per mol of silver halide)

Further, 1-(5-methylureidophenyl)-5-mercaptotetrazole was added to the red-sensitive emulsion layer, the green-sensitive emulsion layer and the blue-sensitive emulsion layer in an amount of $3.0\times1.0^{-4}$ mol, $2.0\times10^{-4}$ mol and $8.0\times10^{-4}$ mol, respectively, per mol of silver halide.

Furthermore, 4-hydroxy-6-methyl-1,3,3a,7-tetrazaindene was added to the blue-sensitive emulsion layer and the green-sensitive emulsion layer in an amount of $1\times10^{-4}$ mol and $2\times10^{-4}$ mol, respectively, per mol of silver halide.

Still further, the following dyes (the numerals in the parentheses show the coated amount) were added to the emulsion layers so as to prevent irradiation.

Irradiation Preventing Dyes (10 mg/$m^2$)

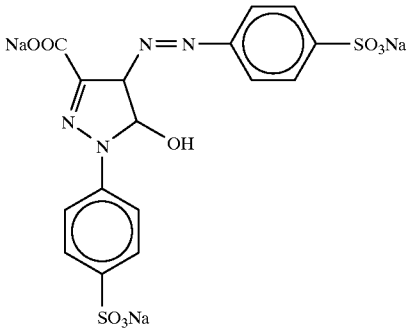

(10 mg/$m^2$)

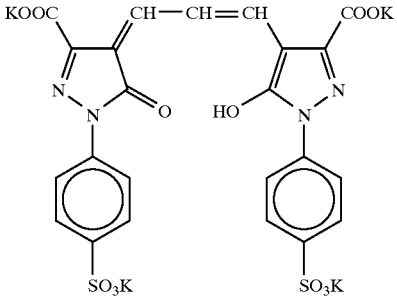

-continued (40 mg/m$^2$)

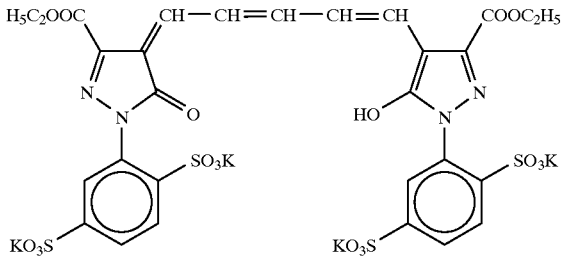

and (20 mg/m$^2$)

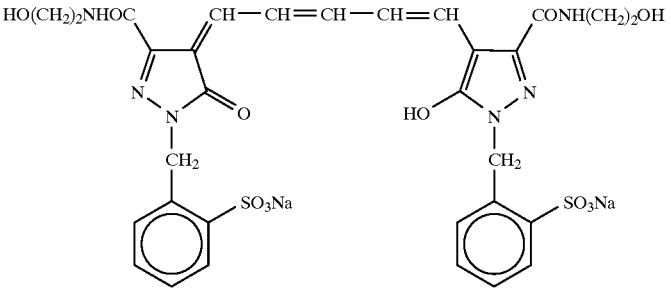

(Layer Structure)

The composition of each layer is shown below, The numerals show the coated amount (g/m$^2$). In the case of silver halide emulsion, it is a coated amount in terms of silver.

TABLE 4

| | |
|---|---|
| Support | |
| Polyethylene laminated paper [Polyethylene on the first layer side contains a white pigment ($TiO_2$) and a bluish dye (ultramarine).] | |
| First Layer (Red-sensitive Emulsion Layer) | |
| Silver Chlorobromide Emulsion A described above | 0.20 |
| Gelatin | 1.18 |
| Cyan Coupler (ExC-1) | 0.19 |
| Reducing Agent (I-7) for color formation | 0.20 |
| Solvent (Solv-1) | 0.78 |
| Second Layer (Color Mixing Preventing Layer) | |
| Gelatin | 1.00 |
| Color Mixing Inhibitor (Cpd-1) | 0.08 |
| Solvent (Solv-1) | 0.25 |
| Solvent (Solv-2) | 0.15 |
| Solvent (Solv-3) | 0.13 |
| Third Layer (Green-sensitive Emulsion Layer) | |
| Silver chlorobromide emulsion (cubic; average grain size: 0.12 μm; silver bromide: 25 mol %) | 0.20 |
| Gelatin | 1.25 |
| Magenta Coupler (ExM-1) | 0.26 |
| Reducing Agent (I-7) for color formation | 0.22 |
| Solvent (Solv-4) | 0.78 |

TABLE 5

| | |
|---|---|
| Fourth Layer (Color Mixing Preventing Layer) | |
| Gelatin | 1.00 |
| Color Mixing Inhibitor (Cpd-1) | 0.08 |
| Solvent (Solv-1) | 0.25 |
| Solvent (Solv-2) | 0.15 |
| Solvent (Solv-3) | 0.13 |
| Fifth Layer (Blue-sensitive Emulsion Layer) | |
| Silver chlorobromide emulsion (cubic; average grain size: 0.41 μm; silver bromide: 0.3 mol %) | 0.015 |
| Gelatin | 1.26 |
| Yellow Coupler (ExY-1) | 0.29 |
| Reducing Agent (I-7) for color formation | 0.24 |
| Solvent (Solv-1) | 0.78 |
| Sixth Layer (Ultraviolet Absorbing Layer) | |
| Gelatin | 0.60 |
| Ultraviolet Absorbent (UV-1) | 0.57 |
| Dye Image Stabilizer (Cpd-2) | 0.06 |
| Solvent (Solv-1) | 0.05 |
| Seventh Layer (Protective Layer) | |
| Gelatin | 1.00 |
| Acryl-modified polymer of polyvinyl alcohol (modification degree: 17%) | 0.05 |
| Liquid paraffin | 0.02 |
| Surface Active Agent (Cpd-3) | 0.01 |

Yellow Coupler (ExY-1)

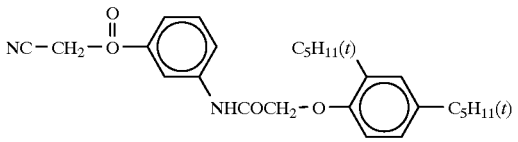

Magenta Coupler (ExM-1)
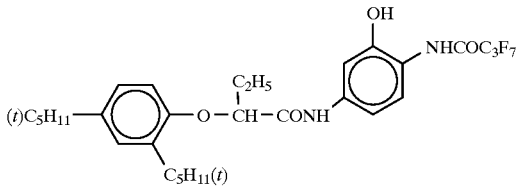
Cyan Coupler (ExC-1)
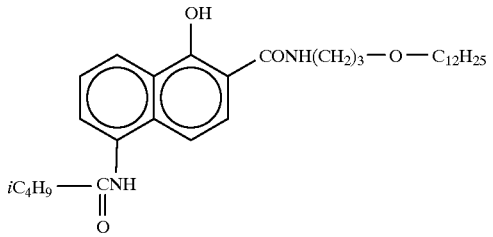
Solvent (Solv-1)
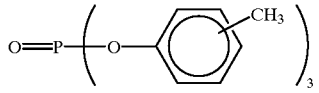
Solvent (Solv-2)
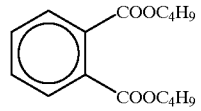
Solvent (Solv-3)
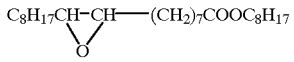
Solvent (Solv-4)
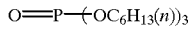
Color Mixing Inhibitor (Cpd-1)
A 1:1:1 mixture (by weight) of:
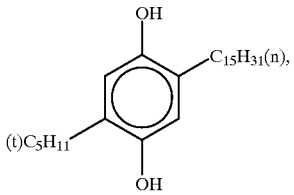
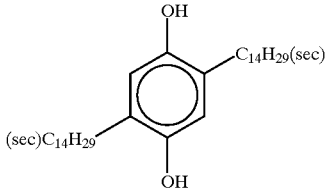
-continued
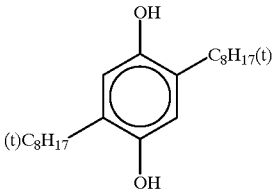
Dye Image Stabilizer (Cpd-2)
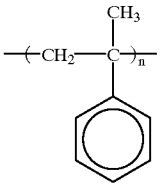
Number average molecular weight: 600
Surface Active Agent (Cpd-3)
A 2:1:1 mixture (by weight) of:
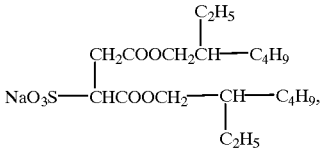
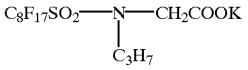
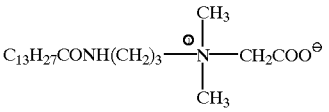
Antiseptic (Cpd-4)
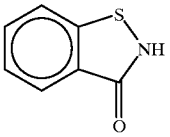
Antiseptic (Cpd-5)
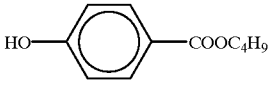

Ultraviolet Absorbent (UV-1)

A 1:2:2:3:1 mixture (by weight) of:

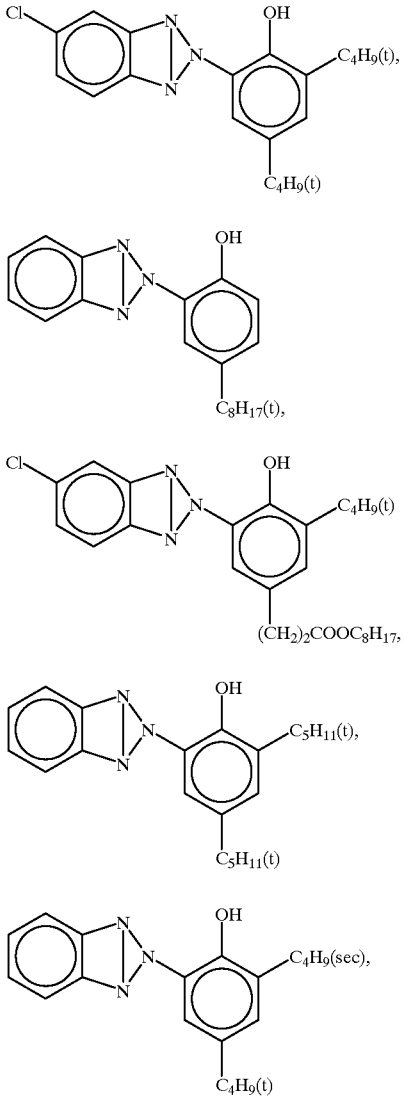

Samples (101) and (102) were prepared thoroughly in the same manner as Sample (100) except that Auxiliary Developing Agent (ETA-1) as a methanol solution or Auxiliary Developing Agent (ETA-19) in the state of fine particle solid dispersion was added to the interlayers of the second layer and the fourth layer each in an amount of $1.4\times10^{-4}$ mol/$m^2$. The thus-prepared samples each was cut and subjected to gradation exposure through a three-color separation filter for sensitometry using a sensitometry (Model FW, manufactured by Fuji Photo Film Co., Ltd.; color temperature of light source: 3200° K.).

After the completion of exposure, samples were continuously processed using the following processing steps and processing solution compositions until the replenishment reached the tank volume of the developer.

| Processing Step | Temperature (° C.) | Replenishing Amount* (ml) | Time (sec.) | Tank volume (l) |
|---|---|---|---|---|
| Development | 40 | 30 | 20 | 1.0 |
| Bleach-fixing | 40 | 30 | 15 | 1.0 |
| Rinsing (1) | 30 | — | 3 | 0.3 |
| Rinsing (2) | 30 | — | 3 | 0.3 |
| Rinsing (3) | 30 | — | 3 | 0.3 |
| Rinsing (4) | 30 | — | 3 | 0.3 |
| Rinsing (5) | 30 | 60 | 3 | 0.3 |
| Alkali treatment | 30 | 30 | 5 | 0.3 |
| Drying | 80 | | 10 | |

(*Replenishing amount per $m^2$ of the light-sensitive material)
(A countercurrent system from Rinsing (5) → (1) was used.)

In the above-described processing, water in Rinsing (4) was sent under pressure to the reverse osmosis membrane and water transmitted was supplied to Rinsing (5) and the concentrated water barred from the transmission was returned to Rinsing (4). In order to reduce the cross-over time between respective rinsings, water was passed through blades provided between tanks.

Sample (100) was developed using Developer-1 and Samples (101) and (102) were developed using Developer-2 (alkali activating solution).

| Developer-1 | Tank Solution | Replenisher |
|---|---|---|
| Water | 800 ml | 800 ml |
| Trisodium phosphate | 30 g | 39 g |
| 5-Nitrobenzotriazole | 0.1 g | 0.25 g |
| Disodium-N,N-bis(sulfonatoethyl)-hydroxylamine | 3.3 g | 6.6 g |
| Potassium chloride | 10 g | — |
| Hydroxyethylidene-1,1-diphosphonic acid (30% solution) | 4 ml | 4 ml |
| 1-Phenyl-4-methyl-4-hydroxymethyl-3-pyrazolidone | 1.5 g | — |
| Water to make | 1 l | |
| pH | 12.0 | |

Developer-2 (alkali activating solution)

A solution resulting from the elimination of an auxiliary developing agent (i.e., 1-phenyl-4-methyl-4-hydroxymethyl-3-pyrazolidone) from Developer-1 was used.

| Bleach-fixing Solution | Tank Solution | Replenisher |
|---|---|---|
| Water | 600 ml | 150 ml |
| Ammonium thiosulfate (700 g/l) | 100 ml | 250 ml |
| Ammonium sulfite monohydrate | 40 g | 40 g |
| Ammonium ethylenedimaminetetra-acetato ferrate | 77 g | 154 g |
| Ethylenediaminetetraacetic acid | 5 g | 10 g |
| Ammonium bromide | 10 g | 20 g |
| Acetic acid (50%) | 70 ml | 140 ml |
| Water to make | 1,000 ml | 1,000 ml |

| Alkali Solution | | |
|---|---|---|
| Potassium carbonate | 30.0 | g |
| Water to make | 1 | l |
| pH | 10.0 | |

After continuous processing under respective conditions, image densities of yellow, magenta and cyan were determined through a B, G, R filter corresponding to respective dyes and the minimum density (Dmin) and the maximum density (Dmin) of each image was determined. At the same time, the magenta image part was measured through a B, R filter and the mixing degree of yellow and cyan colors formed above and below the magenta color forming layer was evaluated. The results are shown in Table 6.

The color mixing was shown by the density of each color at the exposure site where the magenta density was 1.0.

TABLE 6

| | Sample | Developer | Cyan Density | | Magenta Density | | Yellow Density | | Color Mixing | | |
|---|---|---|---|---|---|---|---|---|---|---|---|
| No. | No. | No. | Dmax | Dmin | Dmax | Dmin | Dmax | Dmin | Yellow | Cyan | |
| 1-1 | (100) | 1 | 1.85 | 0.15 | 2.20 | 0.15 | 2.12 | 0.16 | 0.61 | 0.25 | Comparison |
| 1-2 | (101) | 2 | 1.93 | 0.13 | 2.25 | 0.13 | 2.22 | 0.13 | 0.51 | 0.19 | Invention |
| 1-3 | (102) | 2 | 1.99 | 0.12 | 2.32 | 0.12 | 2.33 | 0.12 | 0.42 | 0.16 | Invention |

As a result, it is found that when Sample (101) or (102) where Compound ETA-1 or ETA-19 was added to the light-sensitive material, was processed in an alkali activating bath, an image having a low minimum density and a high maximum density could be obtained. Further, the color mixing was small and the image was sharp.

EXAMPLE 2

Sample (201) was prepared thoroughly in the same manner as Sample (102) in Example 1 except for changing the coated silver amount in the first, third and fifth layers to 0.01 g/m$^2$, 0.01 g/m$^2$ and 0.015 g/m$^2$, respectively.

Sample (201) was subjected to the exposure in the same manner as in Example 1 and then processed with an intensifier of a 0.3% aqueous solution of hydrogen peroxide having a pH of 12.0 obtained by adding hydrogen peroxide to Developer-2. As a result, even when a light-sensitive material greatly reduced in the silver amount was used, an image having a high maximum density the same as in Example 1 could be obtained. Also, the color mixing was small and the image was sharp.

The above-described intensifier contains no auxiliary developing agent and so, excellent in the solution stability, accordingly, even when a continuous processing at a low replenishment amount was practiced, the image obtained had a constant photographic capability.

Thus, it is found that the light-sensitive material of the present invention is suitable for the method of forming an image amplified by the intensification processing of a low-silver light-sensitive material.

EXAMPLE 3

Samples (301), (302), (303), (304), (305), (306) and (307) were prepared thoroughly in the same manner as Sample (102) in Example 1 except for changing the reducing agent for color formation in the RL layer to Compounds (I-1), (I-3), (I-10), (I-30), (I-31), (I-33) and (I-35), respectively. Each sample was processed using an alkali activating solution (Developer 2) in Example 1 and evaluated in the same manner. The color mixing degree is shown by the G-determination density at the exposure site where the cyan density was 1.0. The results are shown in Table 7.

TABLE 7

| | Sample | Developer | Reducing Agent for Color | Cyan Density | | Color |
|---|---|---|---|---|---|---|
| No. | No. | No. | Formation | Dmax | Dmin | Mixing |
| 3-1 | (301) | 2 | I-1 | 1.98 | 0.12 | 0.17 |
| 3-2 | (302) | 2 | I-3 | 1.97 | 0.12 | 0.17 |
| 3-3 | (303) | 2 | I-10 | 1.99 | 0.12 | 0.18 |
| 3-4 | (304) | 2 | I-30 | 2.07 | 0.13 | 0.18 |
| 3-5 | (305) | 2 | I-31 | 2.06 | 0.13 | 0.18 |
| 3-6 | (306) | 2 | I-33 | 2.08 | 0.13 | 0.19 |
| 3-7 | (307) | 2 | I-35 | 2.03 | 0.12 | 0.18 |

As a result, an image having a low minimum density and a high maximum density and low in the color mixing degree could be obtained the same as the case using the reducing agent of Example 1.

EXAMPLE 4

Preparation of Light-Sensitive Material

A multi-layer color printing paper having the following layer structure on the same support as in Example 1 was prepared. This paper was designated as Sample (400).

The coating solutions were prepared as follows.

Preparation of Coating Solution for First Layer

Coupler (ExY-2) for yellow coloration (27.8 g) and 20.5 g of Reducing Agent (I-49) for color formation were dissolved in 52 g of Solvent (Solv-1) and 73 ml of ethyl acetate. The resulting solution was emulsion dispersed in 420 ml of a 12% aqueous gelatin solution containing a 10% sodium dodecylbenzenesulfonate and a citric acid to prepare Emulsified Product D.

Separately, Silver Chlorobromide Emulsion D (cubic; a 3:7 (molar ratio as silver) mixture of a large-size emulsion having an average grain size of 0.88 $\mu$m and a small-size emulsion having an average grain size of 0.70 $\mu$m, of which coefficients of variation of the grain size distribution were 0.08 and 0.10, respectively; each emulsion containing 0.3 mol % of silver bromide localized on a part of the grain surface with the substrate being silver chloride) was prepared. In Silver Chlorobromide Emulsion D, Blue-sensitive Sensitizing Dyes 1, 2 and 3 shown below were added to the large-size emulsion each in an amount of $1.4\times10^{-4}$ mol per mol of silver and to the small-size emulsion each in an amount of $1.7\times10^{-4}$ mol per mol of silver. Silver Chlorobromide Emulsion D was subjected to chemical ripening by adding a sulfur sensitizer and a gold sensitizer. Emulsified Dispersion D and Silver Chlorobromide Emulsion D were mixed and dissolved to prepare a coating solution for the first layer.

Blue-sensitive Sensitizing Dye

Sensitizing Dye 1

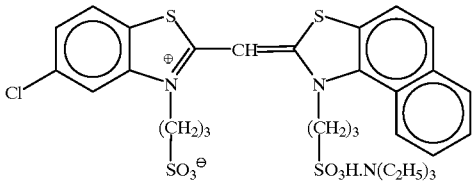

Sensitizing Dye 2

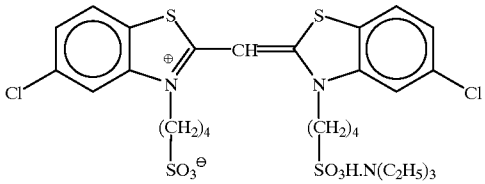

Sensitizing Dye 3

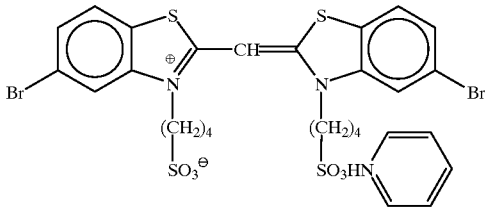

The coating solutions for the third and fifth layers were prepared in the same manner as the coating solution for the first layer. Namely, Silver Chlorobromide Emulsion E for the third layer (cubic; a 1:4 mixture (molar ratio as silver) of a large-size emulsion having an average grain size of 0.50 $\mu$m and a small size emulsion having an average grain size of 0.41 $\mu$m, of which coefficients of variation of the grain size distribution were 0.09 and 0.11, respectively; each emulsion containing 0.8 mol % of silver bromide localized on a part of the grain surface with the substrate being silver chloride) was prepared. To Silver Chlorobromide Emulsion E, Green-sensitive Sensitizing Dye-1 shown below was added to the large size emulsion in an amount of $3.0\times10^{-4}$ mol per mol of silver and to the small-size emulsion in an amount of $3.6\times10^{-4}$ mol per mol of silver, and Green-sensitive Sensitizing Dye-2 shown below was added to the large-size emulsion in an amount of $4.0\times10^{-5}$ mol per mol of silver and to the small-size emulsion in an amount of $7.0\times10^{-5}$ mol per mol of silver. Further, Green-sensitive Sensitizing Dye-3 shown below was added to the large size emulsion in an amount of $2.0\times10^{-4}$ mol per mol of silver and to the small-size emulsion in an amount of $2.8\times10^{-4}$ mol per mol of silver. Silver Chlorobromide Emulsion E and Emulsified Product E prepared in the same manner as Emulsified Product D and containing Coupler (ExM-2) for magenta coloration were mixed and dissolved to prepared a coating solution for the third layer.

Green-sensitive Sensitizing Dye

Sensitizing Dye 1

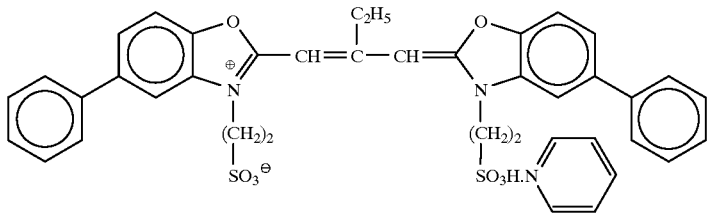

Sensitizing Dye 2

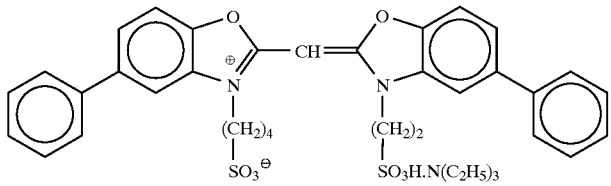

-continued

Sensitizing Dye 3

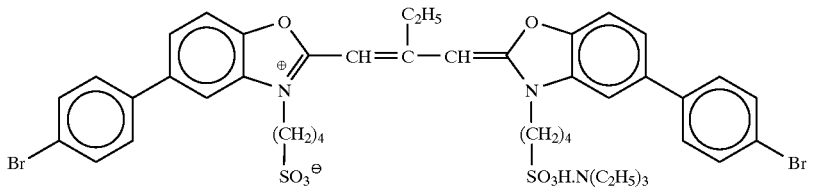

Silver Chlorobromide Emulsion F for the fifth layer (cubic; a 1:4 (molar ratio as silver) of a large-size emulsion having an average grain size of 0.50 μm and a small-size emulsion having an average grain size of 0.41 μm, of which coefficients of variation of the grain size distribution were 0.09 and 0.11, respectively; each emulsion containing 0.8 mol % of silver bromide localized on a part of the grain surface with the substrate being silver chloride) was prepared. In Silver Chlorobromide Emulsion F, Red-sensitive Sensitizing Dye-1 shown below was added to the large-size emulsion in an amount of $5.0\times10^{-5}$ mol per mol of silver and to the small-size emulsion in an amount of $6.0\times10^{-5}$ mol per mol of silver and Red-sensitive Sensitizing Dye-2 was added to the large-size emulsion in an amount of $5.0\times10^{-5}$ mol per mol of silver and to the small-size emulsion in an amount of $6.0\times10^{-5}$ mol per mol of silver.

Red-sensitive Sensitizing Dye

Red-sensitive Sensitizing Dye-1

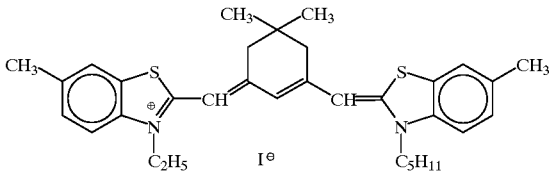

Red-sensitive Sensitizing Dye-2

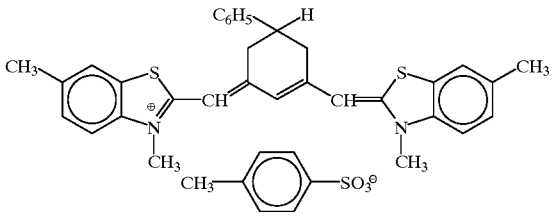

Further Compound A-2 the same as used in Example 1 was added in an amount of $2.6\times10^{-3}$ mol per mol of silver.

Silver Chlorobromide Emulsion F and Emulsified Product F prepared in the same manner as Emulsified Product D and containing Coupler (ExC-2) for cyan coloration were mixed and dissolved to prepare a coating solution for the fifth layer.

Yellow Coupler (ExY-2)

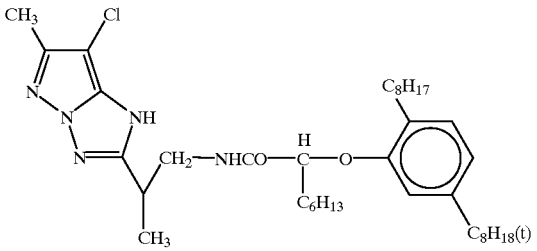

Magenta Coupler (ExM-2)

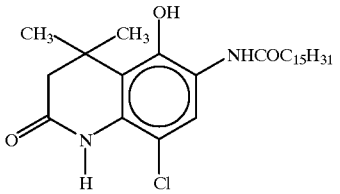

Cyan Coupler (ExC-2)

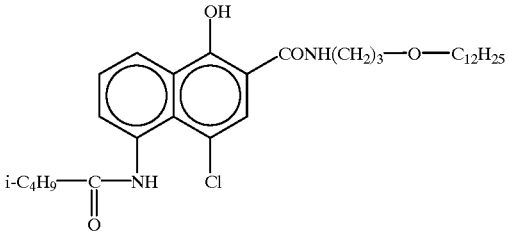

The coating solutions for the second, sixth and seventh layers were also prepared to have the composition described later.

With respect to the solvent, the dye image stabilizer, the ultraviolet absorbent, the color mixing inhibitor and the surface active agent, compounds the same as used in Example 1 were used.

As a gelatin hardening agent in each layer, 1-oxy-3,5-dichloro-s-triazine sodium salt was used.

Further, Cpd-4 and Cpd-5 were added to each layer to give a total coverage of 25 mg/m$^2$ and 50 mg/m$^2$, respectively.

Furthermore, 1-(5-methylureidophenyl)-5-mercaptotetrazole was added to the blue-sensitive emulsion layer, the green-sensitive emulsion layer and the red-sensitive emulsion layer in an amount of $8.5\times10^{-5}$ mol/mol-Ag, $9.0\times10^{-4}$ mol/mol-Ag and $2.5\times10^{-4}$ mol/mol-Ag, respectively. Still further, 4-hydroxy-6-methyl-1,3,3a,7-tetrazaindene was added to the blue-sensitive emulsion layer and the green-sensitive emulsion layer in an amount of $1\times10^{-4}$ mol/mol-Ag and $2\times10^{-4}$ mol/mol-Ag, respectively.

Also, for the prevention of irradiation, the dyes the same as used in Sample (100) of Example 1 were added to the emulsion layers in the same amount.

(Layer Structure) The composition of each layer is shown below, The numerals show the coated amount (g/m$^2$). In the case of silver halide emulsion, it is a coated amount in terms of silver.

TABLE 8

| | |
|---|---|
| Support | |
| Polyethylene laminated paper [Polyethylene on the first layer side contains a white pigment ($TiO_2$) and a bluish dye (ultramarine).] | |
| First Layer (Blue-sensitive Emulsion Layer) | |
| Silver Chlorobromide Emulsion D described above | 0.20 |
| Gelatin | 1.54 |
| Cyan Coupler (ExY-2) | 0.35 |
| Reducing Agent (I-49) for color formation | 0.26 |
| Solvent (Solv-1) | 0.78 |
| Second Layer (Color Mixing Preventing Layer) | |
| Gelatin | 1.00 |
| Color Mixing Inhibitor (Cpd-1) | 0.08 |
| Solvent (Solv-1) | 0.25 |
| Solvent (Solv-2) | 0.15 |
| Solvent (Solv-3) | 0.13 |
| Third Layer (Green-sensitive Emulsion Layer) | |
| Silver Chlorobromide Emulsion E | 0.20 |
| Gelatin | 1.55 |
| Magenta Coupler (ExM-2) | 0.34 |
| Reducing Agent (I-49) for color formation | 0.26 |
| Solvent (Solv-4) | 0.78 |

TABLE 9

| | |
|---|---|
| Fourth Layer (Color Mixing Preventing Layer) | |
| Gelatin | 1.00 |
| Color Mixing Inhibitor (Cpd-1) | 0.08 |
| Solvent (Solv-1) | 0.25 |
| Solvent (Solv-2) | 0.15 |
| Solvent (Solv-3) | 0.13 |
| Fifth Layer (Red-sensitive Emulsion Layer) | |
| Silver Chlorobromide Emulsion F | 0.20 |
| Gelatin | 1.50 |
| Cyan Coupler (ExC-2) | 0.29 |
| Reducing Agent (I-49) for color formation | 0.26 |
| Solvent (Solv-1) | 0.78 |
| Sixth Layer (Ultraviolet Absorbing Layer) | |
| Gelatin | 0.60 |
| Ultraviolet Absorbent (UV-1) | 0.57 |
| Dye Image Stabilizer (Cpd-2) | 0.06 |
| Solvent (Solv-1) | 0.05 |
| Seventh Layer (Protective Layer) | |
| Gelatin | 1.00 |
| Acryl-modified polymer of polyvinyl alcohol (modification degree: 17%) | 0.05 |
| Liquid paraffin | 0.02 |
| Surface Active Agent (Cpd-3) | 0.01 |

Then, Sample (401) was prepared thoroughly in the same manner as above except for adding Auxiliary Developing Agent Precursor (ETA-49) to the light-sensitive layers as the first layer, the third layer and the fifth layer, in an amount of $1.4\times10^{-4}$ mol/m$^2$.

The thus-prepared samples each was cut and subjected to gradation exposure through a three-color separation filter for sensitometry using a sensitometry (Model FW, manufactured by Fuji Photo Film Co., Ltd.; color temperature of light source: 3200° K.).

After the completion of exposure, samples were continuously processed using the following processing steps and processing solution compositions.

| Processing Step | Temperature (° C.) | Time (sec.) |
|---|---|---|
| Development | 40 | 30 |
| Bleach-fixing | 40 | 15 |
| Stabilization | 30 | 10 |
| Drying | 80 | 10 |

| Developer-3 | Tank Solution | |
|---|---|---|
| Water | 800 | ml |
| Sodium 5-sulfosalicylate | 29 | g |
| Disodium-N,N-bis(sulfonatoethyl)-hydroxylamine | 3.3 | g |
| Potassium chloride | 10 | g |
| Hydroxyethylidene-1,1-diphosphonic acid (30% solution) | 4 | ml |
| 1-Phenyl-4-methyl-4-hydroxymethyl-3-pyrazolidone | 1.5 | g |
| Water to make | 1 | l |
| pH | 12.0 | |

Developer-4 (alkali activating solution)

A solution resulting from the elimination of an auxiliary developing agent (i.e., 1-phenyl-4-methyl-4-hydroxymethyl-3-pyrazolidone) from Developer-3 was used.

The bleach-fixing solution used was the same as the tank solution of the bleach-fixing solution in Example 1.

| Stabilizing Solution | | |
|---|---|---|
| Water | 900 | ml |
| Potassium hydrogencarbonate | 15 | g |
| Hydroxyethylidene-1,1-diphosphonic acid (30% solution) | 10 | ml |
| Triethanolamine | 2 | g |
| 5-Chloro-2-methyl-4-isothiazolin-3-one | 0.02 | g |
| Water to make | 1 | l |
| pH | 9.5 | |

After the processing, image densities of yellow, magenta and cyan were determined through a B, G, R filter corresponding to respective dyes and the minimum density (Dmin) and the maximum density (Dmin) of each image was determined. At the same time, the magenta image part was measured through a B, R filter and the mixing degree of yellow and cyan colors formed above and below the magenta color forming layer was evaluated. The results are shown in Table 10.

The color mixing was shown by the density of each color at the exposure site where the magenta density was 1.0.

TABLE 10

| | Sample | Developer | Cyan Density | | Magenta Density | | Yellow Density | | Color Mixing | |
|---|---|---|---|---|---|---|---|---|---|---|
| No. | No. | No. | Dmax | Dmin | Dmax | Dmin | Dmax | Dmin | Yellow | Cyan |
| 4-1 | (400) | 3 | 1.87 | 0.13 | 2.23 | 0.14 | 2.15 | 0.15 | 0.56 | 0.22 |
| 4-2 | (401) | 4 | 2.03 | 0.10 | 2.36 | 0.11 | 2.37 | 0.11 | 0.35 | 0.14 |

As a result, it is found that when a sample where Auxiliary Developing Agent Precursor (ETA-49) was added to the light-sensitive material, was processed in an alkali activating bath, an image having a low minimum density and a high maximum density could be obtained. Further, the color mixing was unexpectedly small and the image was sharp.

The same experiment was conducted using Compound (I-36), (I-37), (I-44), (I-50) or (I-56) in place of Reducing Agent I-49 for color formation of Sample (401) and as a result, an image having a low minimum density and a high maximum density and low in the color mixing degree could be likewise obtained with these compounds.

EXAMPLE 5

Samples (501), (502), (503), (504), (505) and (506) were prepared thoroughly in the same manner as Sample (400) in Example 4 except for adding Compounds (ETA-14), (ETA-20), (ETA-24), (ETA-49), (ETA-50) or (ETA-51) as an auxiliary developing agent or a precursor thereof to interlayers of the second and fourth layers each in an amount of $2.0\times10^{-4}$ mol. Each sample was processed using an alkali activating solution of Example 4 (Developer 4) and evaluated in the same manner as in Example 4. The results obtained are shown in Table 11.

TABLE 11

| | Sample | Developer | Auxiliary Developing Agent or Precursor | Cyan Density | | Magenta Density | | Yellow Density | | Color Mixing | |
|---|---|---|---|---|---|---|---|---|---|---|---|
| No. | No. | No. | Thereof | Dmax | Dmin | Dmax | Dmin | Dmax | Dmin | Yellow | Cyan |
| 5-1 | (501) | 4 | ETA-14 | 2.06 | 0.10 | 2.39 | 0.11 | 2.40 | 0.11 | 0.39 | 0.15 |
| 5-2 | (502) | 4 | ETA-20 | 2.08 | 0.10 | 2.41 | 0.11 | 2.42 | 0.11 | 0.39 | 0.15 |
| 5-3 | (503) | 4 | ETA-24 | 2.09 | 0.10 | 2.41 | 0.11 | 2.43 | 0.11 | 0.38 | 0.14 |
| 5-4 | (504) | 4 | ETA-49 | 2.00 | 0.10 | 2.35 | 0.10 | 2.36 | 0.10 | 0.35 | 0.14 |
| 5-5 | (505) | 4 | ETA-50 | 2.01 | 0.10 | 2.36 | 0.10 | 2.36 | 0.10 | 0.35 | 0.14 |
| 5-6 | (506) | 4 | ETA-51 | 2.00 | 0.10 | 2.34 | 0.10 | 2.35 | 0.10 | 0.34 | 0.13 |

As a result, an image having a low minimum density and a high maximum density and unexpectedly low in the color mixing degree could be obtained on each sample the same as the case using the auxiliary developing agent precursor of Example 4.

Further, it is found that when an auxiliary developing agent precursor was incorporated into the light-sensitive material, the sensitivity upon high-illuminance exposure for $10^{-4}$ second was higher than that when an auxiliary developing agent itself was incorporated.

By processing a light-sensitive material containing a reducing agent for color formation, a coupler and an auxiliary developing agent and/or a precursor thereof according to the present invention in an alkali bath, an image having a low minimum density and a high maximum density can be obtained. Further, an image good in the processing stability in a continuous processing and small in color mixing and stains can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon photographic constituent layers including at least one light-sensitive silver halide emulsion layer and at least one light-insensitive layer, wherein at least one of said photographic constituent layers contains at least one coupler for dye formation, at least one reducing agent for color formation represented by the following formula (I), and an auxiliary developing agent and/or a precursor of an auxiliary developing agent, wherein the constituent layer which contains the auxiliary developing agent and/or the precursor of an auxiliary developing agent is the light-insensitive layer:

$$R^{11}—NH—NH—X—R^{12} \quad (I)$$

wherein $R^{11}$ represents an aryl or heterocyclic group; $R^{12}$ represents an alkyl, alkenyl, alkynyl, aryl or heterocyclic group; and X represents $—SO_2—$, —CO—, —COCO—, —CO—O—, —CO—, $—N(R^{13})—$, —COCO—O—, $—COCO—N(R^{13})—$ or $—SO_2—N(R^{13})—$, wherein $R^{13}$ represents a hydrogen atom or a group described for $R^{12}$.

2. A silver halide color photographic material as claimed in claim 1, wherein the precursor of the auxiliary developing agent is represented by the following formula (A):

$$A—(L)_n—PUG \quad (A)$$

wherein A represents a block group which cleaves the bond to $(L)_n$—PUG upon development, L represents a linking group which cleaves the bond between L and PUG after the cleavage of the bond between L and A, n represents an integer of from 0 to 3, and PUG represents an auxiliary developing agent.

3. A silver halide color photographic material as claimed in claim 1, wherein the auxiliary developing agent is a pyrazolidone, a dihydroxybenzene, a reductone or an aminophenol.

4. A silver halide color photographic material as claimed in claim 1, wherein the auxiliary developing agent and/or a precursor thereof has a solubility in water of 0.1% or less.

5. A silver halide color photographic material as claimed in claim 1, wherein the total coated silver amount of all coated layers is from 0.003 to 0.3 $g/m^2$.

6. A silver halide color photographic material as claimed in claim 1, wherein the reducing agent for color formation is used in an amount of from $1\times10^{-5}$ to $1\times10^{-2}$ mol per $m^2$ of each photographic layer.

7. A silver halide color photographic material as claimed in claim 1, wherein the auxiliary developing agent or precursor thereof is used in an amount of from 1 to 200 mol % based on the reducing agent for color formation.

8. A silver halide color photographic material as claimed in claim 1, wherein the coupler for dye formation is a pyrazolone coupler, a pyrazoloazole coupler, a phenyl coupler, a naphthol coupler or a pyrrolotriazole coupler.

9. A silver halide color photographic material as claimed in claim 1, wherein the silver halide emulsion layer comprises silver chloride emulsion, or silver chlorobromide emulsion or silver chloroiodobromide emulsion having a silver chloride content of 95% or more.

10. A silver halide photographic material as claimed in claim 1, wherein said auxiliary developing agent and/or precursor of an auxiliary developing agent is an auxiliary developing agent represented by the following formula (B-1), (B-2) or (B-3) or a precursor of an auxiliary developing agent represented by the following formula (A):

(B-1)

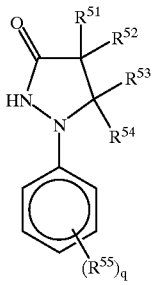

(B-2)

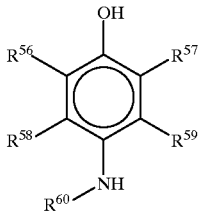

$R^{51}$, $R^{52}$, $R^{53}$ and $R^{54}$ each represents a hydrogen atom, an alkyl group, an aryl group, or a heterocyclic group; $R^{55}$, $R^{56}$, $R^{57}$, $R^{58}$ and $R^{59}$ each represents a hydrogen atom, a halogen atom, an alkyl group, a cycloalkyl group, an alkenyl group, an aryl group, a heterocyclic group, an alkoxy group, a cycloalkyloxy group, an aryloxy group, a heterocyclic oxy group, a silyloxy group, an acyloxy group, an amino group, an anilino group, a heterocyclic amino group, an alkylthio group, an arylthio group or a heterocyclic thio group, a cyano group, a silyl group, a hydroxyl group, a nitro group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, a carbonamido group, a ureido group, an imido group, an alkoxycarbonylamino group, an aryloxycarbonylamino, a sulfonamido group, a sulfamoylamino group, an alkylsulfinyl group, an arenesulfinyl group, an alkanesulfonyl group, an arenesulfonyl group, a sulfamoyl group, a sulfo group, a phosphinoyl group or a phosphinoylamino group; q represents an integer of from 0 to 5 and when q is 2 or greater, the $R^{55}$ groups may be the same or different, and $R^{60}$ represents an alkyl group or an aryl group;

(B-3)

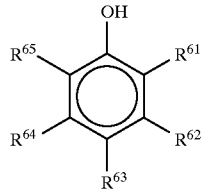

$R^{61}$, $R^{62}$, $R^{63}$, $R^{64}$ and $R^{65}$ represents a hydrogen atom, a halogen atom, an alkyl group, a cycloalkyl group, an alkenyl group, an aryl group, a heterocyclic group, an alkoxy group, a cycloalkyloxy group, an aryloxy group, a heterocyclic oxy group, a silyloxy group, an acyloxy group, an amino group, an anilino group, a heterocyclic amino group, an alkylthio group, an arylthio group, a heterocyclic thio group, a cyano group, a silyl group, a hydroxyl group, a nitro group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, a carbonamido group, a ureido group, an imido group, an alkoxycarbonylamino group, an aryloxycarbonylamino, a sulfonamido group, a sulfamoylamino group, an alkylsulfinyl group, an arenesulfinyl group, an alkanesulfonyl group, an arenesulfonyl group, a sulfamoyl group, a sulfo group, a phosphinoyl group or a phosphinoylamino group; and at least one of $R^{61}$, $R^{62}$, $R^{63}$, $R^{64}$ and $R^{65}$ represents a hydroxy group;

$$A—(L)_n—PUG \quad (A)$$

wherein PUG represents a group obtained by eliminating a hydrogen atom from OH or NH of an auxiliary developing agent represented by formula (B-1); A represents a block group which cleaves the bond to $(L)_n$—PUG upon development, L represents a linking group which cleaves the bond between L and PUG after the cleavage of the bond between L and A, and n represents an integer of from 0 to 3.

11. A silver halide photographic material as claimed in claim 10, wherein said auxiliary developing agent and/or precursor of an auxiliary developing agent is a precursor of an auxiliary developing agent represented by formula (A).

12. A silver halide photographic material as claimed in claim 10, wherein said auxiliary developing agent and/or precursor of an auxiliary developing agent is an auxiliary developing agent represented by formula (B-1).

13. A silver halide photographic material as claimed in claim 10, wherein said auxiliary developing agent and/or precursor of an auxiliary developing agent is an auxiliary developing agent represented by formula (B-2).

14. A silver halide photographic material as claimed in claim 10, wherein said auxiliary developing agent and/or precursor of an auxiliary developing agent is an auxiliary developing agent represented by formula (B-3).

15. A silver halide photographic material as claimed in claim 1, wherein said auxiliary developing agent and/or precursor of an auxiliary developing agent is an auxiliary developing agent represented by the following formula (B-1), (B-2) or (B-3):

(B-1)

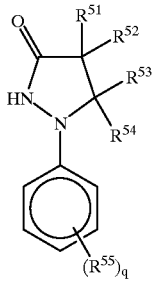

(B-2)

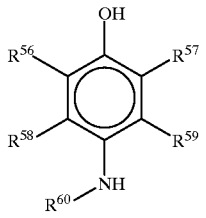

$R^{51}$, $R^{52}$, $R^{53}$ and $R^{54}$ each represents a hydrogen atom, an alkyl group, an aryl group, or a heterocyclic group; $R^{55}$, $R^{56}$, $R^{57}$, $R^{58}$ and $R^{59}$ each represents a hydrogen atom, a halogen atom, an alkyl group, a cycloalkyl group, an alkenyl group, an aryl group, a heterocyclic group, an alkoxy group, a cycloalkyloxy group, an aryloxy group, a heterocyclic oxy group, a silyloxy group, an acyloxy group, an amino group, an anilino group, a heterocyclic amino group, an alkylthio group, an arylthio group, a heterocyclic thio group, a cyano group, a silyl group, a hydroxyl group, a nitro group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, a carbonamido group, a ureido group, an imido group, an alkoxycarbonylamino group, an aryloxycarbonylamino, a sulfonamido group, a sulfamoylamino group, an alkylsulfinyl group, an arenesulfinyl group, an alkanesulfonyl group, an arenesulfonyl group, a sulfamoyl group, a sulfo group, a phosphinoyl group or a phosphinoylamino group; q represents an integer of from 0 to 5 and when q is 2 or greater, the $R^{55}$ groups may be the same or different, and $R^{60}$ represents an alkyl group or an aryl group;

(B-3)

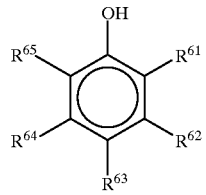

$R^{61}$, $R^{62}$, $R^{63}$, $R^{64}$ and $R^{65}$ represents a hydrogen atom, a halogen atom, an alkyl group, a cycloalkyl group, an alkenyl group, an aryl group, a heterocyclic group, an alkoxy group, a cycloalkyloxy group, an aryloxy group, a heterocyclic oxy group, a silyloxy group, an acyloxy group, an amino group, an anilino group, a heterocyclic amino group, an alkylthio group, an arylthio group, a heterocyclic thio group, a cyano group, a silyl group, a hydroxyl group, a nitro group, an alkoxycarbonyloxy group, a cycloalkyloxy-carbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, a carbonamido group, a ureido group, an imido group, an alkoxycarbonylamino group, an aryloxycarbonylamino, a sulfonamido group, a sulfamoylamino group, an alkylsulfinyl group, an arenesulfinyl group, an alkanesulfonyl group, an arenesulfonyl group, a sulfamoyl group, a sulfo group, a phosphinoyl group or a phosphinoylamino group; and at least one of $R^{61}$, $R^{62}$, $R^{63}$, $R^{64}$ and $R^{65}$ represents a hydroxy group.

* * * * *